US010368657B2

(12) United States Patent
Lilja et al.

(10) Patent No.: US 10,368,657 B2
(45) Date of Patent: Aug. 6, 2019

(54) CHANNEL GLIDE ASSEMBLIES

(71) Applicants: Eva Lilja, Corona, CA (US); Brendan Hingston Lake, Sheung Wan (HK)

(72) Inventors: Eva Lilja, Corona, CA (US); Brendan Hingston Lake, Sheung Wan (HK)

( * ) Notice: Subject to any disclaimer, the term of this patent is extended or adjusted under 35 U.S.C. 154(b) by 0 days.

(21) Appl. No.: 14/866,767

(22) Filed: Sep. 25, 2015

(65) Prior Publication Data

US 2016/0088955 A1 Mar. 31, 2016

Related U.S. Application Data

(60) Provisional application No. 62/056,390, filed on Sep. 26, 2014, provisional application No. 62/083,443, filed on Nov. 24, 2014.

(51) Int. Cl.
*A47F 1/12* (2006.01)
*A47F 5/00* (2006.01)

(52) U.S. Cl.
CPC ..... *A47F 1/12* (2013.01); *A47F 5/005* (2013.01); *A47F 5/0068* (2013.01); *A47B 2220/0044* (2013.01)

(58) Field of Classification Search
CPC ..... A47F 1/04; A47F 1/06; A47F 1/08; A47F 1/087; A47F 1/12; A47F 1/125; A47F 1/126; A47F 5/005; A47F 5/0068; A47F 7/17
USPC ..... 211/59.2
See application file for complete search history.

(56) References Cited

U.S. PATENT DOCUMENTS 2,218,444 A * 10/1940 Vineyard ..... A47F 1/12 193/15
2,984,031 A 5/1961 Giesecke
3,001,754 A 9/1961 Fowler
3,270,450 A 9/1966 Flum
3,429,428 A 2/1969 Fowler
3,853,073 A 12/1974 Flum et al.
3,865,250 A 2/1975 Jay
4,042,096 A * 8/1977 Smith ..... A47F 1/126 211/134

(Continued)

FOREIGN PATENT DOCUMENTS

CA 89388 S 6/1904
CA 89389 S 10/1904

(Continued)

OTHER PUBLICATIONS

International Search Report and Written Opinion in corresponding International Patent Application No. PCT/US2015/052476, dated Jan. 29, 2016, in 11 pages.

(Continued)

*Primary Examiner* — Ko H Chan
(74) *Attorney, Agent, or Firm* — Knobbe, Martens, Olson & Bear, LLP

(57) ABSTRACT

Various embodiments of a channel glide assembly are disclosed. In some embodiments, the assembly includes a channel glide having a base with a first channel and a second channel, a first fence on a lateral outside side of the first channel, a second fence on a lateral outside side of the second channel, an intermediate fence positioned between the first and second channel, and a front stop unit removably connected with the base. In certain embodiments, the front stop unit is a different material than the base.

20 Claims, 47 Drawing Sheets

(56) References Cited

U.S. PATENT DOCUMENTS 4,140,224 A * 2/1979 Celeste ..... A47B 96/027 211/134
4,246,710 A * 1/1981 Mixer ..... A47F 5/0869 211/57.1
4,332,204 A 6/1982 Hewell
4,334,374 A 6/1982 Spamer et al.
4,351,244 A 9/1982 Suttles
4,351,246 A 9/1982 Hutchins, Jr.
4,367,818 A 1/1983 Suttles
4,401,223 A 8/1983 Spamer
4,416,380 A 11/1983 Flum
4,423,816 A 1/1984 Suttles
4,423,818 A 1/1984 Spamer
4,426,011 A 1/1984 Jay
4,454,948 A 6/1984 Spamer
4,454,949 A 6/1984 Flum
4,460,096 A 7/1984 Ricci
D275,058 S 8/1984 Flum
4,470,943 A 9/1984 Preis
4,478,337 A 10/1984 Flum
4,496,037 A 1/1985 Spamer
4,506,790 A 3/1985 Muscari
4,535,704 A 8/1985 Suttles
4,565,725 A 1/1986 Spamer
4,574,709 A 3/1986 Lackey et al.
4,589,349 A 5/1986 Gebhardt et al.
4,593,823 A 6/1986 Fershko et al.
4,598,828 A 7/1986 Young et al.
4,610,363 A 9/1986 Flum et al.
4,615,276 A * 10/1986 Garabedian ..... A47F 5/005 108/61
4,633,788 A 1/1987 Roberston
4,653,651 A 3/1987 Flum
D290,795 S 7/1987 Gebhardt
4,678,088 A 7/1987 Flum
4,685,574 A 8/1987 Young et al.
4,706,820 A 11/1987 Spamer et al.
D293,865 S 1/1988 Robertson
4,716,841 A 1/1988 Suttles
D294,090 S 2/1988 Robertson
4,724,682 A 2/1988 Flum et al.
D295,195 S 4/1988 Stoddard
4,750,623 A 6/1988 Flum
4,756,430 A 7/1988 Spamer et al.
4,763,796 A 8/1988 Flum
4,801,024 A 1/1989 Flum et al.
4,801,025 A 1/1989 Flum et al.
4,886,171 A 12/1989 Spamer
4,899,893 A 2/1990 Robertson
4,925,357 A 5/1990 Cisternino et al.
4,930,643 A 6/1990 Flum
4,946,032 A 8/1990 Stoddard et al.
4,953,719 A 9/1990 Spamer
4,958,739 A 9/1990 Spamer
4,960,210 A 10/1990 Spamer
RE33,515 E 1/1991 Fershko et al.
4,982,840 A 1/1991 Bidwell et al.
4,982,849 A 1/1991 Flum et al.
4,997,094 A 3/1991 Spamer et al.
5,016,527 A 5/1991 Spamer et al.
5,016,545 A 5/1991 Robertson et al.
5,016,759 A 5/1991 Spamer
5,016,761 A 5/1991 Stoddard et al.
5,022,535 A 6/1991 Spamer
5,022,541 A 6/1991 White
5,024,336 A 6/1991 Spamer
D317,844 S 7/1991 Stoddard et al.
5,039,002 A 8/1991 Spamer
D319,849 S 9/1991 Stoddard et al.
5,048,171 A 9/1991 Bidwell et al.
5,050,748 A 9/1991 Taub
D323,262 S 1/1992 Flum
D326,800 S 6/1992 Flum
D326,801 S 6/1992 Flum
D327,097 S 6/1992 Stoddard et al.
5,161,699 A 11/1992 Hanna et al.
5,169,020 A 12/1992 Spamer
D333,748 S 3/1993 Stoddard et al.
5,190,211 A 3/1993 Stoddard et al.
5,191,997 A 3/1993 Squitieri
D334,859 S 4/1993 Homann
5,205,638 A 4/1993 Squitieri
D336,803 S 6/1993 Stoddard et al.
5,238,128 A 8/1993 Stoddard
D339,270 S 9/1993 Homann
5,265,738 A 11/1993 Yablans et al.
D343,327 S 1/1994 Bailey et al.
D344,419 S 2/1994 Stoddard
5,313,891 A 5/1994 Suttles
D349,203 S 8/1994 Kelemen et al.
5,351,838 A 10/1994 Flum
D354,639 S 1/1995 Stoddard et al.
D354,640 S 1/1995 Flum
D354,641 S 1/1995 Stoddard et al.
D354,642 S 1/1995 Stoddard et al.
D354,885 S 1/1995 Lanius
D355,995 S 3/1995 Stoddard et al.
D357,026 S 4/1995 Kelemen et al.
5,417,333 A 5/1995 Flum
D358,955 S 6/1995 Fowler
5,448,844 A 9/1995 Miller, Jr. et al.
5,450,971 A 9/1995 Boron et al.
5,457,859 A 10/1995 Kacprowicz et al.
D364,760 S 12/1995 Robertson et al.
D364,880 S 12/1995 Robertson et al.
D367,975 S 3/1996 Robertson et al.
D368,396 S 4/1996 Bidwell
D371,916 S 7/1996 Kacprowicz
5,531,336 A 7/1996 Parham et al.
5,562,217 A 10/1996 Salveson et al.
5,586,687 A 12/1996 Spamer et al.
5,590,541 A 1/1997 Rainwater
5,595,310 A 1/1997 Spamer
5,597,150 A 1/1997 Stein et al.
5,622,261 A 4/1997 Mobley et al.
5,624,042 A 4/1997 Flum et al.
5,634,564 A 6/1997 Spamer et al.
5,645,176 A 7/1997 Jay
5,645,182 A 7/1997 Miller, Jr. et al.
D383,933 S 9/1997 Robertson
D384,855 S 10/1997 Robertson
D385,438 S 10/1997 Jay
5,673,801 A 10/1997 Markson
5,685,664 A 11/1997 Parham et al.
5,695,075 A 12/1997 Flum et al.
5,695,076 A 12/1997 Jay
5,695,077 A 12/1997 Jay
D389,363 S 1/1998 Robertson
5,706,956 A 1/1998 Headrick et al.
5,706,958 A 1/1998 Spamer
5,706,978 A 1/1998 Spamer
5,711,432 A 1/1998 Stein et al.
D390,723 S 2/1998 Jay
D391,101 S 2/1998 Robertson
D391,102 S 2/1998 Robertson
D391,103 S 2/1998 Robertson
5,718,341 A 2/1998 Robertson
D393,550 S 4/1998 Jay
5,755,341 A 5/1998 Spamer
D395,179 S 6/1998 Primiano et al.
5,779,068 A 7/1998 Whiten et al.
5,785,189 A 7/1998 Gollob
5,788,090 A 8/1998 Kajiwara
5,788,091 A 8/1998 Robertson
5,806,417 A 9/1998 Whiten
D399,377 S 10/1998 Robertson et al.
D401,436 S 11/1998 Jay
D401,437 S 11/1998 Primiano et al.
D402,490 S 12/1998 Parham
D402,829 S 12/1998 Jay
5,855,281 A 1/1999 Rabas
D405,632 S 2/1999 Parham
5,865,324 A 2/1999 Jay
5,865,326 A 2/1999 Spamer et al.

(56) References Cited

U.S. PATENT DOCUMENTS

D406,712 S 3/1999 Bidwell
5,875,919 A 3/1999 Spamer et al.
5,878,894 A 3/1999 Robertson
D407,928 S 4/1999 Bidwell
5,904,256 A 5/1999 Jay
5,910,162 A 6/1999 Harbour et al.
D412,078 S 7/1999 Bidwell
D413,217 S 8/1999 Bidwell et al.
D413,745 S 9/1999 Bidwell et al.
5,957,327 A 9/1999 Whiten
5,975,318 A 11/1999 Jay
D421,350 S 3/2000 Bidwell et al.
6,059,125 A 5/2000 Parham
6,068,142 A * 5/2000 Primiano ..... A47F 3/0486 211/183
D426,092 S 6/2000 Neustadt
6,082,556 A 7/2000 Primiano et al.
6,102,496 A 8/2000 Parham
6,105,791 A 8/2000 Chalson et al.
6,142,316 A * 11/2000 Harbour ..... A47F 1/12 211/59.2
6,173,845 B1 1/2001 Higgins et al.
6,186,345 B1 2/2001 Robertson
6,209,731 B1 4/2001 Spamer et al.
6,209,733 B1 4/2001 Higgins et al.
6,234,325 B1 5/2001 Higgins et al.
6,234,326 B1 5/2001 Higgins et al.
6,237,784 B1 5/2001 Primiano
6,276,538 B1 * 8/2001 Battaglia ..... A47F 1/12 108/108
6,325,221 B2 12/2001 Parham
6,360,901 B1 3/2002 Parham
D455,295 S 4/2002 Miller
6,363,640 B1 4/2002 Flum et al.
6,380,799 B1 4/2002 Chung et al.
D457,014 S 5/2002 Miller
6,398,044 B1 6/2002 Robertson
D459,738 S 7/2002 Menz
D460,291 S 7/2002 Miller et al.
6,419,100 B1 7/2002 Menz et al.
6,435,359 B1 8/2002 Primiano
6,439,402 B2 8/2002 Robertson
D463,188 S 9/2002 Miller et al.
6,474,484 B1 11/2002 Miller, Jr.
6,478,268 B1 11/2002 Bidwell et al.
6,505,747 B1 1/2003 Robertson
6,520,356 B2 2/2003 Miller, Jr.
6,523,702 B1 2/2003 Primiano et al.
6,523,703 B1 2/2003 Robertson
6,554,143 B1 4/2003 Robertson
D475,896 S 6/2003 Flum
6,585,120 B2 7/2003 Robertson
6,588,606 B2 7/2003 Miller, Jr. et al.
6,604,637 B2 8/2003 Primiano et al.
6,604,638 B1 8/2003 Primiano et al.
6,612,123 B2 9/2003 Miller, Jr. et al.
6,615,995 B2 9/2003 Primiano et al.
6,629,431 B1 10/2003 Robertson
6,637,233 B1 10/2003 Flum
6,637,604 B1 10/2003 Jay et al.
6,640,983 B2 11/2003 Miller, Jr.
D485,452 S 1/2004 Boron et al.
D485,459 S 1/2004 Bidwell et al.
D485,460 S 1/2004 Bidwell et al.
D485,712 S 1/2004 Bidwell et al.
D485,713 S 1/2004 Boron et al.
D485,714 S 1/2004 Boron et al.
D485,715 S 1/2004 Boron
D485,716 S 1/2004 Boron
D485,717 S 1/2004 Boron
D485,718 S 1/2004 Boron
6,672,464 B2 1/2004 Robertson
6,679,389 B1 1/2004 Robertson et al.
6,681,950 B2 1/2004 Miller, Jr. et al.
D486,018 S 2/2004 Bidwell et al.
D486,331 S 2/2004 Boron
6,688,478 B2 2/2004 Miller, Jr. et al.
6,695,152 B1 2/2004 Fabrizio et al.
6,702,127 B2 3/2004 Primiano
6,715,621 B2 * 4/2004 Boron ..... A47F 1/12 211/175
6,722,509 B1 4/2004 Robertson et al.
6,726,039 B2 4/2004 Boron
6,745,905 B2 6/2004 Bernstein
6,766,911 B2 7/2004 Higgins
6,779,670 B2 8/2004 Primiano et al.
D496,054 S 9/2004 Flum
6,830,157 B2 12/2004 Robertson et al.
6,860,046 B1 3/2005 Squitieri
6,874,646 B2 4/2005 Jay
6,880,708 B2 4/2005 Boron
D508,826 S 8/2005 Bidwell et al.
D509,390 S 9/2005 Boron et al.
6,938,791 B2 9/2005 Robertson et al.
6,955,269 B2 10/2005 Menz et al.
D511,639 S 11/2005 Boron et al.
6,962,260 B2 11/2005 Jay et al.
6,964,235 B2 11/2005 Hardy
6,978,888 B1 12/2005 Sanders
7,032,761 B2 4/2006 Nagel
7,044,424 B2 5/2006 Robertson et al.
7,044,483 B2 5/2006 Robertson et al.
D522,276 S 6/2006 Povich et al.
7,066,340 B2 6/2006 Robertson
7,080,744 B2 7/2006 Robertson
7,083,054 B2 8/2006 Squitieri
7,086,541 B2 8/2006 Robertson
7,093,546 B2 8/2006 Hardy
7,104,410 B2 9/2006 Primiano
7,121,112 B2 10/2006 Robertson
7,182,209 B2 2/2007 Squitieri
7,191,905 B2 3/2007 Robertson
7,269,970 B2 9/2007 Robertson
7,293,381 B2 11/2007 Primiano et al.
7,306,106 B2 12/2007 Robertson
7,444,825 B2 11/2008 Miller, Jr. et al.
7,448,504 B2 11/2008 Primiano
7,484,628 B2 2/2009 Schneider
7,556,159 B2 7/2009 Robertson
7,584,862 B2 9/2009 Robertson
7,665,618 B2 * 2/2010 Jay ..... A47F 1/12 211/59.2
7,703,614 B2 4/2010 Schneider et al.
D626,762 S 11/2010 Primiano
7,854,333 B2 * 12/2010 Kottke ..... A47F 1/12 211/59.2
7,891,503 B2 2/2011 Hardy
7,918,365 B2 4/2011 White et al.
7,975,858 B2 7/2011 Schneider
7,980,417 B2 7/2011 Riley
8,016,139 B2 9/2011 Hanners et al.
8,020,714 B2 9/2011 Miller, Jr. et al.
8,028,855 B2 10/2011 White et al.
D450,726 S 11/2011 Menz
8,056,734 B2 11/2011 Menz et al.
8,066,128 B2 11/2011 Crawbuck et al.
8,104,630 B2 1/2012 Schneider
8,186,520 B2 5/2012 Schneider et al.
8,205,759 B2 6/2012 Schneider
8,215,795 B2 7/2012 Pichel
8,251,232 B2 8/2012 Nakaya et al.
8,333,285 B2 12/2012 Kiehnau et al.
8,387,806 B2 3/2013 Schneider
8,413,826 B2 4/2013 Schneider et al.
8,453,851 B2 6/2013 Ciesick
8,651,288 B2 2/2014 Squitieri
8,863,963 B2 10/2014 Hardy
8,922,467 B2 12/2014 Matsumoto et al.
8,967,394 B2 * 3/2015 Hardy ..... A47F 1/126 211/175
9,060,622 B2 6/2015 Neumann et al.
9,107,516 B2 * 8/2015 Pichel ..... A47F 1/04
9,198,527 B2 * 12/2015 Goehring ..... A47F 1/12
9,215,938 B2 12/2015 Neumann et al.

(56) References Cited

U.S. PATENT DOCUMENTS

| | | | | |
|---|---|---|---|---|
| 9,300,723 | B2 | 3/2016 | Rothschild et al. | |
| 9,380,889 | B2 | 7/2016 | Howard et al. | |
| 9,392,882 | B2 | 7/2016 | Pichel | |
| 9,526,356 | B2 | 12/2016 | Pichel et al. | |
| 2002/0088762 | A1 | 7/2002 | Burke | |
| 2002/0148794 | A1 | 10/2002 | Marihugh | |
| 2002/0179553 | A1 | 12/2002 | Squitieri | |
| 2003/0132182 | A1 | 7/2003 | Jay | |
| 2004/0004046 | A1 | 1/2004 | Primiano et al. | |
| 2004/0020877 | A1* | 2/2004 | Boron | A47F 1/12 211/59.2 |
| 2004/0084389 | A1 | 5/2004 | Robertson et al. | |
| 2004/0221600 | A1 | 11/2004 | Flum | |
| 2004/0245197 | A1 | 12/2004 | McElvaney | |
| 2005/0126448 | A1 | 6/2005 | Bernstein et al. | |
| 2005/0133471 | A1 | 6/2005 | Squitieri | |
| 2005/0166431 | A1 | 8/2005 | Boron et al. | |
| 2005/0199563 | A1 | 9/2005 | Richter et al. | |
| 2006/0037925 | A1 | 2/2006 | Wood et al. | |
| 2006/0043036 | A1 | 3/2006 | Robertson | |
| 2006/0054575 | A1 | 3/2006 | Robertson | |
| 2006/0102570 | A1 | 5/2006 | Robertson | |
| 2006/0207950 | A1 | 9/2006 | Kiehnau et al. | |
| 2006/0220501 | A1 | 10/2006 | Robertson | |
| 2006/0237384 | A1 | 10/2006 | Neumann et al. | |
| 2006/0248918 | A1 | 11/2006 | Robertson | |
| 2007/0063112 | A1 | 3/2007 | Patterson | |
| 2007/0176065 | A1 | 8/2007 | Schneider | |
| 2007/0295678 | A1 | 12/2007 | Higgins | |
| 2008/0000856 | A1 | 1/2008 | Primiano | |
| 2008/0005941 | A1 | 1/2008 | Primiano et al. | |
| 2008/0159910 | A1 | 7/2008 | Dick et al. | |
| 2008/0223804 | A1 | 9/2008 | Riley | |
| 2009/0308084 | A1 | 12/2009 | Kreutzer et al. | |
| 2010/0011798 | A1 | 1/2010 | Robertson et al. | |
| 2010/0014288 | A1 | 1/2010 | Kreutzer et al. | |
| 2010/0032391 | A1 | 2/2010 | Schneider et al. | |
| 2010/0032392 | A1 | 2/2010 | Camello et al. | |
| 2010/0307992 | A1 | 12/2010 | Robertson et al. | |
| 2011/0094980 | A1 | 4/2011 | Cousin et al. | |
| 2011/0290749 | A1 | 12/2011 | Neumann et al. | |
| 2012/0006771 | A1 | 1/2012 | Miller, Jr. et al. | |
| 2012/0074087 | A1 | 3/2012 | Neumann et al. | |
| 2012/0266437 | A1 | 10/2012 | Camello et al. | |
| 2013/0048648 | A1 | 2/2013 | Robertson et al. | |
| 2014/0223721 | A1 | 8/2014 | Cummings et al. | |
| 2014/0360953 | A1 | 12/2014 | Pichel | |
| 2015/0157141 | A1 | 6/2015 | Neumann et al. | |
| 2015/0257546 | A1 | 9/2015 | Pichel et al. | |
| 2016/0097516 | A1 | 4/2016 | Howard et al. | |
| 2016/0106234 | A1 | 4/2016 | Pichel et al. | |
| 2016/0150894 | A1 | 6/2016 | Howard et al. | |
| 2016/0206117 | A1 | 7/2016 | Howard et al. | |
| 2016/0210889 | A1 | 7/2016 | Francavilla et al. | |
| 2016/0278540 | A1 | 9/2016 | Gommermann et al. | |
| 2016/0309920 | A1 | 10/2016 | Botta et al. | |
| 2016/0316936 | A1 | 11/2016 | Camello et al. | |
| 2016/0324334 | A1 | 11/2016 | Pichel | |
| 2017/0007040 | A1 | 1/2017 | Howard et al. | |
| 2017/0020303 | A1 | 1/2017 | Atkins | |
| 2017/0035218 | A1 | 2/2017 | Riley et al. | |
| 2017/0049248 | A1 | 2/2017 | Lilja et al. | |

FOREIGN PATENT DOCUMENTS

| | | | |
|---|---|---|---|
| CA | 2528803 | C | 1/2014 |
| CN | 102245058 | A | 11/2011 |
| CN | 103038138 | A | 4/2013 |
| CN | 103976603 | A | 8/2014 |
| CN | 105682514 | A | 6/2016 |
| CN | 103284523 | B | 1/2017 |
| EP | 0928147 | A4 | 10/1999 |
| EP | 0928147 | B1 | 5/2003 |
| EP | 1239757 | B1 | 7/2006 |
| EP | 1489949 | B1 | 4/2015 |
| EP | 2633784 | B1 | 11/2015 |
| EP | 3001934 | A1 | 4/2016 |
| EP | 2457472 | B1 | 11/2016 |
| GB | 2479914 | A | 11/2011 |
| WO | WO 1988/009635 | A1 | 12/1988 |
| WO | WO 1999/023918 | A1 | 5/1999 |
| WO | WO 2003/090587 | A1 | 11/2003 |
| WO | WO 2009/021014 | A1 | 2/2009 |
| WO | WO 2009/152246 | A1 | 12/2009 |
| WO | WO 2010/071943 | A1 | 7/2010 |
| WO | WO 2014/200759 | A1 | 12/2014 |
| WO | WO 2015/006638 | A1 | 1/2015 |
| WO | WO 2015/038846 | A1 | 3/2015 |
| WO | 2016049587 | A1 | 3/2016 |
| WO | WO 2016/118407 | A1 | 7/2016 |
| WO | WO 2016/118602 | A1 | 7/2016 |
| WO | WO 2016/154616 | A1 | 9/2016 |
| WO | WO 2017/007885 | A1 | 1/2017 |
| WO | WO 2017/024295 | A1 | 2/2017 |
| WO | WO 2017/172830 | A1 | 10/2017 |

OTHER PUBLICATIONS

International Search Report and Written Opinion in corresponding International Patent Application No. PCT/US2017/024622, dated Jun. 21, 2017, in 9 pages.

Partial Supplementary European Search Report in corresponding European Patent Application No. 15844783.9, dated Feb. 14, 2018, in 10 pages.

Extended Search Report in corresponding European Patent Application No. 15844783.9, dated May 2, 2018, in 10 pages.

* cited by examiner

140

150

120

110

CHANNEL GLIDE ASSEMBLIES

CROSS-REFERENCE

This application claims the benefit of priority to U.S. Provisional Patent Application No. 62/056,390, filed Sep. 26, 2014, titled "CHANNEL GLIDE ASSEMBLIES," and U.S. Provisional Patent Application No. 62/083,443, filed Nov. 24, 2014, titled "IMPROVED DISPLAY APPARATUS," the entirety of each of which is hereby incorporated by reference herein and made a part of this application.

BACKGROUND

Field

The present disclosure relates to shelving systems, such as gravity-fed racks for displaying and storing goods.

Description of the Related Art

Various retail establishments use shelves to display and store goods. Because shelf space is limited, competition for shelf space can be intense. Shelf space limits can be even more significant in some situations, such as where the shelf is maintained in a freezer, refrigerator, or other cooled environment.

SUMMARY

In some embodiments, a channel glide includes a base having a first channel. The channel glide can include a first fence and a second fence. In some embodiments, the first fence is positioned on a first lateral outside side of the base and the second fence is positioned on a second lateral outside side of the base. In some embodiments, the base has a second channel. Certain embodiments have an intermediate fence positioned between the first and second channels. Some implementations have a front stop unit. The front stop unit can be removably connected with the base. In some embodiments, the front stop unit is a different material than the base.

In certain embodiments, the channel glide includes an extension portion. The extension portion can be connected with a rear of the base. In some implementations, the extension portion comprises one or more break points. The break points can enable a selectable part of the extension portion to be frangibly separated from a front portion of the extension portion.

In some embodiments, the channel glide has a rear stop unit. The rear stop unit can be removably connected with a rear of the base. In certain implementations, the rear portion of the channel glide has one or more break points. The break points can enable a selectable part of the rear portion to be frangibly separated from a front portion of the channel glide.

As mentioned above, the channel glide can include a front stop unit. In certain embodiments, the hardness of the front stop unit is greater than the hardness of the base. In some variants, the front stop unit has a woodgrain appearance. In some implementations, the front stop unit is slidably engaged with the first fence, second fence, and/or intermediate fence. In some embodiments, the front stop unit includes one or more rails. In some implementations, at least two of the rails have a catch. The catch can be angled toward a longitudinal centerline of one of the channels and/or toward the front of the channel glide.

In certain implementations, the first fence includes a first connection member and/or the second fence includes a second connection member. The first connection member can be configured to engage a second connection member of another channel glide that is laterally adjacent to the first fence. The second connection member can be configured to engage a first connection member of another channel glide that is laterally adjacent to the second fence.

In some embodiments, a product display and/or dispensing system includes the channel glide and a channel strip. The channel strip can have a body having a front face. The front face can be configured to receive indicia. The channel strip can include one or more clamping members. The clamping members can be configured to engage a shelf on which the channel glide rests, such as a shelf in a cooler, refrigerator, case, display stand or cart, or otherwise. In some embodiments, the channel strip has one or more frangible portions, such as scores. The scores can be about equally spaced or unequally spaced. The scores can be configured to facilitate breaking of the channel strip at a predetermined length. In certain implementations, the predetermined length is approximately the lateral width of the channel glide. In some embodiments, the channel strip is configured such that, in an installed state (e.g., when mated with a shelf), a lower edge of the channel strip is closer to the ground than the lower edge of the channel glide. Some embodiments include a relief element received on the front face. A forward-most part of the relief element can extend forward of a forward-most part of the body. In some variants, the relief element comprises lettering, a logo, or other indicia.

In some embodiments, a merchandising track device for displaying articles to a consumer includes at least one longitudinally elongate member. The at least one longitudinally elongate member can have a web portion and sidewalls extending therefrom. The web portion and the sidewalls can be configured to form a channel for retaining articles therein.

Some embodiments include a front bracket. The front bracket can be configured to be engaged with an end portion of the longitudinally elongate channel member. In certain variants, the front bracket extends only partially across the front of the channel formed by the web portion and sidewalls. In some embodiments, the front bracket is releasably engageable with the end portion of the longitudinally elongate channel. In some variants, upon engagement of the front bracket with the end portion of the channel member, the partial extension of the front bracket across the face of the channel is configured to retain the articles in the channel member until removal. In certain implementations, the front bracket is configured to display substantially all of the front portion of the article.

In certain embodiments, the at least one longitudinally elongate member includes one or more frangible regions at predetermined locations. The frangible portions can extend through the web portion and/or through each of the sidewalls. The frangible portions can facilitate disconnecting a portion of the at least one longitudinally elongate member and/or adjusting the length of the longitudinally elongate member.

In some implementations, the at least one longitudinally elongate channel member is engageable with a further longitudinally extending channel member. For example, the at least one longitudinally elongate channel member can be configured to be engageable with a further longitudinally elongate channel member at the frangible portions. In some variants, a tab extending from at least one longitudinally elongate channel member engages with a recess in the further longitudinally extending channel member.

In certain embodiments, the at least one longitudinally extending channel member is configured for receiving a stopper member at a location distal to the front member. The stopper member can be engageable with the at least one longitudinally extending channel member. For example, the stopper member can be engageable at a frangible portion extending through the web portion and each of the sidewalls for adjusting the length of the longitudinally elongate member.

In certain embodiments, the merchandising track device includes a plurality of apertures formed in the sidewalls and/or the web portion of the longitudinally elongate member. This can reduce the amount of material used therein.

In some embodiments, a merchandising track system includes one or more longitudinally elongate members. One, some, or each longitudinally elongate member can have a web portion and sidewalls extending therefrom. The web portion and sidewalls can be configured to form a channel for retaining articles therein. The system can include a front bracket, which can be engaged with one or more end portions of the longitudinally elongate channel members. The front bracket can extend only partially across the front of the channels formed by the web portion and sidewalls of the longitudinally elongate members. In some embodiments, the longitudinally elongate members can be inter-engaged with each other by locking tabs in sidewalls of one of the longitudinally elongate member engaging with recesses in sidewalls of an adjacent longitudinally elongate member.

In some embodiments, a front bracket is configured to releasably engage with a merchandising track system. The merchandising track system can have at least one or more longitudinally elongate members. The front bracket can be configured so as to extend only partially across the front of the channel formed by the web portion and sidewalls of the longitudinally elongate members. The front bracket can be releasably engageable with the end portion of the longitudinally elongate channel.

BRIEF DESCRIPTION OF THE DRAWINGS

Various features of the embodiments disclosed herein are described below with reference to the drawings. The illustrated embodiments are intended to illustrate, but not to limit the embodiments. Various features of the different disclosed embodiments can be combined to form further embodiments, which are part of this disclosure.

DETAILED DESCRIPTION OF CERTAIN EMBODIMENTS

Overview

Figure 1:
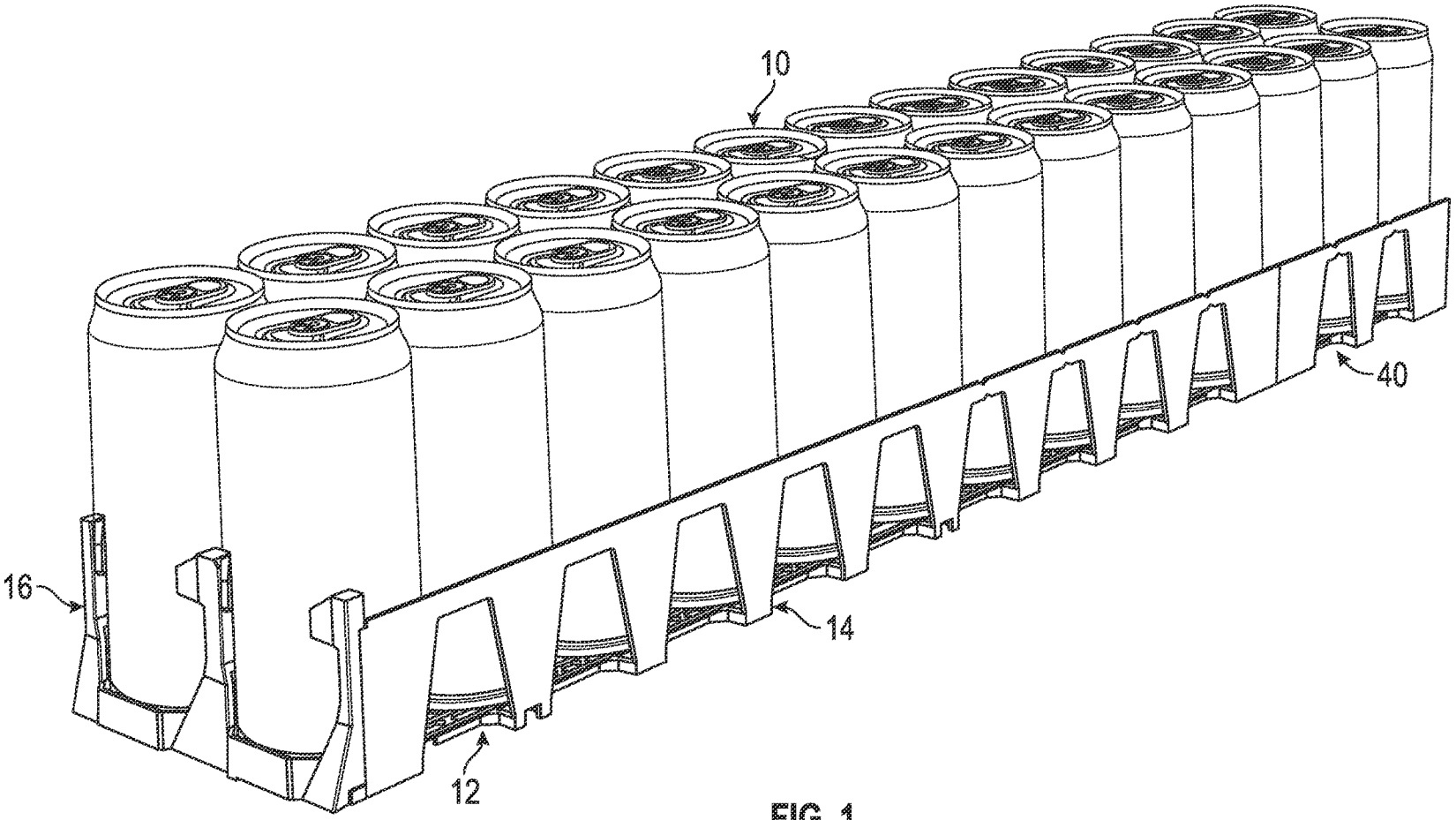
FIG. 1 illustrates a front perspective view of an embodiment of a channel glide with an extension portion, the channel glide displaying a plurality of goods, such as beverage cans.

Channel glides (also called "glide racks" and "glider trays") are used to hold goods, such as cans or bottles, in cooler display cases, such as in grocery or convenience stores. Such display cases typically include one or more shelves, which are connected to struts that transfer weight from the shelf to the ground. The channel glide can sit on the shelf, thereby providing a platform on which to display and/or store the goods. Generally, the channel glide is slightly tilted toward the front of the display case. For example, the shelf can be at a slight angle or a shim can be positioned between a rear portion of the channel glide and the shelf. The tilt encourages the goods in the channel glide to move downward, toward the front of the rack. Accordingly, when a forward-most good is removed from the channel glide, the other goods automatically slide forward by force of gravity, so that the next-most-forward good becomes the forward-most good and is displayed at the front of the channel glide.

FIGS. 1-10B illustrate an embodiment of a channel glide 10. As shown, the channel glide 10 can include a base 12, one or more fences 14, and a front stop unit 16. The channel glide 10 can receive a plurality of goods to facilitate the display and/or storage of such goods. For example, the illustrated channel glide 10 includes a first channel for a first column of goods and a second channel for a second column of goods. Some embodiments include only a first channel for a first column of goods. Various embodiments of the channel glide 10 can facilitate ready access to at least a front-most one of the goods, thereby allowing easy removal of such goods for purchase. For illustrative purposes, the discussion below describes the channel glide 10 in the context of holding beverage cans. However, the channel glide 10 can be configured to hold and dispense a variety of other goods, such as bottles, jugs, tins, cups, boxes, packages, or otherwise.

As shown, the channel glide 10 can secure and/or display one or more columns of goods. For example, the channel glide can include 1, 2, 3, 4, 5, 10, or more columns of goods. In some embodiments, the channel glide 10 can be configured such that one, some, or each column can contain at least: 4 goods, 6 goods, 8 goods, 10 goods, 12 goods, 15 goods, 20 goods, or otherwise.

Base

The base 12 can provide support for the goods in the channel glide 10. For example, a bottom of a beverage can or other good may rest on and be supported by the base 12, which in turn can be supported by the shelf. The base 12 can include an elongate, generally planar, portion that forms the bottom of channel glide 10. In various embodiments, the base 12 is made of a material that can aid in sliding of the cans along the base, such as a flexible, slick, and/or smooth material. In some embodiments, the base is constructed of a blended polypropylene, low density polyethylene, or other plastic. In some variants, the base is made of a metal, such as aluminum.

Figure 5:
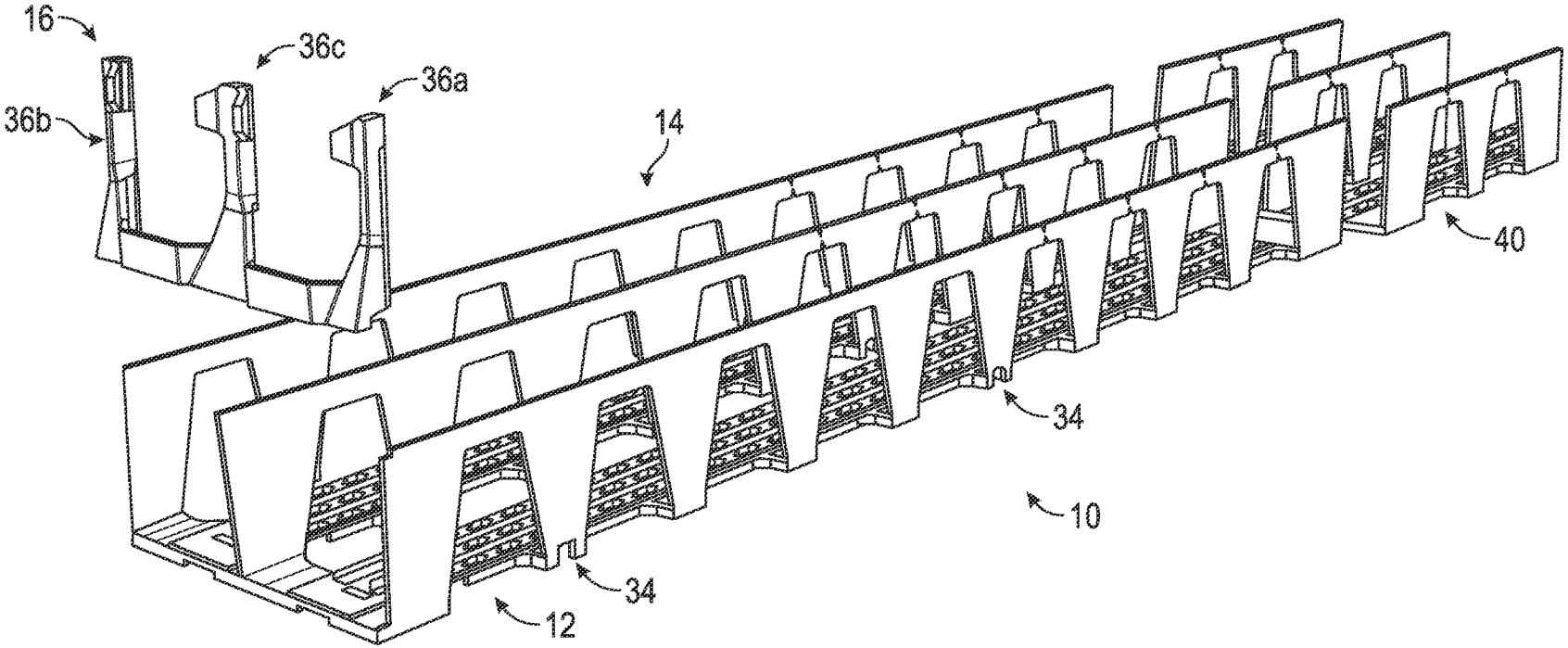
FIG. 5 illustrates an exploded front perspective view of the channel glide of FIG. 4.
Figure 6:
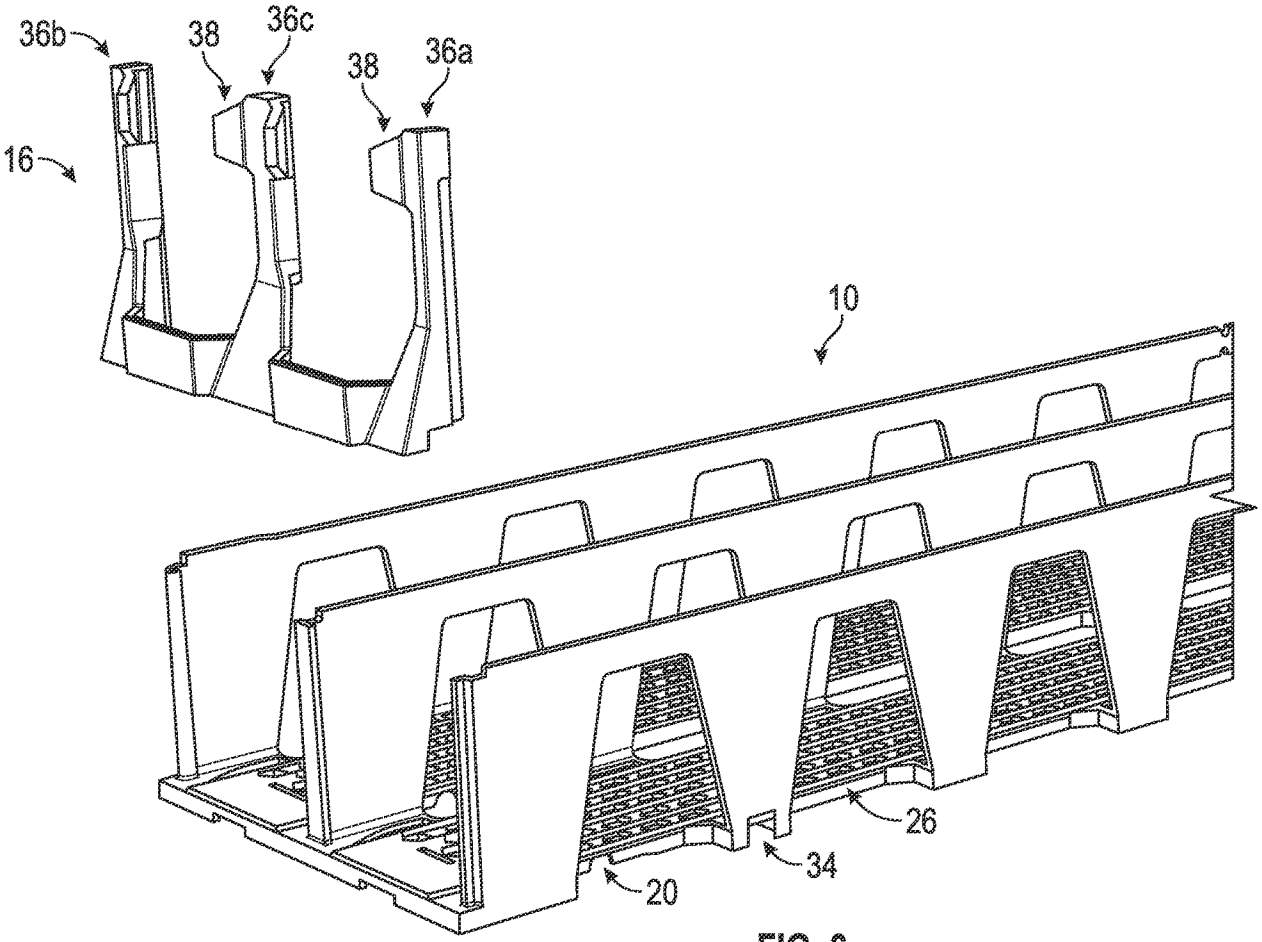
FIG. 6 illustrates a close-up view of a front portion of the channel glide of FIG. 5.
Figure 7:
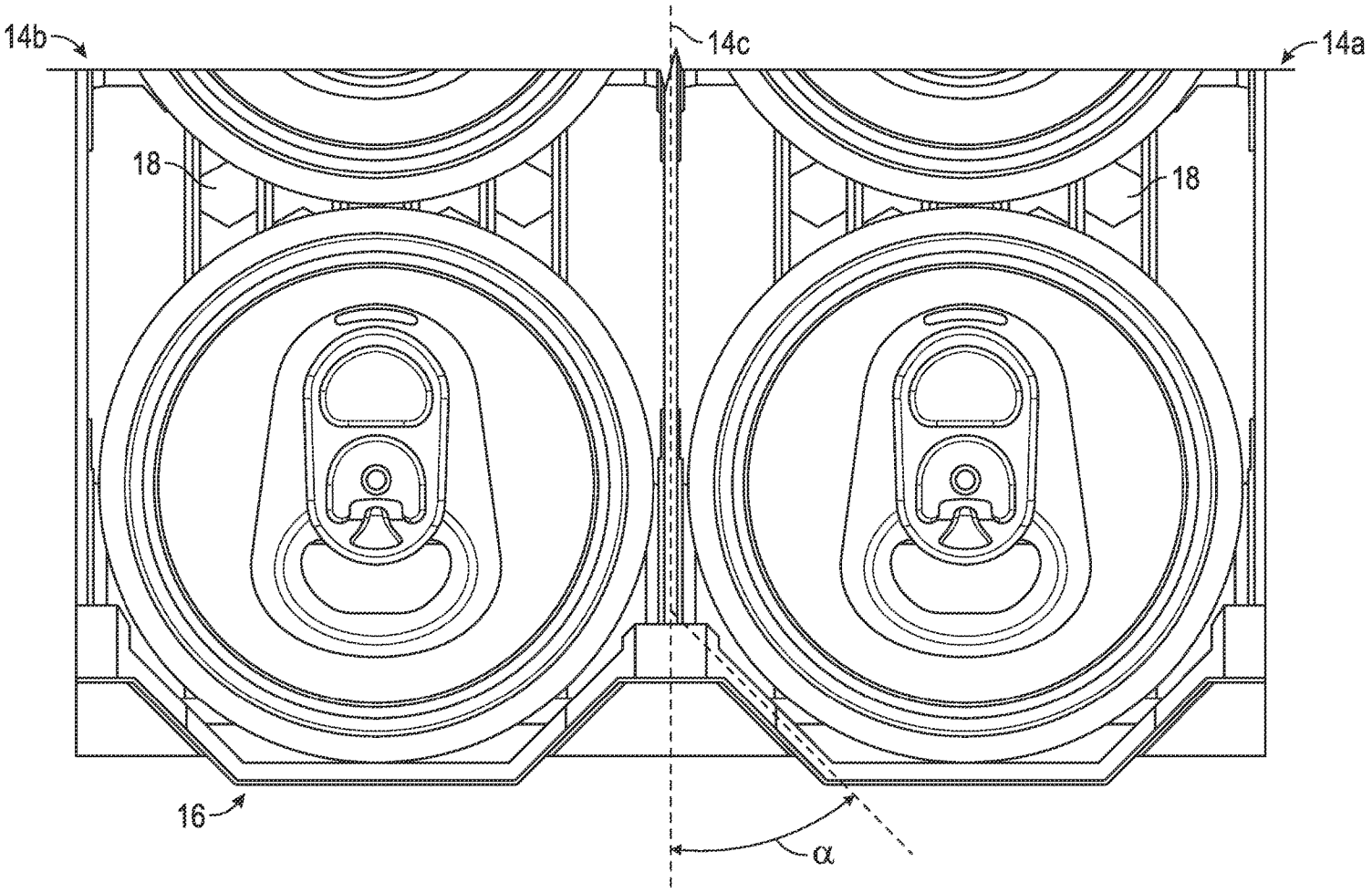
FIG. 7 illustrates top view of the channel glide of FIG. 4 with beverage cans shown for comparison to certain features.

As shown in FIGS. 4-9, the base 12 can include one or more apertures 18. Such apertures 18 can allow airflow to reach the bottom or bottom portions of the cans. This can inhibit the bottom portion of the can from being warmer than a top portion of the can and/or can increase the rate of the heat transfer from the can. In some implementations, the apertures 18 have a shape that is generally: circular, triangular, square, hexagonal, octagonal, star-shaped, or otherwise. As shown in FIG. 7, in some embodiments, some of the apertures 18 can be positioned between successive cans in the column. As also shown in FIG. 7, certain variants of the channel glide 10 have one or more openings located between the base 12 and the fence 14.

Figure 10A:
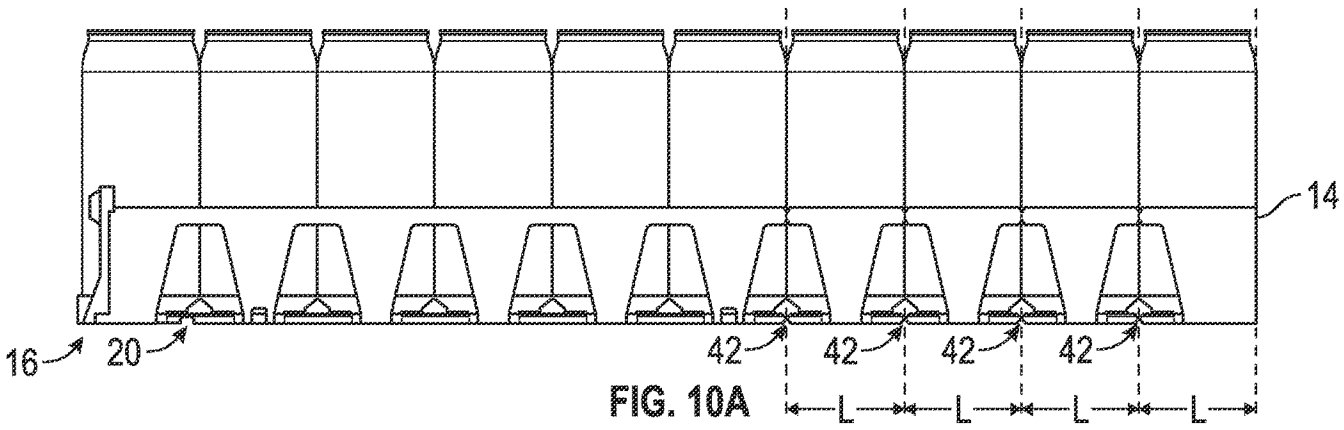
FIGS. 10A and 10B illustrate a side view of the channel glide of FIG. 1 without and with the extension portion.
Figure 10B:
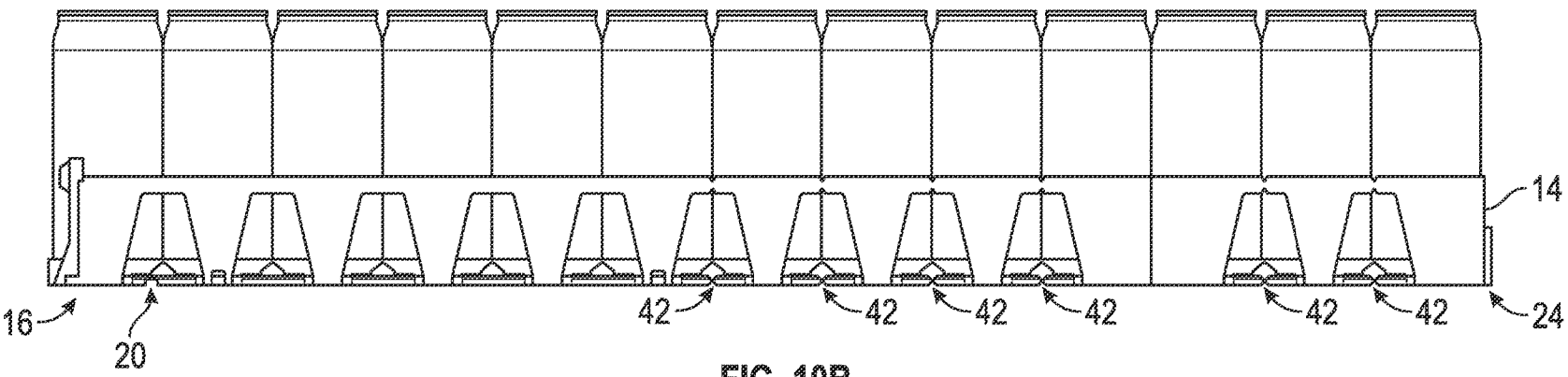
Figure 34:
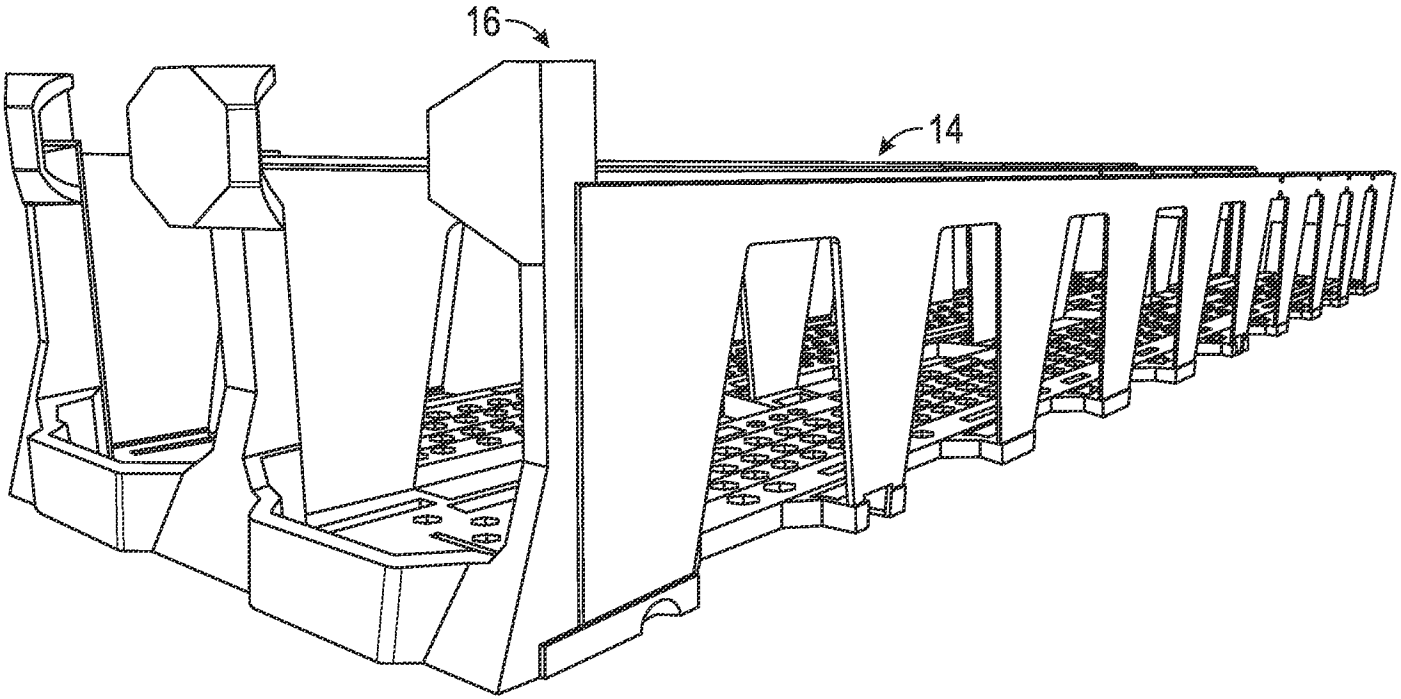

In some implementations, the base 12 includes a retention element, such as a groove 20 (see FIGS. 10A, 10B, and 34). The groove 20 can be configured to receive a portion (e.g., a laterally extending rod) of the shelf. This can couple the channel glide 10 and the shelf and/or can inhibit the channel glide 10 from moving forward relative to the shelf (e.g., toward the closed door of the cooler). In various embodiments, the groove 20 is positioned rearward of the front of the channel glide 10 and/or of the front stop unit 16.

In some implementations, the base 12 includes one or more engagement members, such as channels. For example, the base 12 can include a channel that is offset from (e.g., below) the top of the base 12 and that is configured to engage a tongue on a rear stop unit 24 and/or an extension 40, as is discussed in more detail below.

As shown in FIG. 6, in some embodiments, the base 12 includes sliding facilitation members 26, such as projections or rails, ribs, etc. The sliding facilitation members 26 can extend some or all of the length of the base 12. The bottom of the cans can be supported on the sliding facilitation members 26. This can decrease the amount of surface area in contact between the base and the cans (compared to not having the sliding facilitation members), which reduces the amount of friction between the base and the cans. The reduction in friction can aid in the cans readily and/or smoothly sliding towards the front of the channel glide 10. In some embodiments, the sliding facilitation members 26 have a narrowing shape in relation to height above the shelf. For example, the sliding facilitation members 26 can have a generally triangular cross-sectional shape.

Fences

Figure 4:
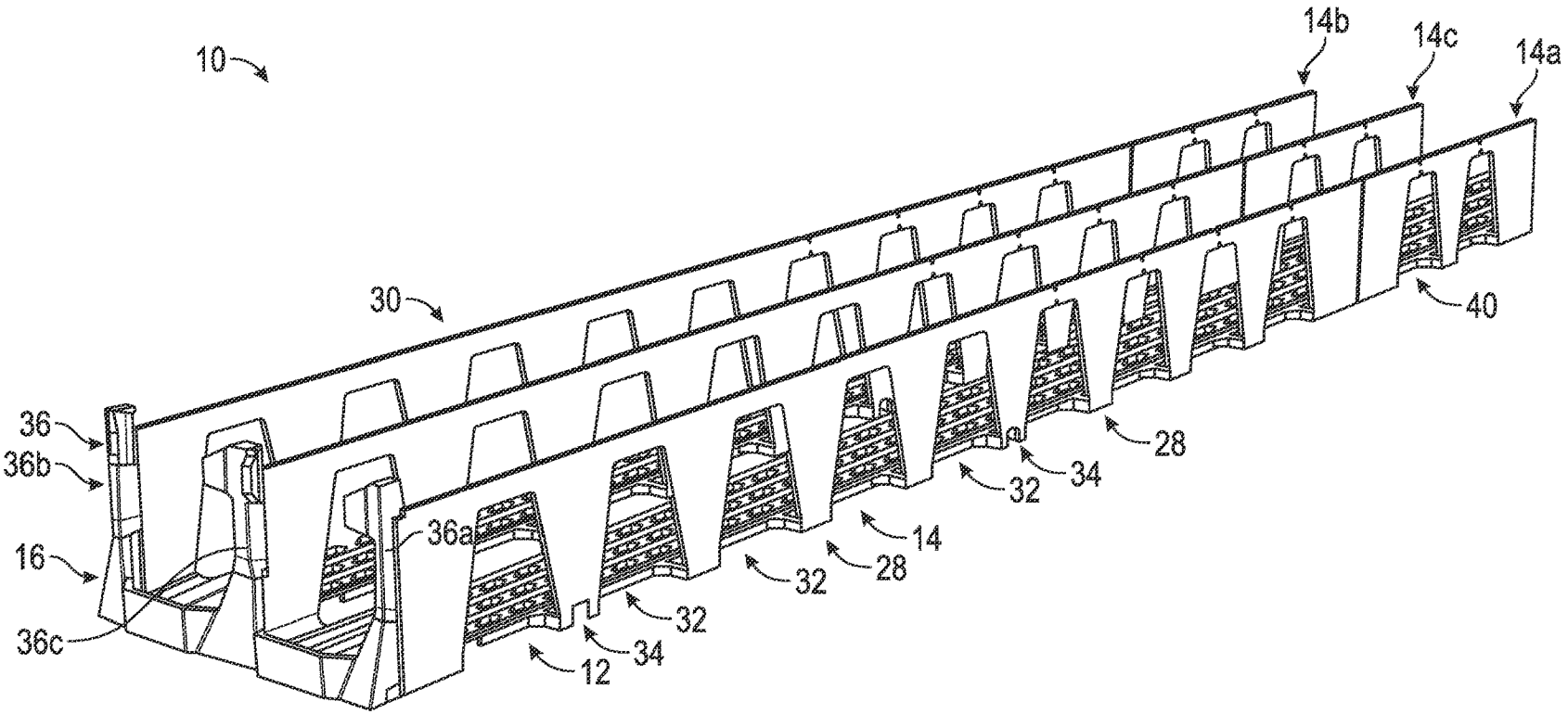
FIG. 4 illustrates a front perspective view of the channel glide of FIG. 1 without the goods.

As noted above, the channel glide 10 can include one or more fences 14. For example, as shown in FIG. 4, the channel glide 10 can include a first fence 14*a* on a first lateral side and a second fence 14*b* on a second lateral side. The side fences 14*a*, 14*b* can provide lateral support for the cans in the channel glide 10 to inhibit the cans from laterally exiting the glide. Certain embodiments include an intermediate fence 14*c* that divides the first and second columns of goods from each other. Some embodiments do not include the intermediate fence 14*c*.

In various embodiments, the fences 14 include a plurality of generally vertically extending supports 28, such as is illustrated in FIGS. 1 and 4. A bottom portion of the supports 28 can be connected with the base 12 and a top portion of the supports 28 can be capped and/or intersected by a rail 30. The bottom portion of the supports 28 can be relatively narrow compared to the top portion. For example, the ratio of the width of the bottom portion to the width of the top portion can be at least about: ½, ⅓, ¼, ⅕, values between the aforementioned values, or other values.

In some embodiments, the fences 14 include apertures 32 between adjacent supports 28. This can allow airflow between the supports 28 to facilitate cooling of the cans. In some embodiments, in comparing one of the apertures 32 to an adjacent one of the supports 28, the area of the opening of the aperture 32 is greater than the outwardly-facing surface area of the support 28, such as being at least about 1.2 times greater.

As shown in FIG. 1, in certain implementations, the supports 28 are distributed along the length of the channel glide 10 so as to be aligned with the cans. For example, when the channel glide 10 is full, a middle of each support 28 can be about aligned with a corresponding middle of one of the cans. Such positioning of the supports 28 can increase the bracing for the cans at that localized region of the base 12, due to the connection between the support 28 and the base 12. In some embodiments, such alignment reduces the chance of lateral tipping of the can by providing a physical lateral interference to the bottom of the can.

As shown in FIG. 4, the fences 14 can include one or more connection members 34. In the embodiment illustrated, some of the supports on the fence 14*a* include connection members 34 that mate with corresponding connection members 34 on the fence 14*b* of another channel glide 10. For example, one or more of the supports in the fence 14*a* can include a recess, and one or more of the supports in the fence 14*b* can include a hook or tab that can be received in the recess. Thus, when a first channel glide is laterally positioned against a second channel glide, the hooks or tabs of the first channel glide 10 can be received in the recesses of the second channel glide 10. In various embodiments, the connection members 34 are on a portion of the channel glide 10 that is not configured to frangibly detach from the front portion of the channel glide 10, which is a feature that will be discussed in more detail below.

In several embodiments, the lateral space occupied by the fences 14*a*, 14*b* can represent wasted space on the shelf. Thus it can be beneficial to reduce the lateral width of the fences 14*a*, 14*b*. For example, the lateral width of the fences 14*a*, 14*b* can be less than the vertical thickness of the base 12, less than the lateral thickness of the intermediate fence 14*c*, and/or less than 5% of the lateral width of the channel and/or the diameter of the beverage can.

Front Stop Unit

As mentioned above, the channel glide 10 can include a front stop unit 16. The front stop unit can be configured to stop cans from unintentionally sliding out of the front of the channel glide 10, yet still allow ready access to, and removal of, the cans by a user at the front of the channel glide 10. In some embodiments, the front stop unit 16 is constructed of a different material than the base 12. For example, in certain embodiments, rather than being a smooth or slick material (such as the base 12), the front stop unit 16 is constructed of a resilient and/or durable material, such as high-density polyethylene. In some implementations, the front stop unit 16 is metal or wood (or at least has a finish that makes the front stop unit 16 appear to be metal or wood) and the base 12 is plastic. In certain implementations, the front stop unit 16 has a different color, texture, hardness (e.g., using Shore D durometer scale), or visual appearance than the base 12.

As illustrated, the front stop unit 16 can include one or more pillars 36. The pillars 36 can be laterally positioned so as to laterally align with the fences. For example as shown, the front stop unit 16 can include three pillars, each aligned with one of the three fences. In the embodiment shown in FIG. 4, the front stop unit 16 includes a first side pillar 36*a*, second side pillar 36*b*, and intermediate pillar 36*c*.

In various embodiments, the front stop unit 16 includes indicia, such as labels, logos, colors, product identifications, or otherwise. In the embodiment illustrated, a logo is positioned at a bottom central portion of the front stop unit and/or between the columns of cans. However, the indicia can alternately or additionally be positioned in other locations on the front stop unit 16. For example, indicia can be positioned near a top portion of one or more of the pillars 36. This can make the indicia more visible to a user. For example, for shelving below a viewer's (e.g., a consumer's) straight-ahead line of sight, the viewer needs to look down to see the shelf, but the vertical distance can make certain items (e.g., small text and/or logos) difficult to discern. By placing the indicia on the pillars 36, the indicia is elevated closer to the viewer's eyes, and thus more easily perceived. This can aid in the viewer finding and identifying the goods in the channel glide 10, which in turn can result in an increase in sales of the goods.

In some implementations, the top and/or bottom portion of the pillars 36 is wider than an intermediate portion of the pillars. This can provide space for the indicia and/or can allow for a larger indicia. In some variants, compared to the narrowest lateral width of the intermediate portion of the pillar, the top portion and/or the bottom portion has a lateral width that is wider by at least about: 20%, 25%, 35%, 50%, 75%, 100%, values between the aforementioned values, or other values.

Figure 27:
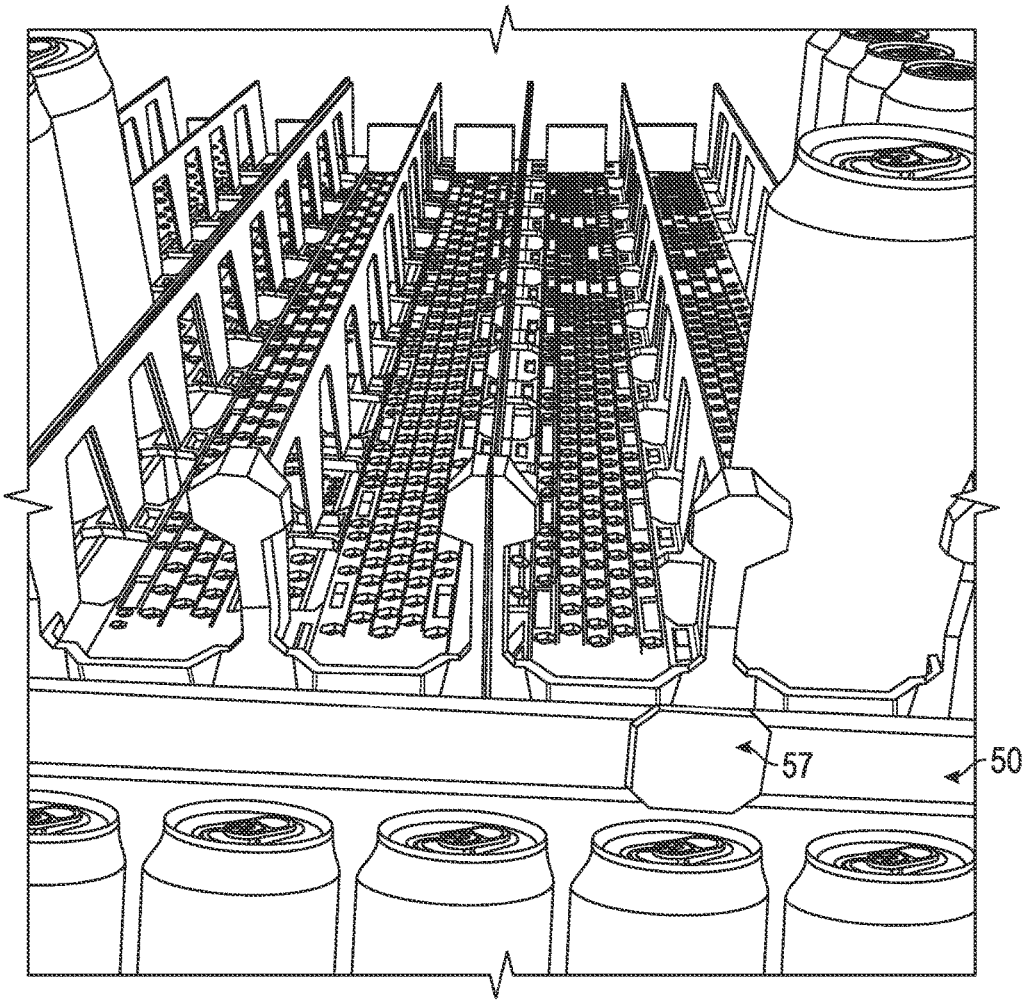
FIGS. 27-46 show illustrative embodiments of channel glides and channel strips.
Figure 28:
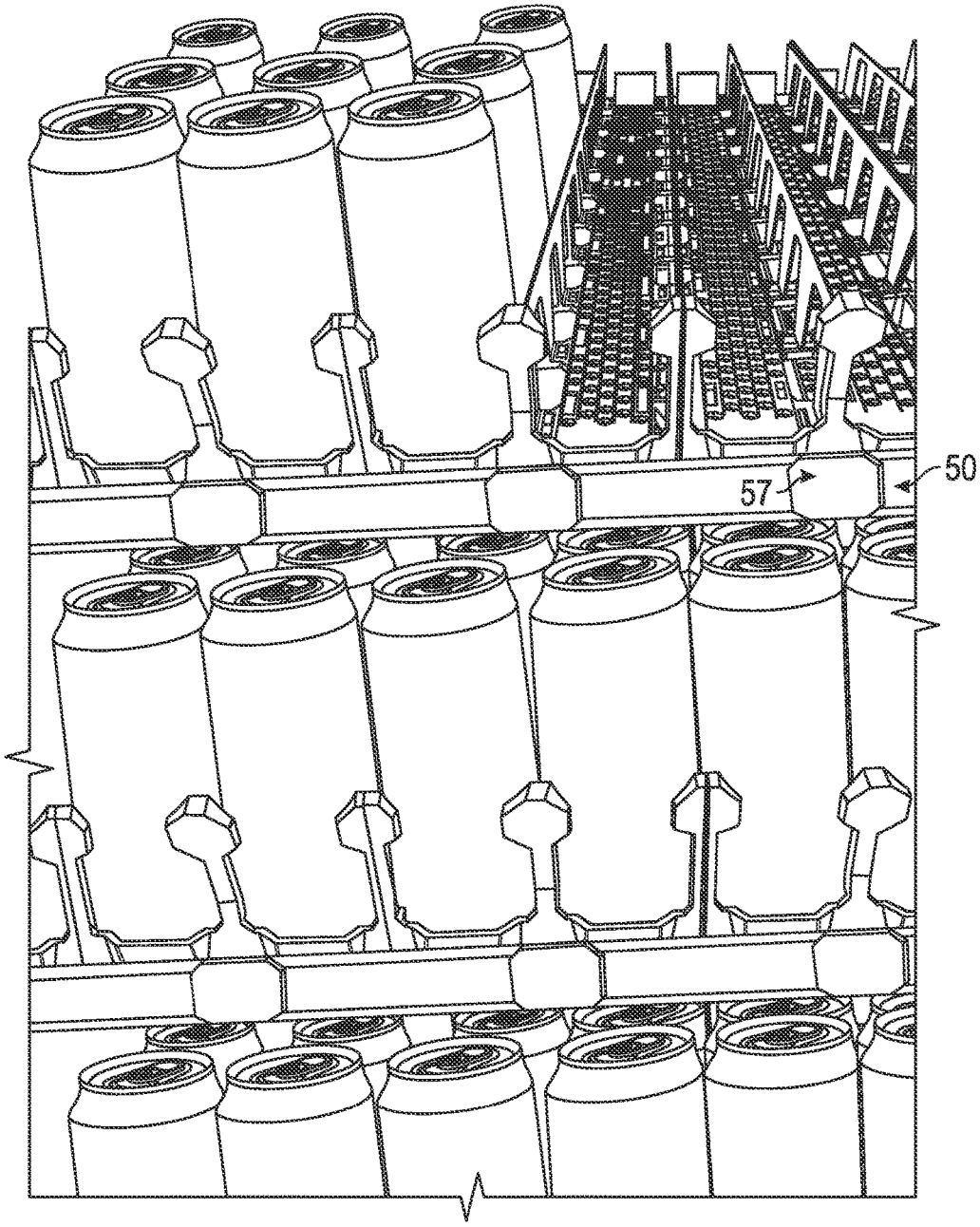

As shown in FIGS. 2, 27, 28, and 39, in some embodiments, the intermediate pillar 36*c* can include a complete shape (e.g., of a logo, emblem, design, etc.), and the side pillars 36*a*, 36*b* can each include about half of that shape. For example, as shown, the intermediate pillar 36*c* includes a complete generally octagonal emblem, the first side pillar 36*a* includes about half of the octagonal emblem, and the second side pillar 36*b* includes about the other half of the octagonal emblem. As shown in FIGS. 27 and 28, when a plurality of channel glides 10 are placed laterally adjacent to each other, such "half" emblems can mate with the corresponding "other half" of the emblem of the adjacent channel glide, thereby providing the visual appearance of a substantially complete emblem. This can make the plurality of channel glides 10 appear to be a single unit and/or can give the impression that the channel glides 10 are custom fit to the cooler, which can confer an image of quality and excellence to the goods displayed in the channel glides 10.

As shown in FIG. 5, the front stop unit 16 can be removable from the remainder of the channel glide 10. For example, the pillars 36 of the front stop unit 16 can be slidingly engaged with the fences 14, such as with rails on the fences 14 and corresponding channels in the front stop unit 16 that receive the rails, as shown in FIG. 6. A removable front stop unit 16 can facilitate changing the indicia on the channel glide 10 without needing to physically change (e.g., move or remove) the entire channel glide 10. Instead, just the front stop unit 16 can be swapped with another front stop unit 16. For example, a first front stop unit 16 with a first set of indicia can be removed, and a second front stop unit 16 with a second set of indicia can be installed on the channel glide 10. Thus, information (e.g., labels, logos, colors, product identifications, or otherwise) on the front of the channel glide 10 can be readily and rapidly changed. In some embodiments, the front stop unit 16 is not removable from the base 12 and/or one or more of the fences 14. For example, the front stop unit 16 and at least one of the base 12 and one or more of the fences 14 can molded or otherwise formed together. In some embodiments, the front stop unit 16 is integral with the base 12.

In some embodiments, the front stop unit 16 can engage a front of the base 12. For example, the front stop unit 16 can include a resilient securing member (e.g., a latch) and the base 12 can include an opening configured to receive the securing member, thereby selectively coupling the front stop unit 16 and the base 12. In some variants, the front stop unit 16 engages and/or is supported on an upper surface of the front portion of the base 12. In certain implementations, the front stop unit 16 can engage with one or more of the fences 14, such as with a sliding engagement. In some embodiments, the front stop unit 16 includes a recess that mates with a corresponding projection or rail of one of the fences 14. In some embodiments, the recess has a generally "C" shaped arrangement and is engaged with a generally "L"-shaped tab of the end portion of one of the fences 14. Various attachment mechanisms can be used to connect the front stop unit 16 and the base 12 and/or the fences 14, and such mechanisms are within the scope of this disclosure.

In various embodiments, a lower portion of the front stop unit 16 provides a physical stop that can impede the forward progress of a bottom portion of the can. In some embodiments, the lower portion provides visual framing and/or masking of a bottom portion of the can. This can reduce the chance of the bottom portion of the can being seen, which could detract from the overall appearance of the cans in the channel glide 10. As shown, the lower portion can include a hollow that projects forwardly from a rearward part of the front stop unit 16. This can allow the front base portion to receive a portion (e.g., the bottom portion) of the front-most beverage can. In some implementations, the hollow has a generally rounded or generally frustoconical shape when viewed from above.

As illustrated, the pillars 36 on the front stop unit 16 can include one or more movement inhibiting members, such as fingers, wings, or catches 38. The catches 38 can extend outwardly from the pillars 36 and engage a front-most of the cans to impede the can from moving forward. The catches also can be configured to allow a user to withdraw the can by lifting the can vertically and/or tilting the can with respect to the catches.

As shown in FIG. 1, each can is restrained by a pair of catches 38. For example, one of the catches 38 can be on one of the side pillars 36*a*, 36*b* and the other can be on the intermediate pillar 36*c*. In various embodiments, the catches 38 do not contact each other, do not extend entirely between the first and second pillars, are laterally spaced apart, and/or do not contact each other. This allows an unobstructed view of the front of the can. In some embodiments, from a front view, at least a majority of the surface area of the front half of the can is visible. In certain implementations, from a front view, the portion of the front half of the can that is visible is at least about: 60%, 75%, 90%, 95% values between the aforementioned values, or other values. In various embodiments, a vertical line can be drawn down the face of the can that does not intersect any of the catches 38. In some implementations, the catches 38 are spaced apart by a distance that is at least about 60%, about 75%, about 85%, or about 90% of the diameter of the can and/or the lateral width of the channel.

As shown, each pair of catches 38 can be angled toward a longitudinal centerline of one of the channels and toward the front of the channel glide 10. In some embodiments, such a configuration allows the pair of catches to automatically position the can at about the lateral center of the channel glide 10, which can increase the visibility of the face or the case and/or improve the visual appearance of the can. Additionally, such angled catches permit the can to slide forward a greater distance than if the catches 38 extended straight laterally. As shown in FIG. 7, in some embodiments, with respect to a line parallel to the centerline of the channel glide 10, the catch 38 can be tilted at an angle alpha ($\alpha$) of at least about: 30°, 37°, 45°, 57°, 60°, values between the aforementioned values, or other values. In some embodiments, the catch 38 is at such an angle as to approximately mimic the sector of the circle that is the portion of the can in contact with the catch 38. This can increase the amount of area in contact between the can and the catch 38 and reduce stress on the can and the catch 38. In some implementations, the surface of the catch 38 that contacts the can is generally planar. In other implementations, the surface of the catch 38 that contacts the can is rounded, such as at about the same radius as the can.

Figure 2:
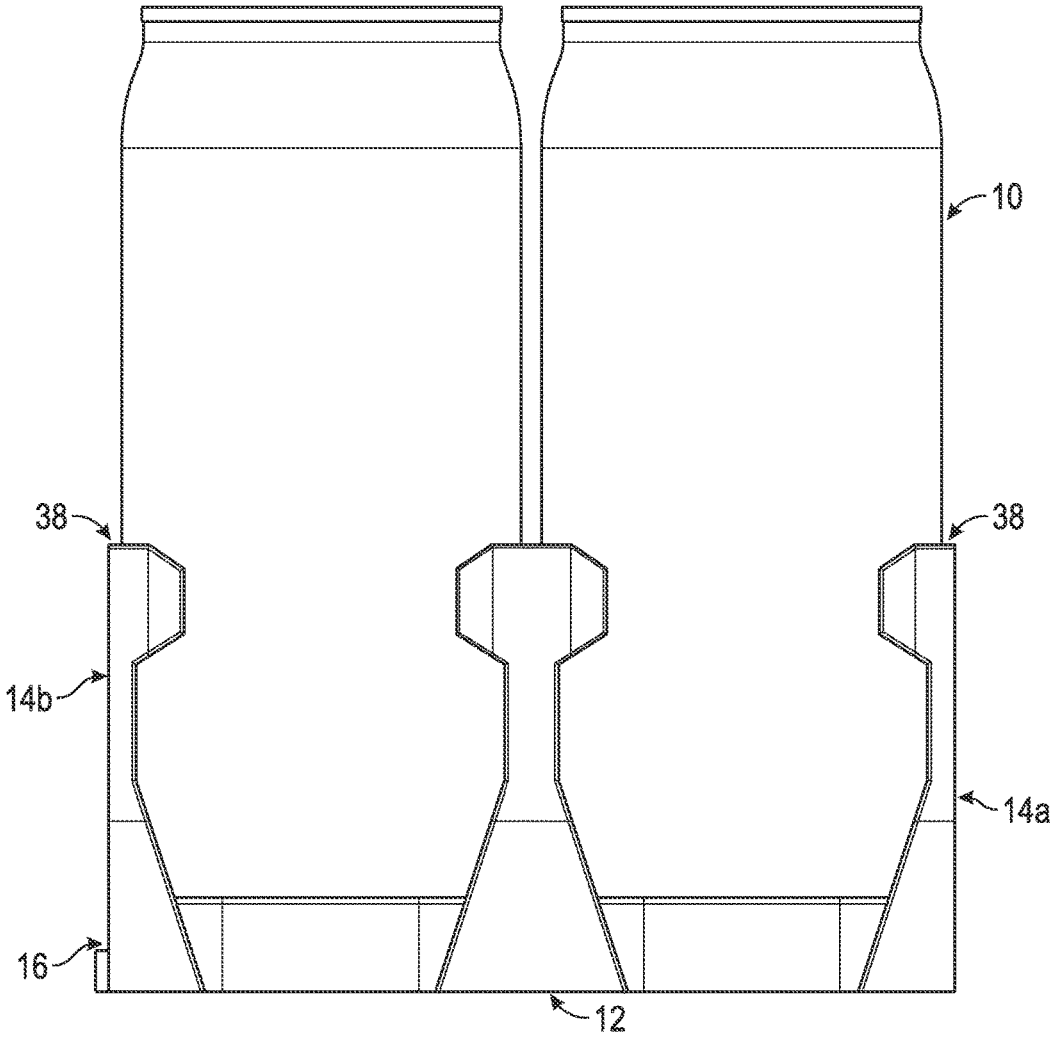
FIG. 2 illustrates a front view of the channel glide of FIG. 1.

As shown in FIG. 2, the catches 38 can be positioned at or near the top of pillars 36. This can enhance the stability of the cans. For example, by engaging the cans with the catches 38 above the base 12, the chance of the can tipping over can be reduced. For example, when a can is removed from the channel glide 10, and the remainder of the cans in the column slide forward, the momentum of the front-most can may tend to increase the chance of that can tipping forward out of the channel. This could be especially true were only the bottom portion of the can to be restrained, such as with a lip or low lateral bar, which would cause a large moment of force to be applied to the top portion of the can. However, the channel glide 10 (e.g., the front stop unit 16) has catches 38 that are elevated (e.g., at or near the top of the pillars). This allows the catches 38 to engage the can at a much higher location, which reduces the moment of force applied to the top portion of the can, thereby reducing the chance of the can tipping forward out of the channel. In some embodiments, the catches 38 are configured to engage the can at distance above the base that is at least about ¼ of the overall height of the can. In some variants, the catches are configured to engage the can at distance above the base that is at least about ⅓ of the overall height of the can. In some implementations, the height of the center of one of the catches above the base is greater than the lateral width of one of the channels. For example, the ratio of the height of the center of one of the catches above the base to the lateral width of one of the channels is about: 0.50, 0.75, 0.90, 1.01, 1.05, 1.1, 1.2, 1.5, 2.0, values between the aforementioned values, or other values.

Rear Stop Unit

Figure 3:
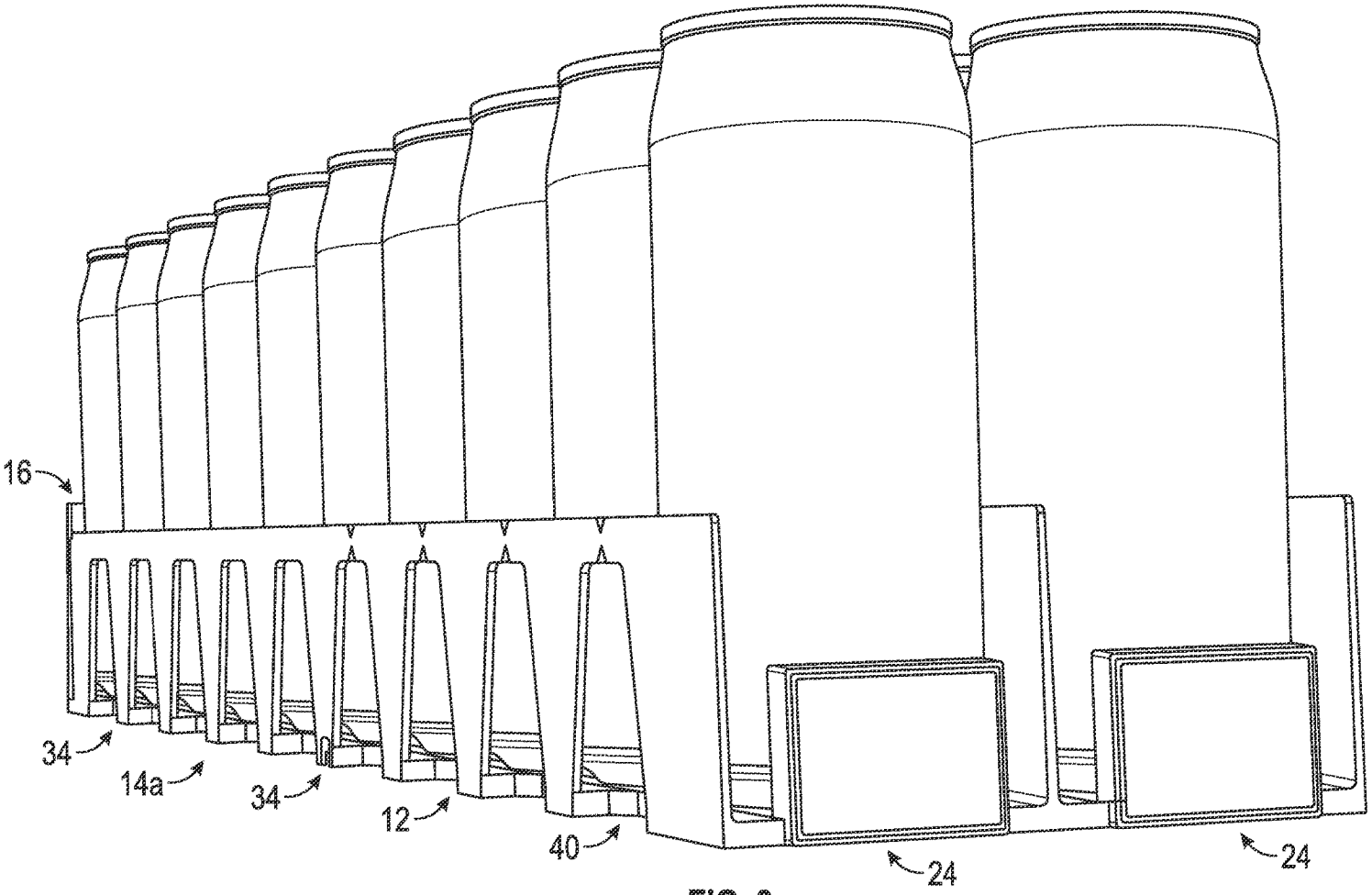
FIG. 3 illustrates a rear perspective view of the channel glide of FIG. 1.
Figure 8:
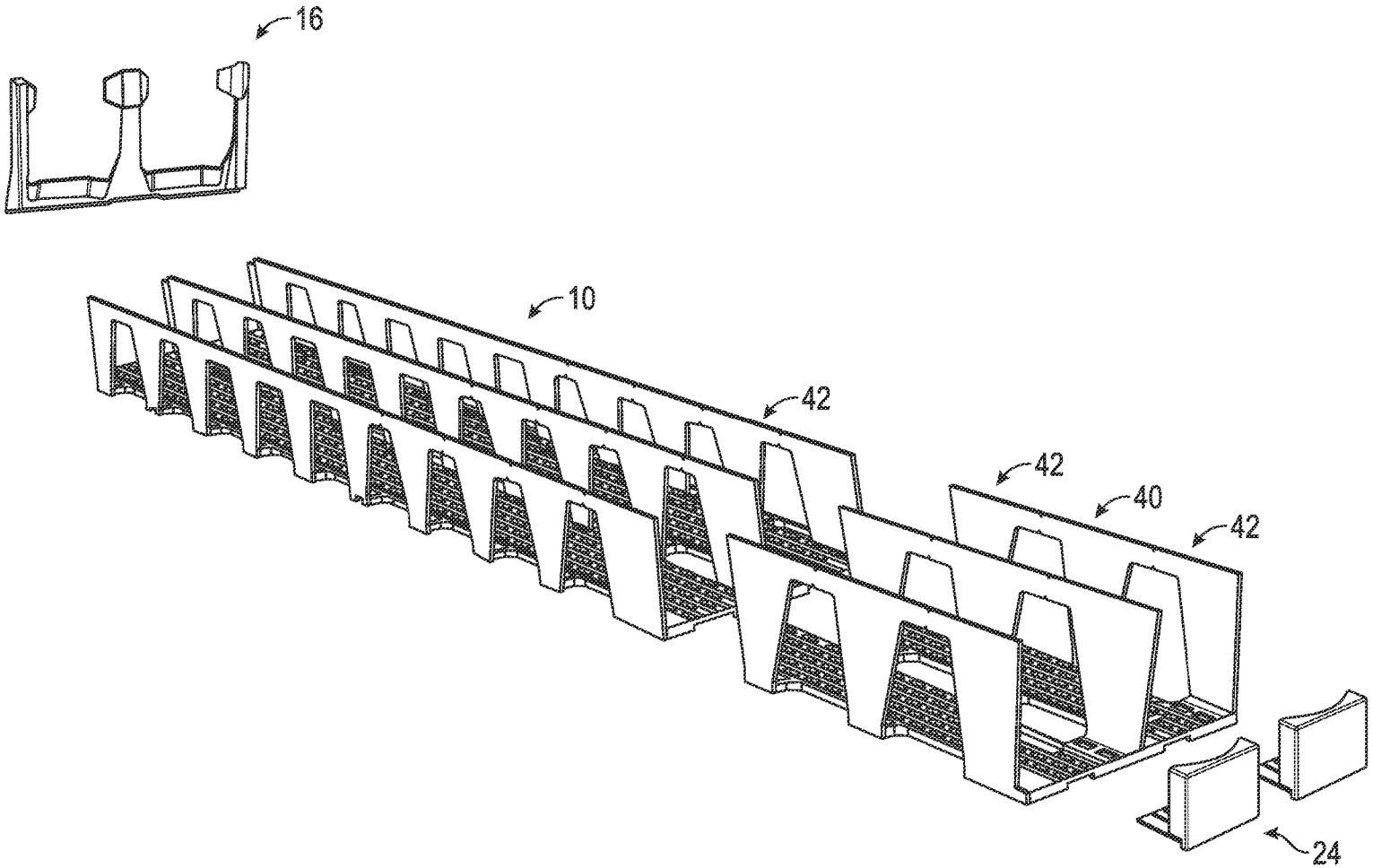
FIG. 8 illustrates an exploded rear perspective view of the channel glide of FIG. 4.
Figure 9:
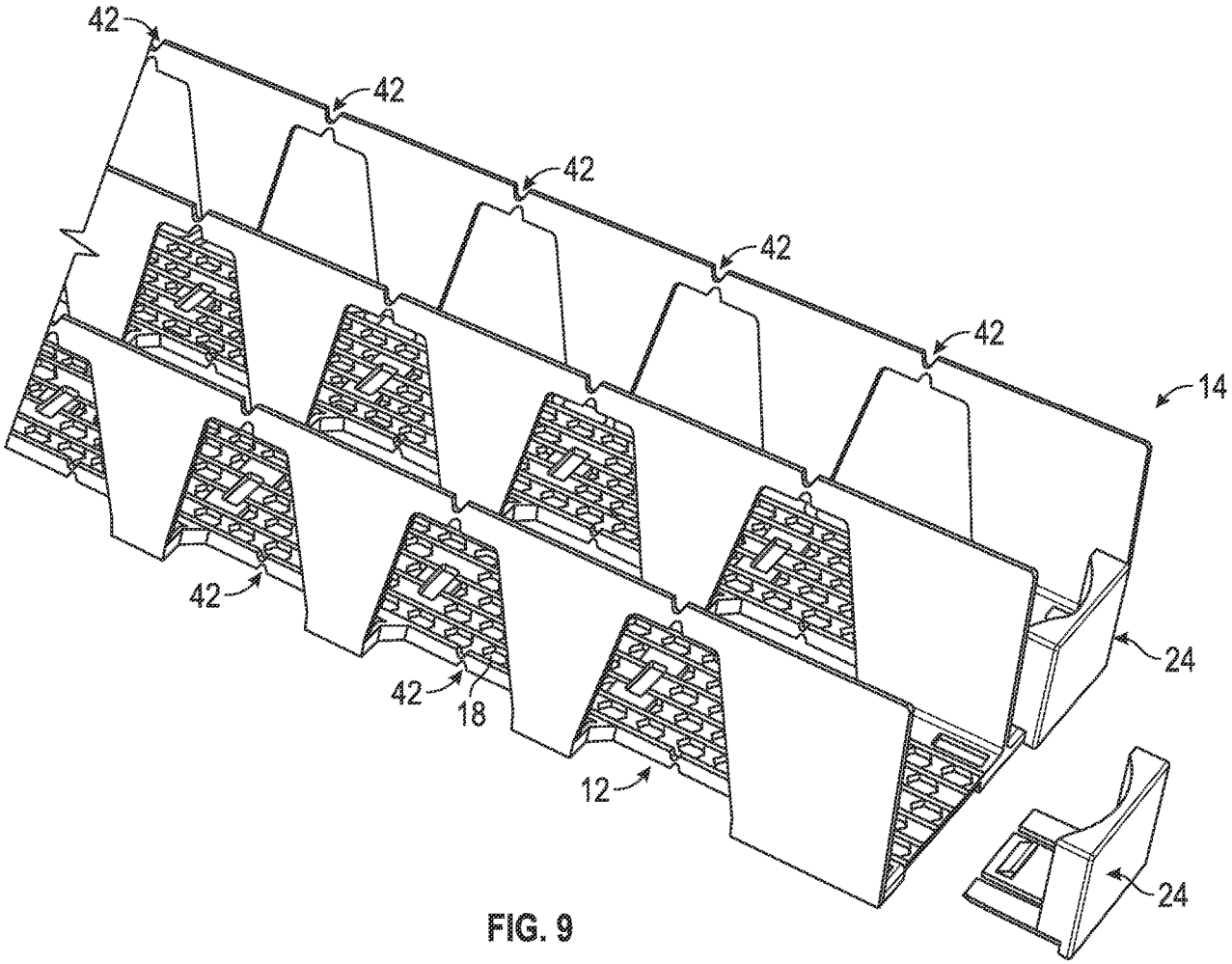
FIG. 9 illustrates an exploded rear perspective view of a portion of the channel glide of FIG. 8.

As shown in FIGS. 3, 8, and 9, the channel glide 10 can include a rear stop unit 24. The rear stop unit 24 can project upwardly from the base 12. This can allow the rear stop unit 24 to present a physical interference to cans in the channel glide 10, and thus can reduce the likelihood of the cans being rearwardly pushed out of the channel glide 10. For example, if a user at the front of the channel glide 10 tries to push the column of cans rearwardly, the rear stop unit 24 can inhibit the rear-most of those cans from being ejected from the channel glide 10. This can maintain the organization of the cans and/or reduce the likelihood of damage that could occur were one or more of the cans to be ejected and fall to the ground. Some embodiments of the channel glide 10 include a plurality of rear stop units 24, such as a rear stop unit 24 for each of the first and second channels.

In some embodiments, the rear stop unit 24 is removable from the base 12. For example, the rear stop unit 24 can be coupled with the base 12 via a tongue and groove attachment. The rear stop unit can include a securing member (e.g., a latch) and a guiding member (e.g., a prong). The guiding member can slide into the channel of the base 12, which can aid in guiding the securing member into engagement (e.g., snap into) with a corresponding securing feature (e.g., an opening) in the base 12. Thus, the rear stop member 14 can be securely connected with the base 12.

The removable rear stop unit 24 can facilitate rear loading of the channel glide 10, which, compared to front loading, can be a more convenient and/or desirable way to add cans to the channel glide 10. By removing the rear stop unit 24, there is no longer a physical interference to adding cans into the channel glide 10 via the rear of the channel glide 10. Thus, the channel glide 10 can be easily restocked from the rear as cans are removed from the front. When the restocking is complete, the rear stop unit 24 can be replaced so as to reduce the likelihood of rear push-off, as discussed above. In some variants, restocking occurs without removal of the removable rear stop unit 24.

In some embodiments, the rear stop unit 24 is configured to accept indicia, such as a logo or label. This can aid in identifying the type of product that should be placed in the channel glide 10. Without such rear facing indicia, rear restocking can be difficult because identifying information about what type of product should go in a particular channel may not be visible. For example, from the rear of the channel glide 10, the indicia on the front stop unit 16 may not be visible and/or the cans in the channel glide 10 may have been removed or have their labels facing forward. In contrast, the rear stop unit 24 can facilitate ready identification of what product should go in a channel.

Modular Configurations and Features

Several embodiments of the channel glide 10 have a modular configuration. This can aid in sizing the channel glide 10 to fit the particulars of a shelf. For example, a shelf typically has a certain depth and width that is available for one or more of the channel glides 10. As discussed below, the channel glide 10 can be configured to increase and/or decrease in length, which can allow the channel glide's length to be customized based on, for example, the available shelf depth. Further, the channel glide 10 can be laterally mated with additional instances of the channel glide 10. This can form a channel glide assembly whose lateral width can be customized (by adding additional channel glides) to match, for example, the available shelf width. Thus, both the length and width of the channel glide 10 can be selected and changed to meet particular shelving requirements.

In some embodiments, the length of the channel glide 10 can be increased by mating the channel glide 10 with one or more extension portions 40. The extension portion 40 can be similar in form and function to the channel glide 10, discussed above. For example, the extension portion 40 can have a similar base and similar fences. The extension portion 40 can couple with the channel glide 10, such as with a tongue and groove arrangement as discussed above in connection with the rear stop unit 24. A rear of the extension portion 40 can be configured to couple with one or more of the rear stop units 24, such as with the tongue and groove attachment.

In several embodiments, the extension portion 40 includes break points 42. In various embodiments, the break points 42 include scores and/or portions of reduced width or thickness. For example, as shown in FIGS. 8 and 9, at the break points 42, the rail 18 and the base 12 can decrease in thickness. In some embodiments, the base 12 includes generally v-shaped grooves that extend laterally across the base 12. In some embodiments, the grooves are interrupted by the apertures 18 in the base 12.

The break points 42 can allow the amount of length added by the extension to be selected. For example, the extension portion 40 can be about the length of three beverage cans and have two break points. This can allow a user to select whether to extend the channel glide 10 by one can length, two can lengths, or three can lengths. In some embodiments, the extension portion 40 can couple with an additional extension portion 40 thereby further extending the length of the channel glide 10 overall.

In some embodiments, the channel glide 10 includes break points 42, which can allow the length of the channel glide 10 to be reduced by detaching a rear portion of the channel glide 10 from a front portion of the channel glide 10. For example, the channel glide 10 can include one or more break points 42 that allow a rear portion of the channel glide 10 to break off, thereby reducing the length of the remaining portion. In some embodiments, the connection members 34 are located forward of the forward-most break point 42.

Several embodiments are configured to enable the rear stop unit 24 to be engaged with the rear of the channel glide 10 even after one or more of the break points 42 have been activated. For example, the rear of the base 12 and rear stop unit 24, and/or the rear of the extension portion 40 and the rear stop unit 24, can be configured to be engageable even after activation of one or more of the break points 42. For example, the base 12 and/or the extension portion 40 can include, adjacent some or each of the break points 42, a tongue or groove that is configured to receive a mating groove or tongue of the rear stop unit 24. In some embodiments, the base 12 and/or the extension portion 40 can include, adjacent some or each of the break points 42, a channel and/or an opening. In some implementations, the channel can aid in guiding a securing member (e.g., a latch) of the rear stop unit 24 into engagement (e.g., snap into) with the opening. Thus the rear stop unit 24 can be used with the channel glide 10 regardless of length.

In various embodiments, the break points 42 are positioned to correspond to a feature of the cans and/or the channel that holds the cans or other goods. For example, the break points 42 can be spaced apart by a distance that is about the diameter of a can and/or that is about the lateral width of one of the channels. In various embodiments, activating the rear-most break point 42 reduces the channel glide 10 length by about one can length, activating the second rear-most break point 42 reduces the channel glide 10 length by about two can lengths, activating the third rear-most break point 42 reduces the channel glide 10 length by about three can lengths, etc.

The break point 42 can be configured such that break occurs generally parallel with the front of the channel glide 10 and/or generally perpendicular to the longitudinal axis of the columns of cans. In some embodiments, the weakened portions in the fences 14 and the base 12 are aligned such that a plane perpendicular to the base 12 and to the longitudinal axis of the channel glide 10 intersects the weakened portions on the fences 14 and base 12. In some variants, when viewed from above, the break point 42 extends in a generally straight line laterally through the rails 14*a-c* and the base 12. The break point 42 can be configured so that breakage occurs generally along a plane that is perpendicular to the longitudinal centerline of the channel glide 10. In some implementations, some of the break points 42 are positioned about equidistant between two adjacent supports of the fence 14*a* and/or 14*b*.

In certain variants, the plurality of break points 42 in the channel glide 10 can allow a user to select from several places at which to reduce the length of the channel glide 10, thus allowing the selection of a variety of different lengths. For example, for a shelf with a first depth the user may choose to activate a first break point, and for a shelf with a second depth a user may choose to activate a second break point. Thus, the user can select the length of the channel glide 10 to customize the channel glide 10 to fit a particular shelf.

With regard to FIGS. 10A and 10B, side views of the channel glide 10 are illustrated. As shown, in some embodiments, at least at a rear portion of the channel glide 10 can include a plurality of break points 42. In the embodiment of FIG. 10A, the channel glide 10 includes four break points, thus allowing the user to choose to remove one, two, three, or four lengths L from the channel glide 10 length. Other embodiments include more or fewer break points. The embodiment of FIG. 10B includes the extension portion 40, which can include a plurality of break points 42 as well. For example, as shown, the extension portion 40 can include three break points. Because the extension 40 was added in the embodiment of FIG. 10B, presumably at least some additional length was desired (compared to the embodiment of FIG. 10A without the extension 40), nevertheless a user can choose to remove one, two, or three lengths L from the extension portion 40 as well as the one, two, three, or four lengths L from the channel glide 10. In various embodiments, the length L between break points 42 is about equal to the diameter of the can and/or the lateral width of the channel. For example, the break points 42 can be spaced apart such that removal of one length L is about equal to decreasing the capacity of the one of the channels by one can.

Figure 11:
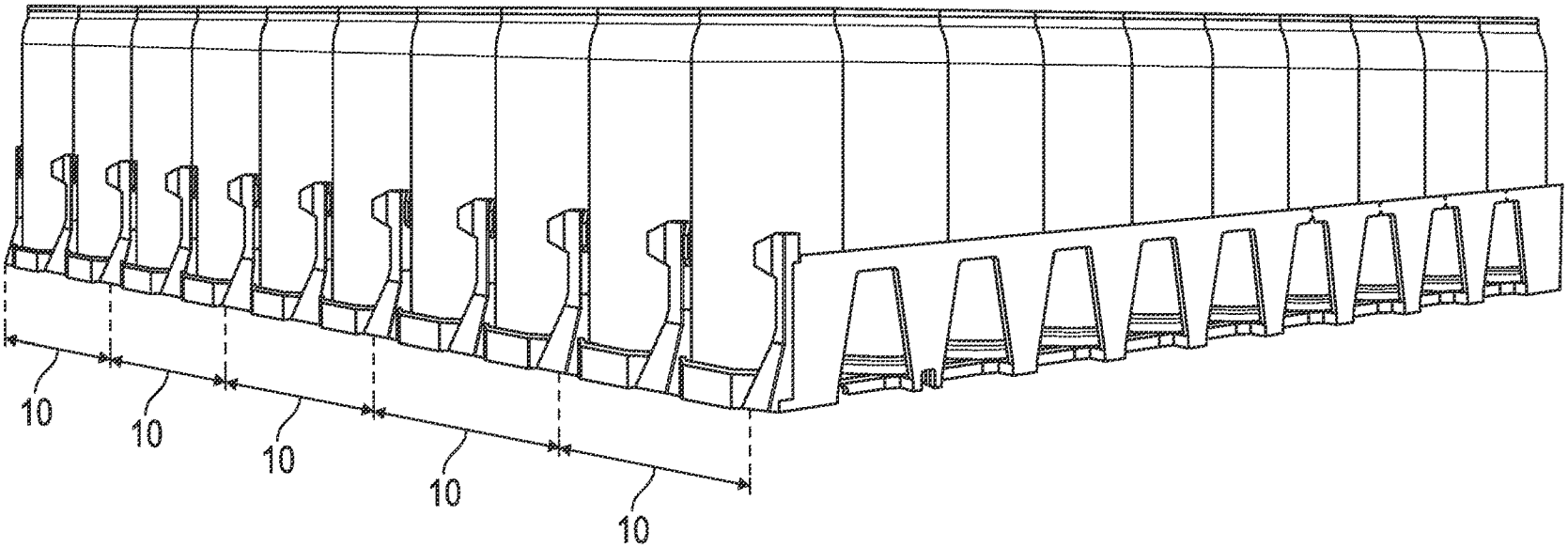
FIG. 11 illustrates a front perspective view of a channel glide assembly comprising a plurality of the channel glides of FIG. 1 without the extension portion.
Figure 12:
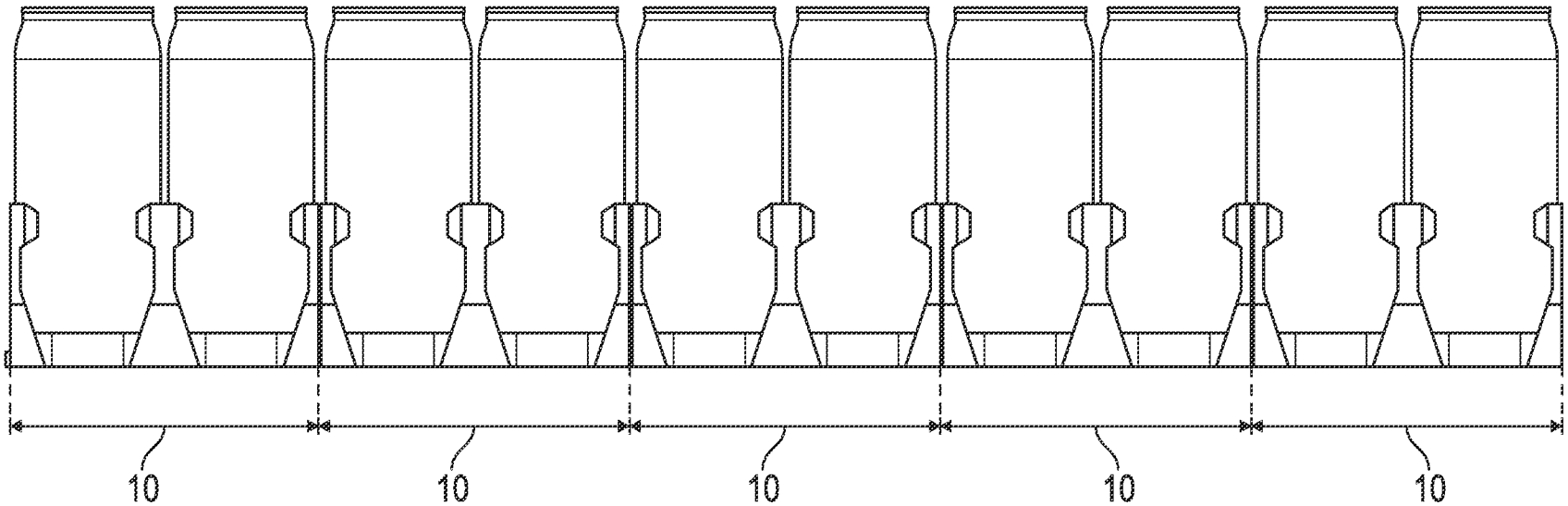
FIG. 12 illustrates a front view of the channel glide assembly of FIG. 11.

As previously discussed, the channel glide 10 can include connection features 34 that can aid in lateral connection between channel glides 10. For example, the connection features 34 (e.g. hooks or tabs) of a first channel glide 10 can be received in the connection features 34 (e.g. recesses) of a laterally adjacent channel glide 10. This pattern can be repeated to produce an overall channel glide assembly of the lateral width desired. For example, as shown in FIGS. 11 and 12, as assembly of a plurality (e.g., 2, 3, 4, 5, 6, 7, or more) of the channel glides 10 can be produced. Accordingly, the channel glide 10 permits a user to customize a lateral width to meet a particular shelving requirement.

Channel Strip

Figure 13A:
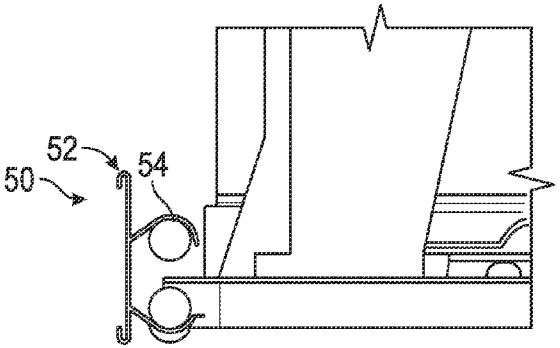
FIGS. 13A and 13B illustrate side and exploded views of an embodiment of a channel strip.
Figure 13B:
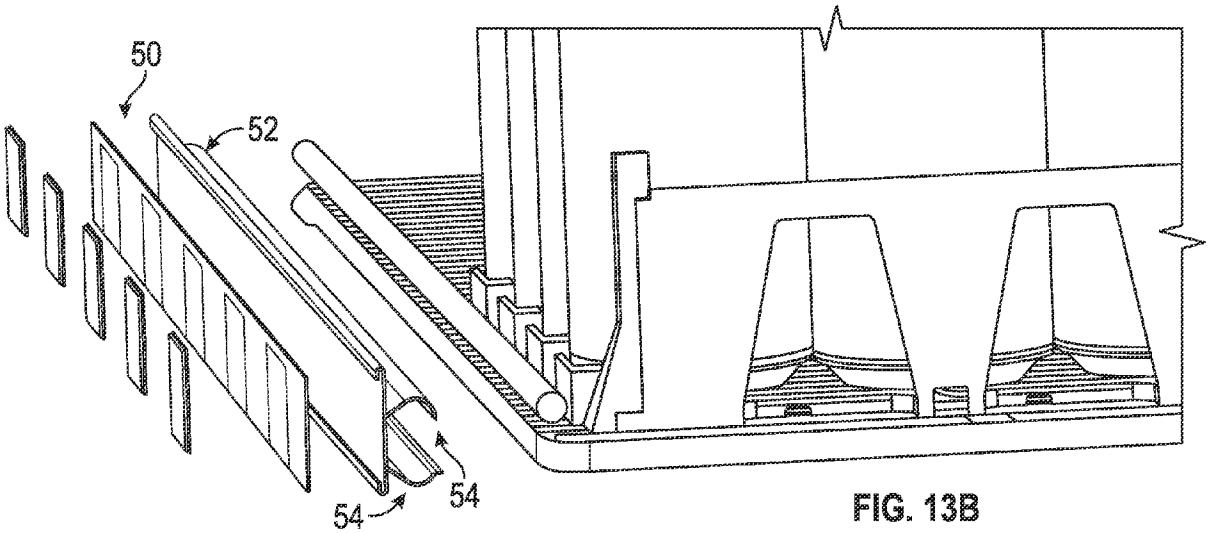

As discussed above, the channel glide 10 typically rests on a shelf in the cooler. It can be advantageous to include indicia (e.g. labels and/or logos) on the front of that shelf, such as to draw attention to the product and/or to provide information about the product, such as pricing. Accordingly, as shown in FIGS. 13A-B, some embodiments of the channel glide 10 can be used in conjunction with a channel strip 50. The channel strip 50 can be coupled to the front of the shelf. The channel strip 50 can include a body having a front face 52 and clasping elements 54. The clasping elements 54 can resiliently deflect and grasp a front rail portion of the shelf, such as a laterally-extending rod or rods, thereby retaining the channel strip 50 on the shelf. The clasping elements 54 can include one or more flexible areas, which enable the clasping elements 54 to accommodate variances in the front rail portion of the shelf.

In some variants, such as is shown in FIG. 13A, one or more of the clasping elements 54 has an installation facilitating extension, such as a lip, bend, or flange. The extension can be configured to engage the front rail portion of the shelf to aid in installing the channel strip 50 on the shelf. In the embodiment of FIG. 13A, the extension is a generally rearwardly-extending portion on the end of the lower clasping element 54. In certain embodiments, the extension is angled with respect to horizontal, such as being angled downward (e.g., at an angle of less than or equal to about 60°). In some implementations, the installation facilitating extension is the rearward-most portion of the channel strip 50.

The front face 52 can be configured to receive one or a strip of labeling elements, such an elongated piece of paper or plastic. In some embodiments, the labeling elements include relief elements, such as elements that project outward from the front face 52. In some variants, a front-most portion of the relief element extends forward of a front-most portion of the front face 52.

Figure 14:
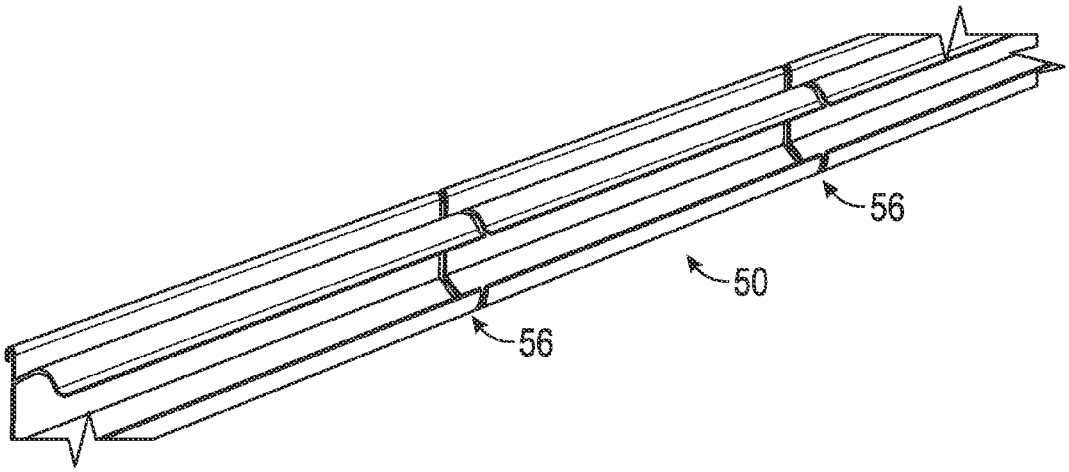
FIG. 14 illustrates a partial perspective view of the channel strip of FIGS. 13A-B.

As shown in FIG. 14, some embodiments of the channel strip include break points 56, such as portions that are scored or that have a reduced thickness. The break points 56 can be positioned to correlate with the approximate width of a channel glide 10. For example, in the embodiment shown, the channel strip 50 includes three break points 56 and the distance between each of the break points 56 is about equal to the lateral width of a channel glide 10. Thus, the channel strip 50 shown can extend across three laterally adjacent channel glides 10. If only one or two channel glides are used, then the channel strip 50 can be reduced in size by breaking the channel strip 50 at a break point 56 such that the channel strip has a length that approximately matches the lateral width of the channel glide assembly being used.

Typically, the channel strip 50 attaches and/or is positioned lower than the channel glide 10. For example, the top-most portion of the channel strip 50 can extend above the base 12 of the channel glide 10 no more than about 10% of the overall vertical height of the channel glide 10. Positioning the channel strip 50 in a lower position can provide a location for indicia regarding the contents of the channel glide 10, while also avoiding obscuring the contents of the channel glide 10 and/or inhibiting with removal of the contents of the channel glide 10. In some embodiments, the channel strip 50 extends below the channel glide 10 and/or the shelf. This can aid in increasing the amount of indicia and/or labeling available for indicating the contents of the channel glide 10.

Multi-Pack Channel Glides

Some channel glides are configured to display and/or dispense multi-pack arrangements of cans, such as 4-packs, 6-packs, 8-packs, or otherwise. For example, certain variants are configured with a lateral width that is about the lateral width of the multi-pack of cans. Some multi-pack arrangements are bound together, such as with a set of connected plastic rings or a cardboard box. Due to the cans being bound together, the intermediate fence 14*c* could cause the multi-pack to bind or get caught in the channel glide 10. Accordingly, some embodiments of the channel glide 10 do not include the intermediate fence 14*c*. Some embodiments alternately or additionally do not include the front stop unit 16. In some implementations, the front of the base 12 includes a movement inhibition member, such as an upwardly extending lip.

Certain Examples

Figure 15:
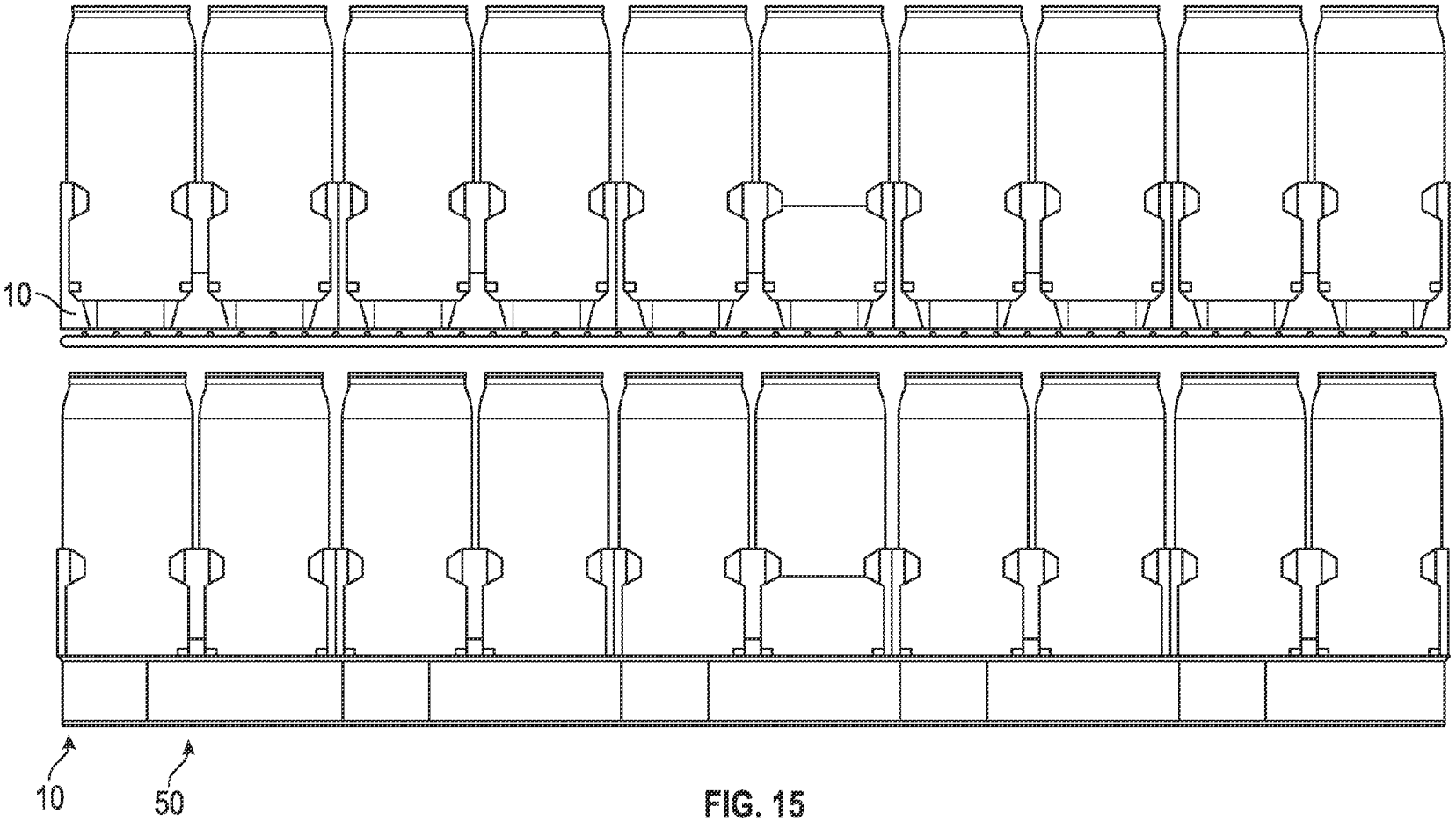
FIGS. 15-26 illustrate additional view of channel glides and channel strips.
Figure 16:
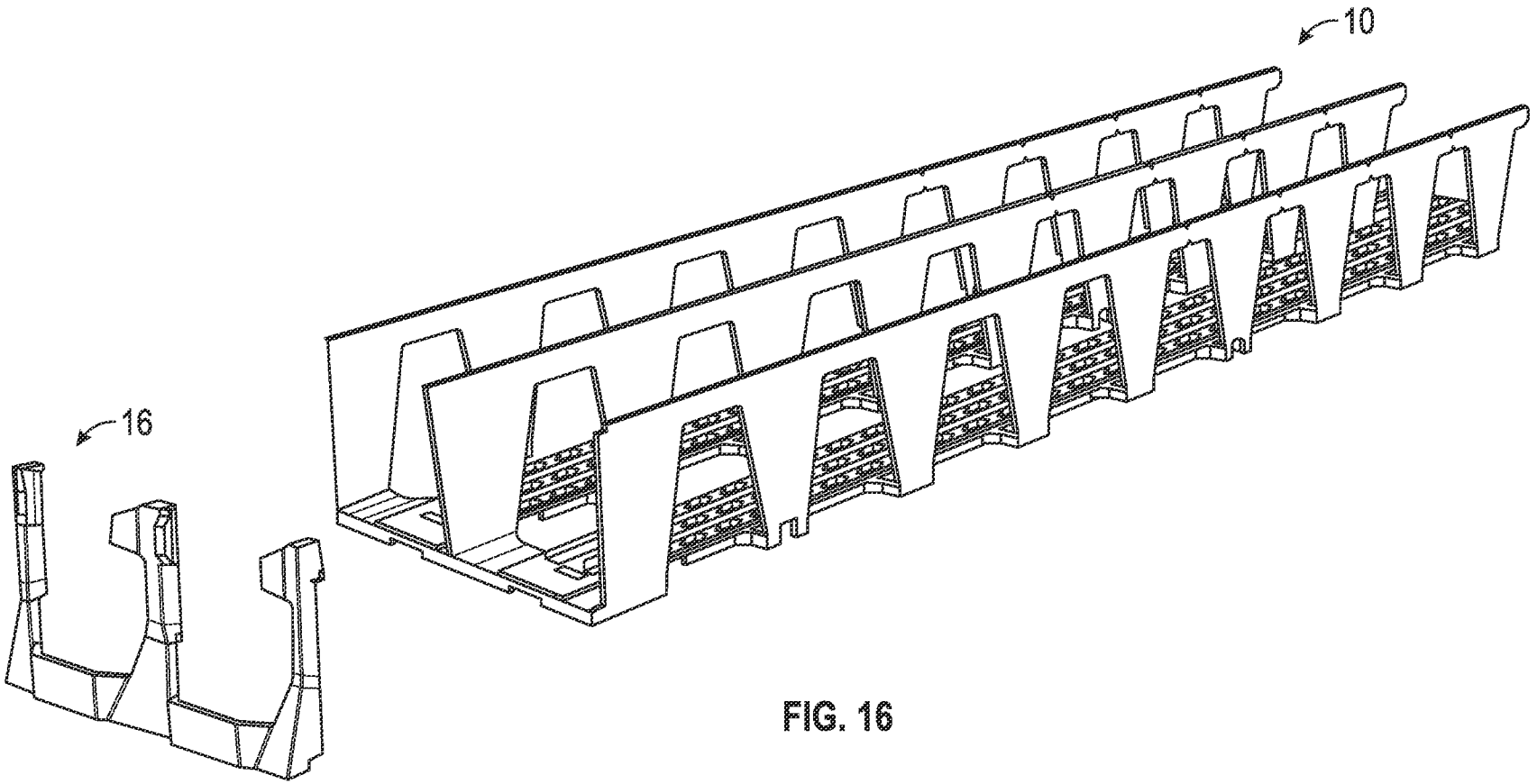
Figure 17:
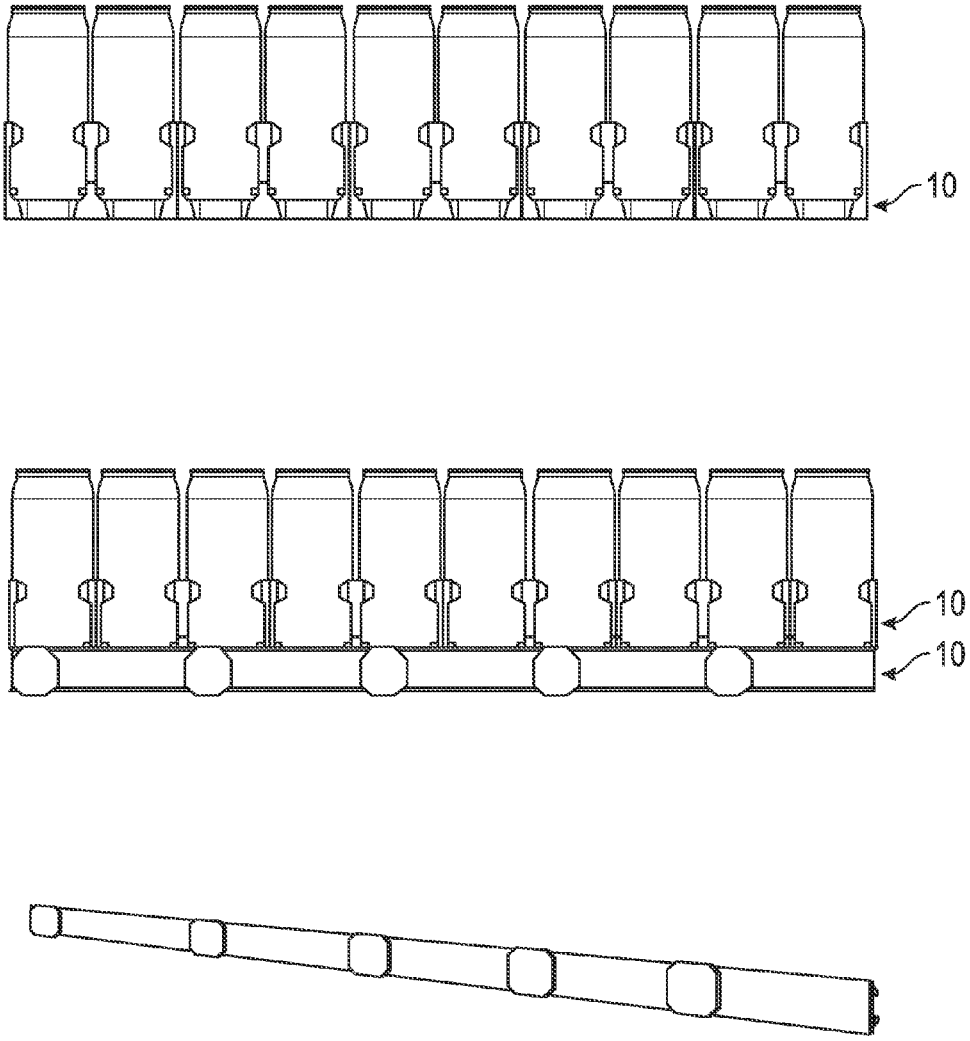
Figure 18:
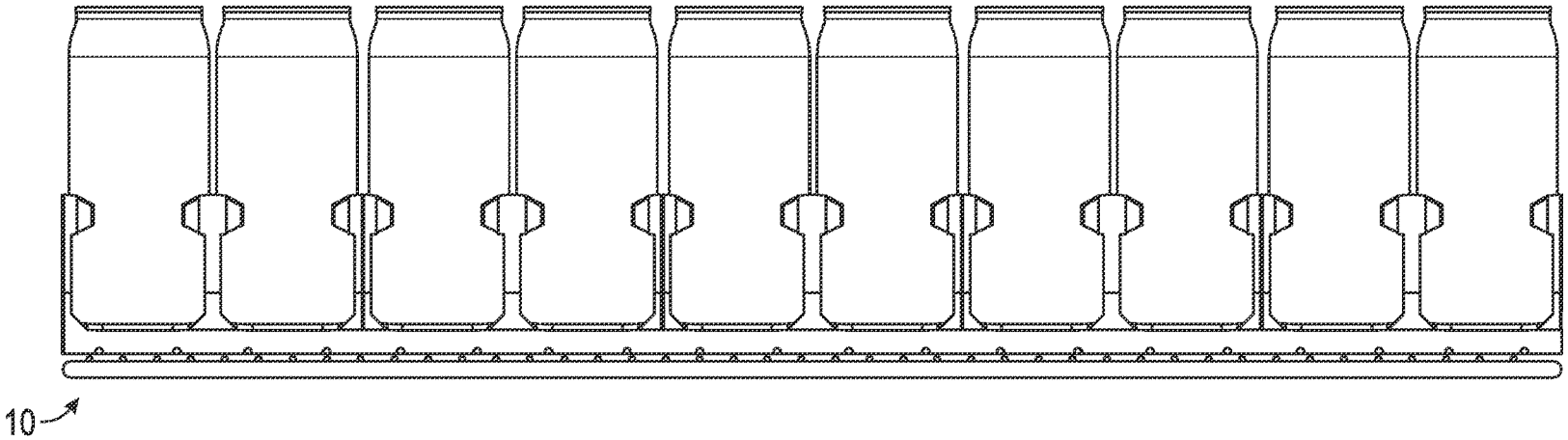
Figure 19:
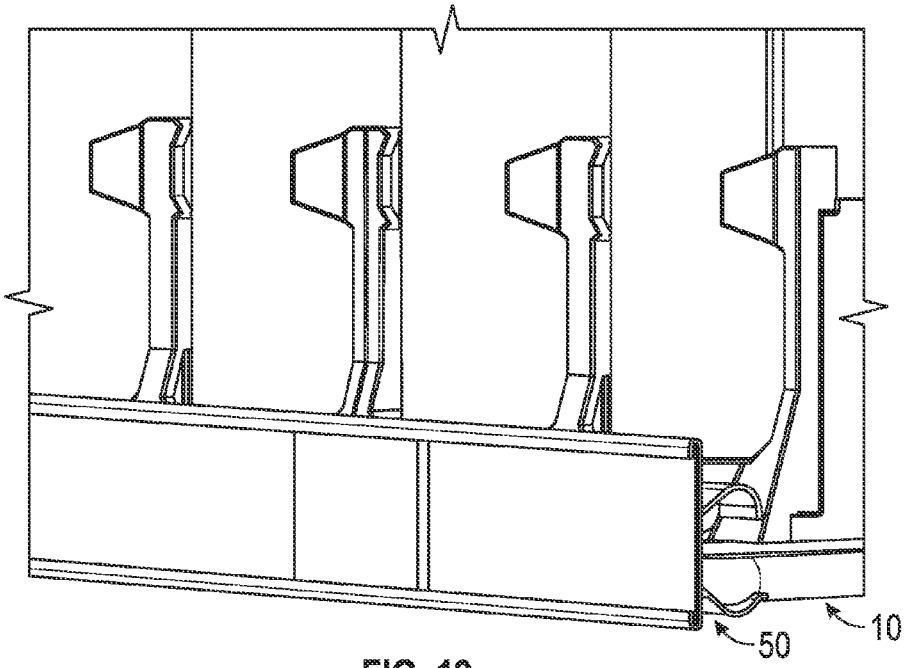
Figure 20:
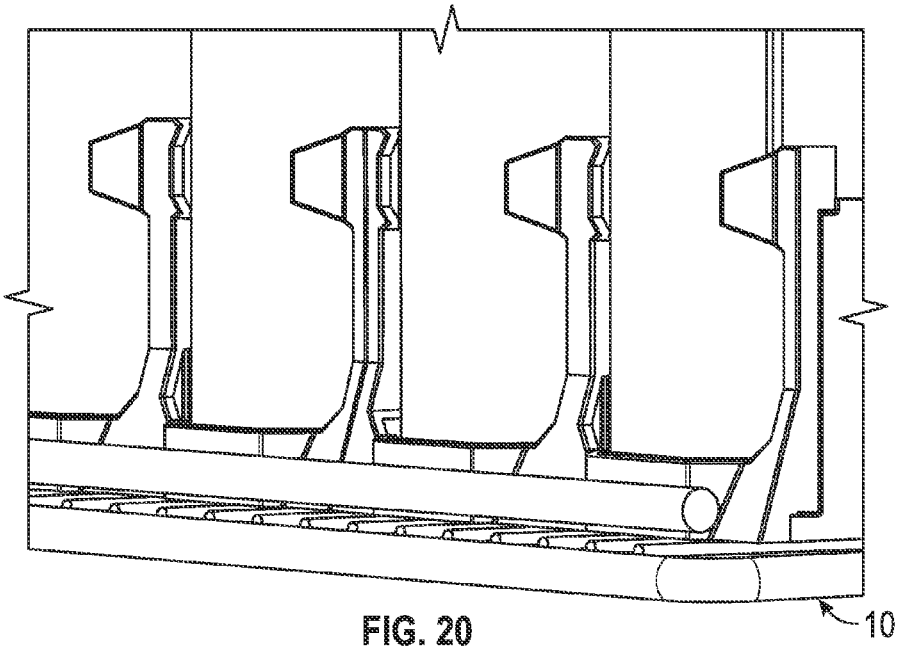
Figure 21:
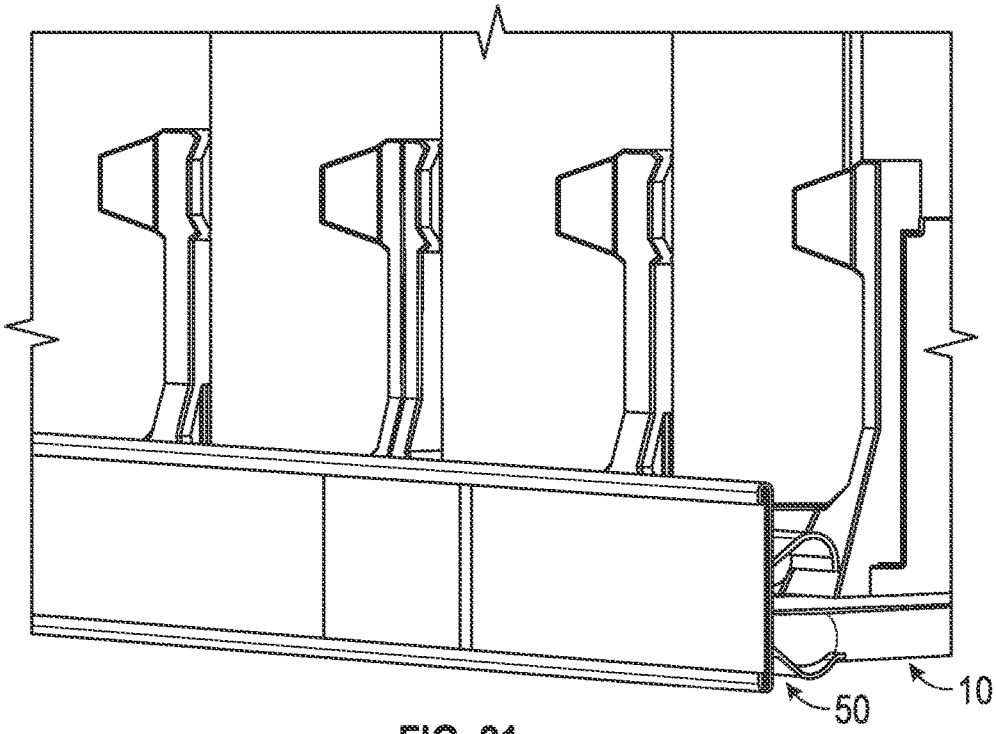
Figure 22:
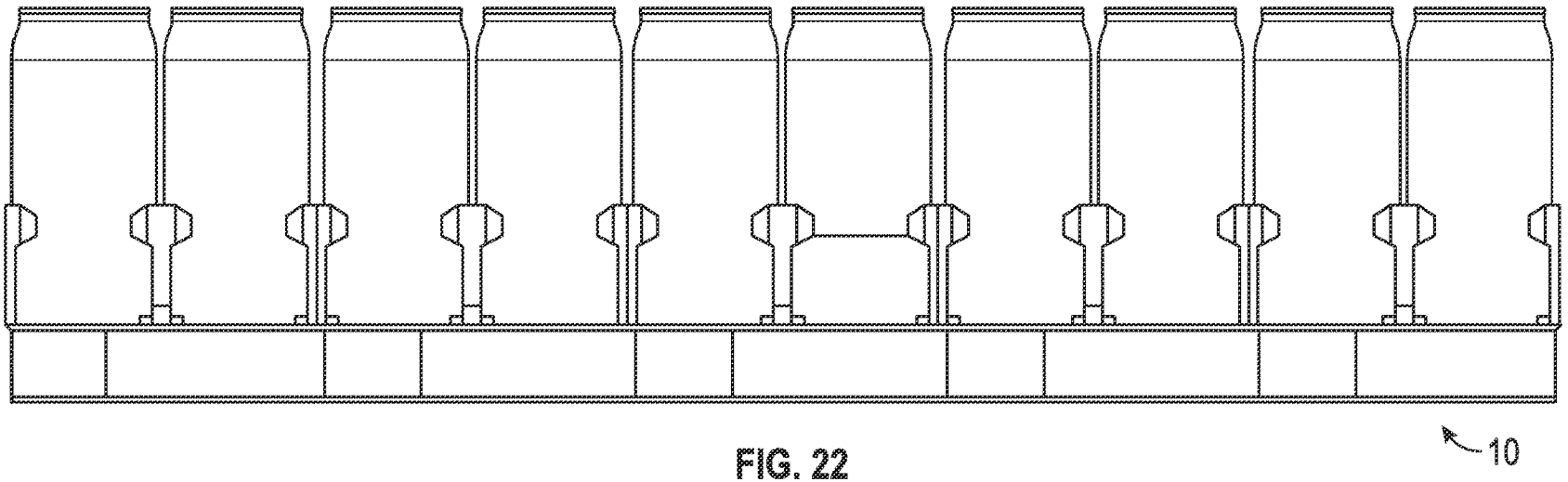
Figure 23:
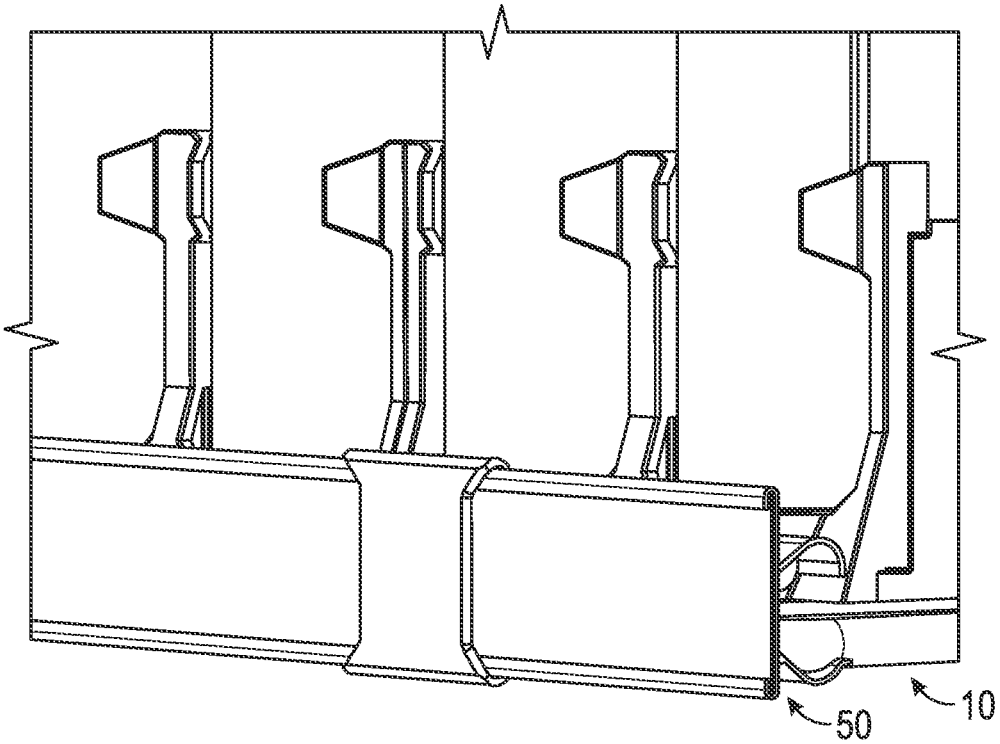
Figure 24:
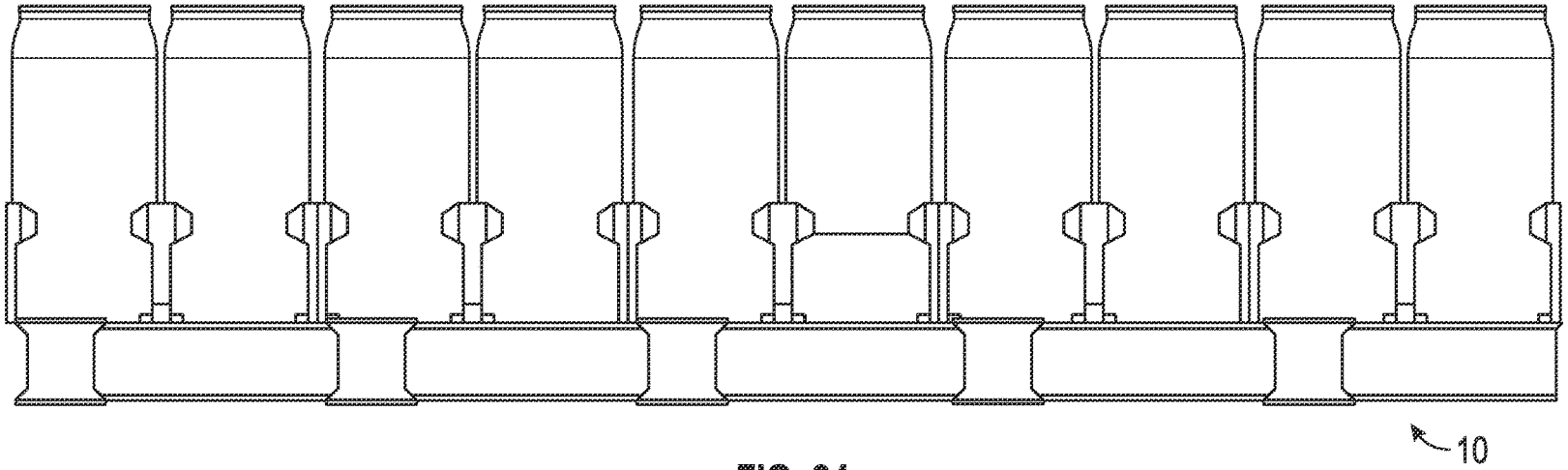
Figure 25:
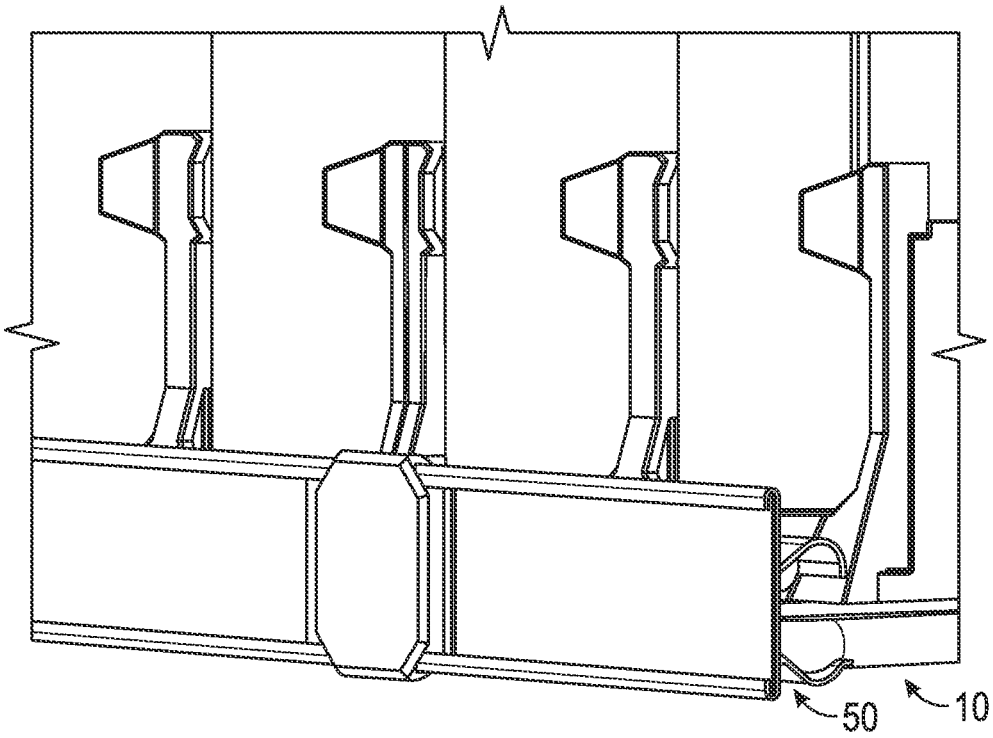
Figure 26:
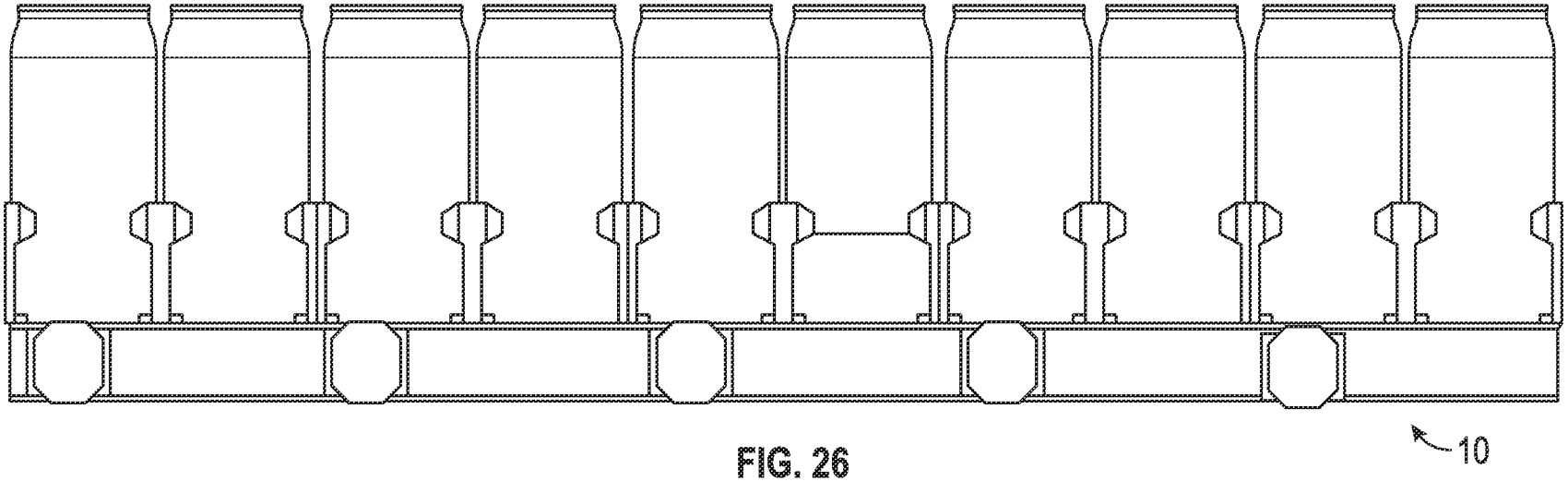
Figure 29:
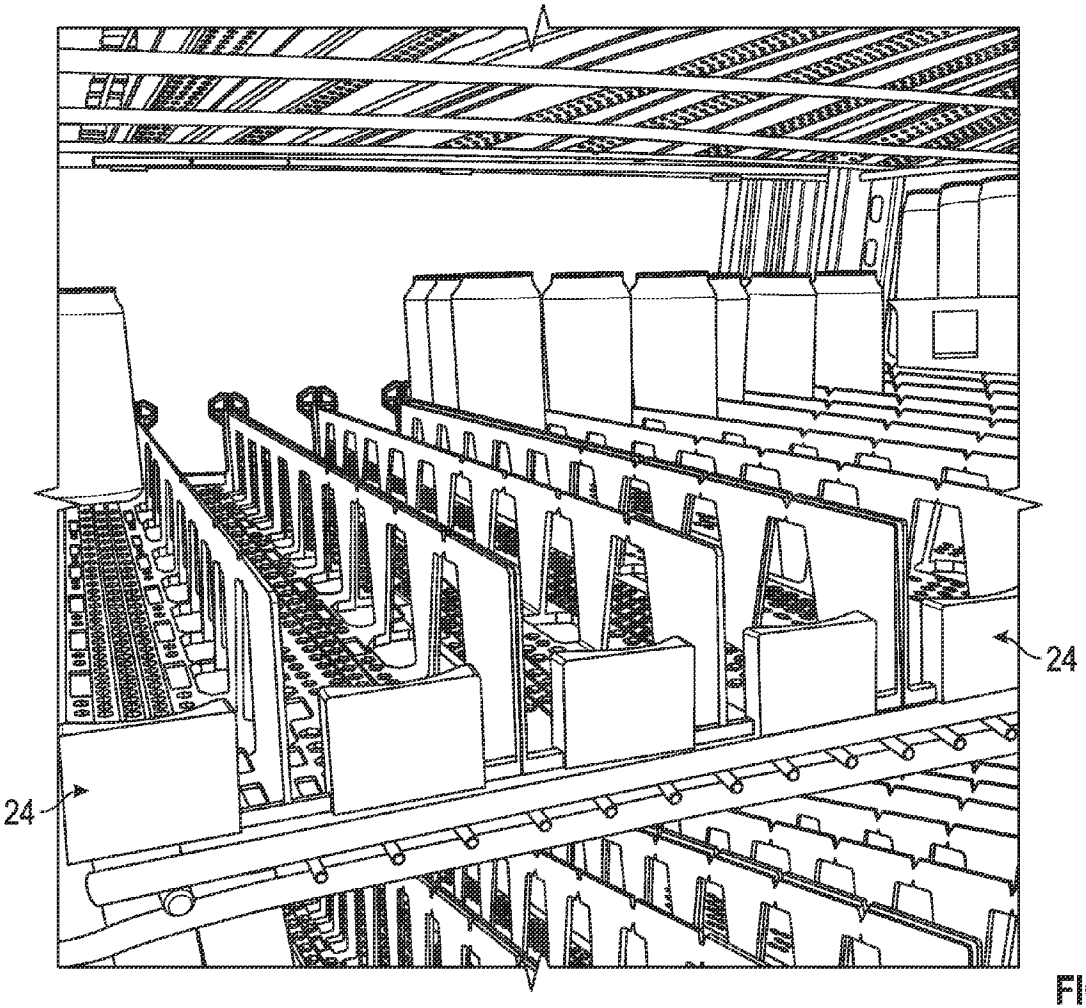
Figure 30:
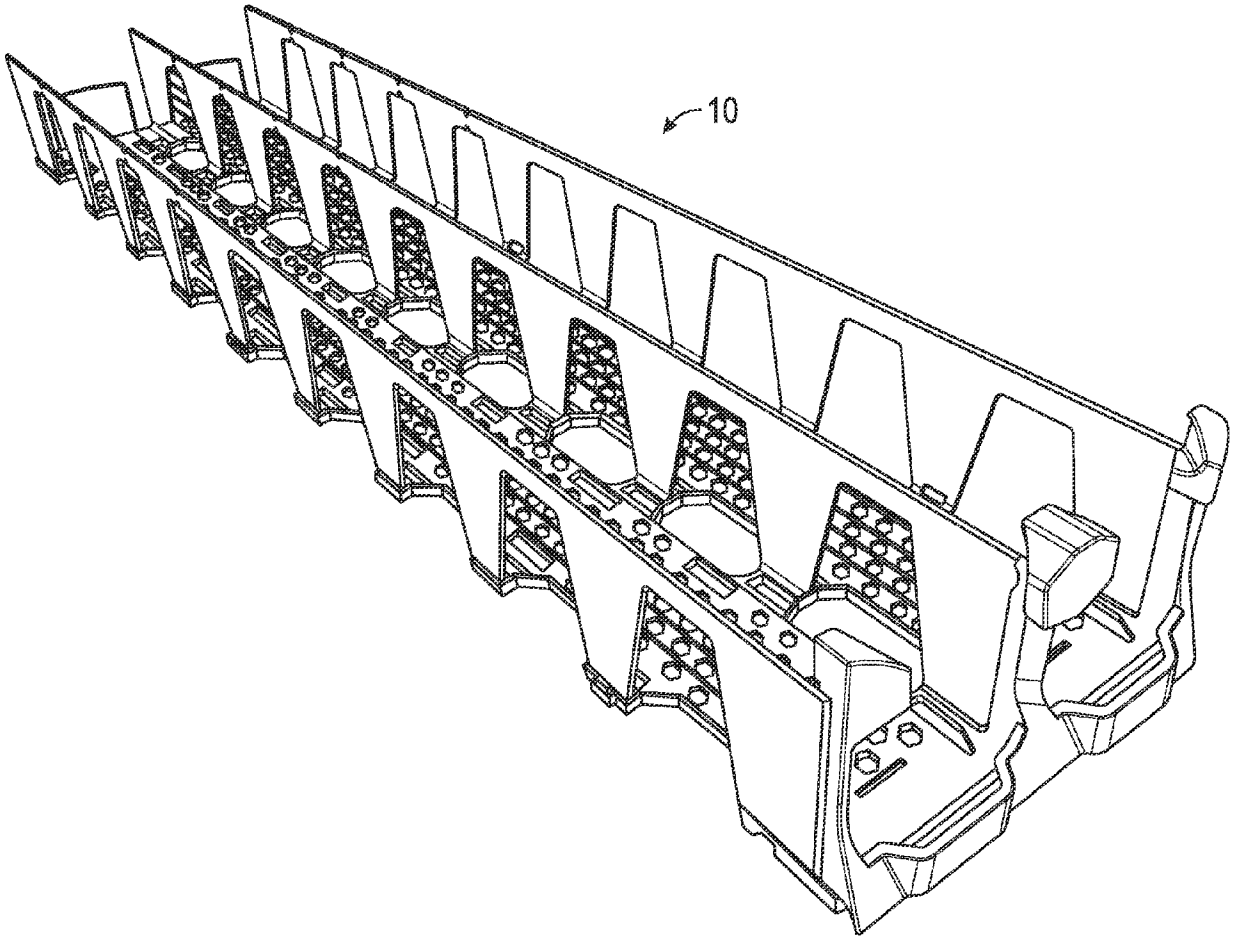
Figure 31:
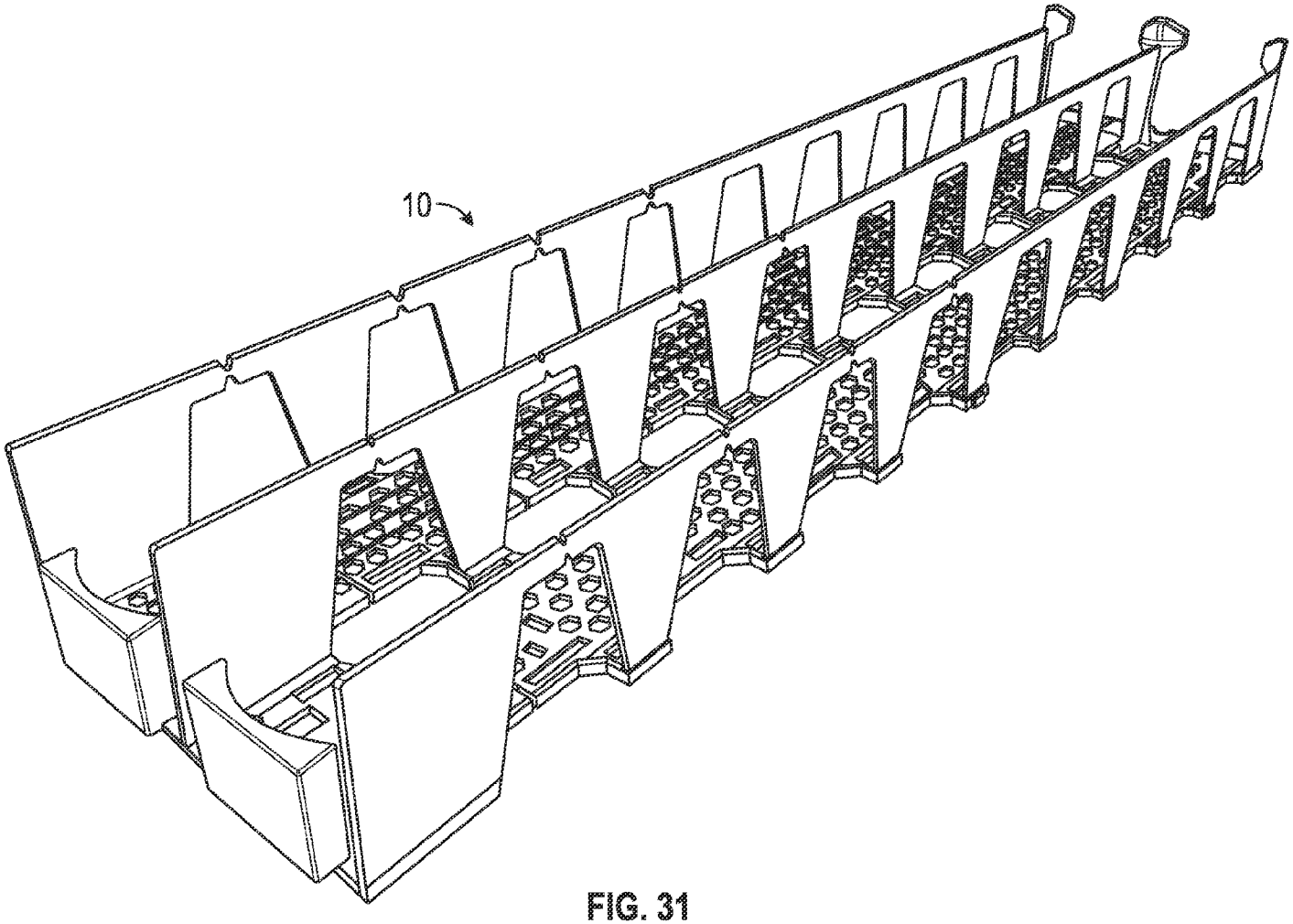

FIGS. 15-29 illustrate certain embodiments of the channel glide 10 in example retail settings. As shown in FIG. 15, different instances of the channel glide 10 can be stacked above each other, such as on adjacent shelves. As shown in FIG. 16, the front stop unit 16 can be removable. As shown in FIG. 17, some embodiments include the channel strip 50 and others do not. As shown in FIG. 18, the channel glide 10 can rest on a shelf, such as a shelf in a walk-in cooler or refrigerator. As shown in FIGS. 19 and 20, the channel glide 10 and/or the channel strip 50 can include marketing materials and/or other indicia. As shown in FIGS. 22-26, some embodiments are configured to dispense and/or display a plurality of columns of goods, such as 10 columns of goods. As shown in FIGS. 27 and 28, the channel strip 50 can include shields or emblems 57 that project outward from the front face of the channel strip 50, such as at least about 5 mm. As shown in FIG. 29, some or each of the columns can have a rear stop unit 24.

Figure 32:
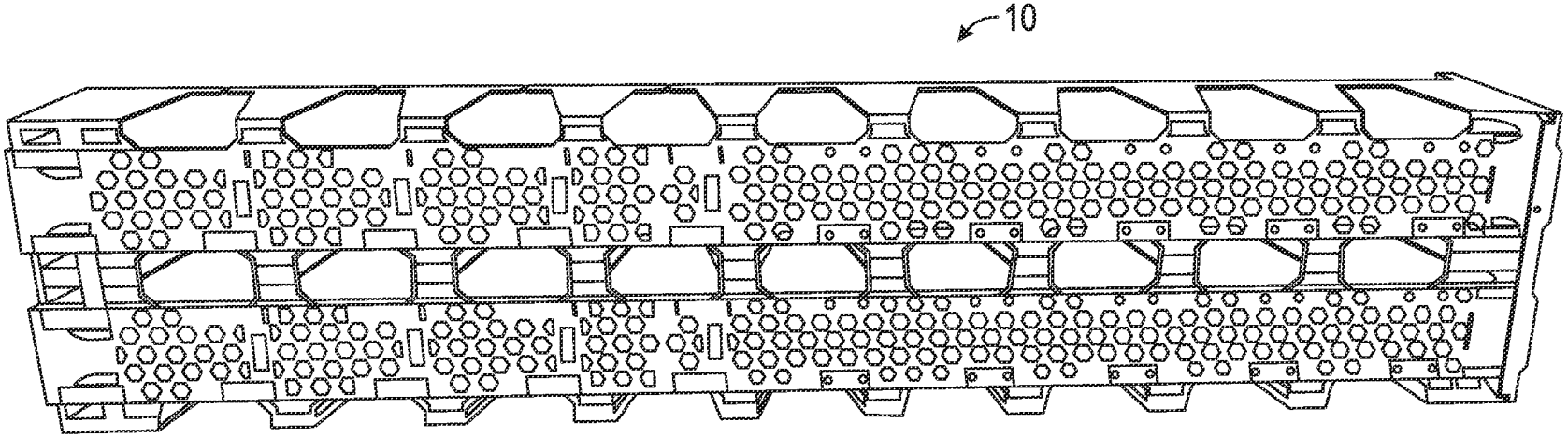
Figure 33:
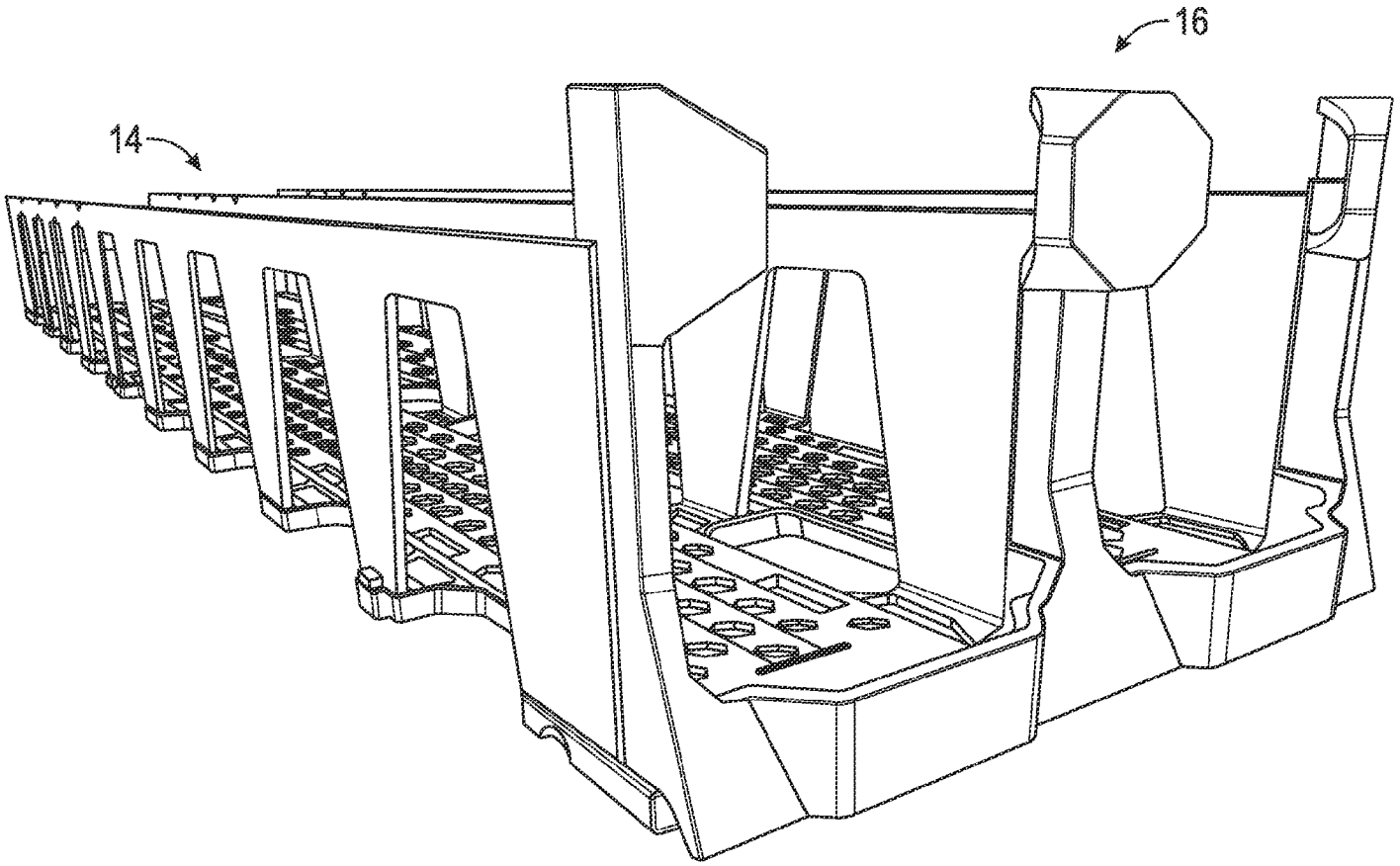
Figure 35:
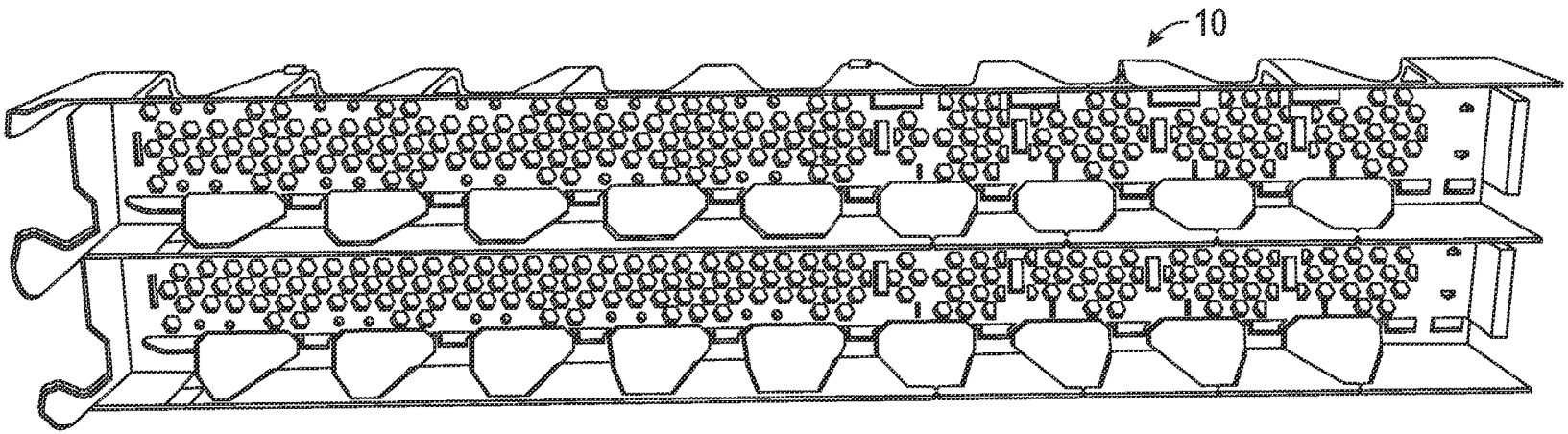
Figure 36:
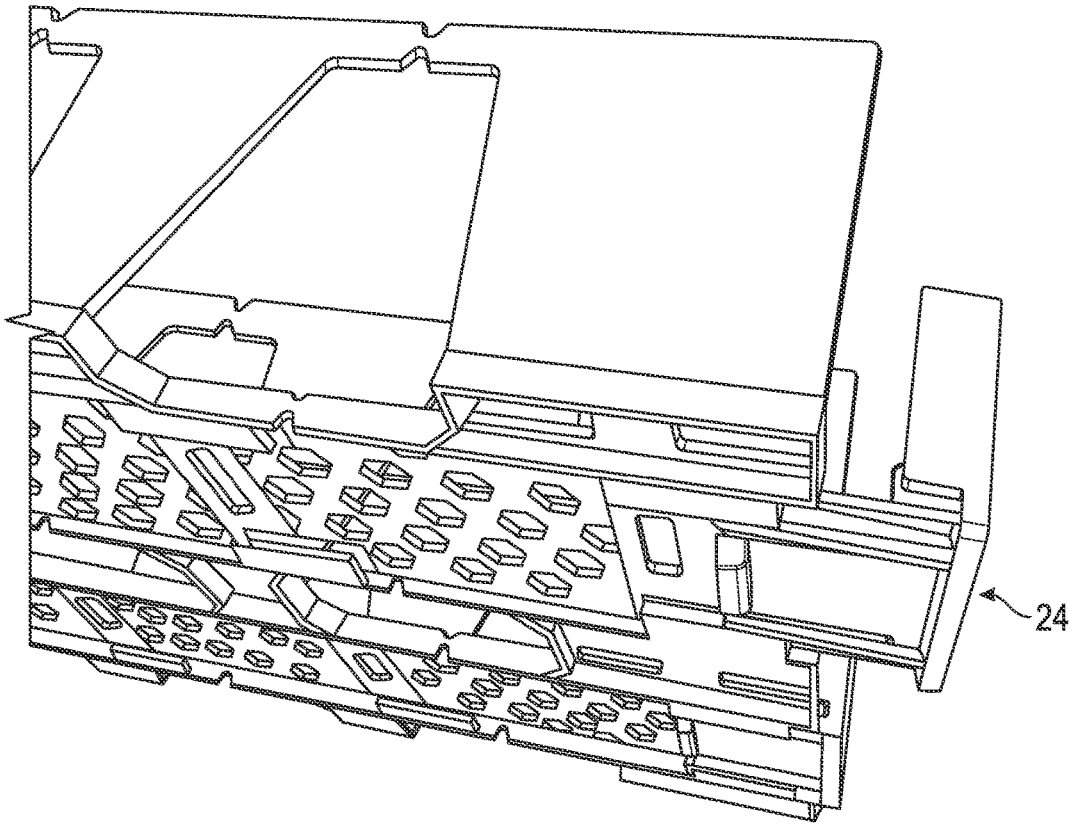
Figure 37:
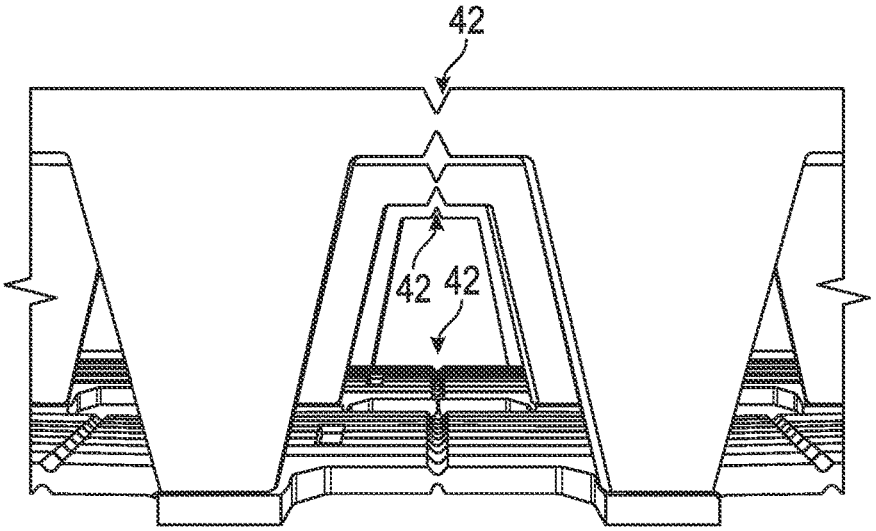
Figure 38:
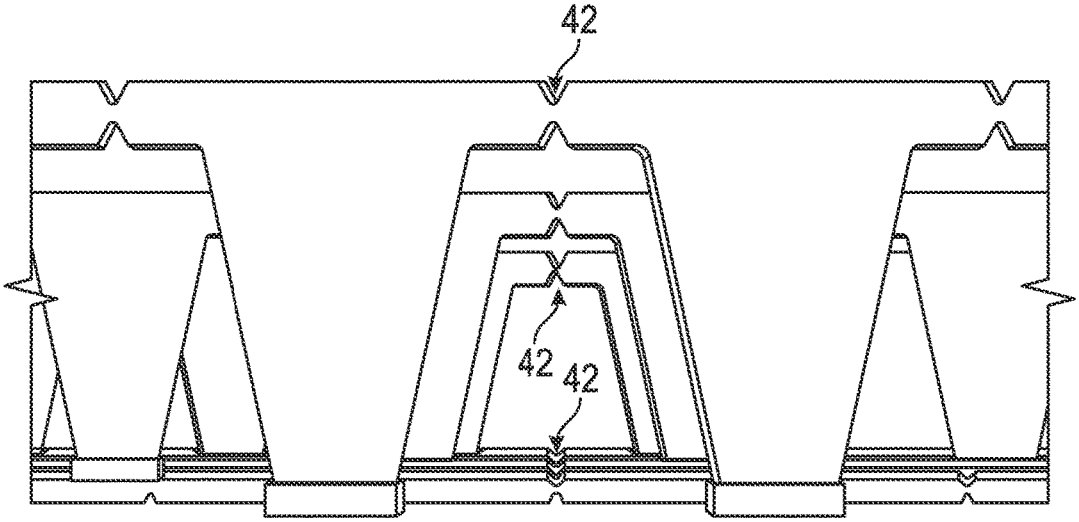

FIGS. 30-38 depict a non-limiting example of the channel glide 10. As shown, in FIGS. 30 and 31, the example is configured to hold two columns of goods. As shown in FIGS. 32 and 35, the example includes apertures in the bottom, which can allow air to pass through to cool the goods. As shown in FIGS. 33 and 34, in the example, the front stop unit 16 is taller than the fences 14. As shown in FIG. 36, the example includes the rear stop unit 24. As shown in FIGS. 37 and 38, the example includes break points 42 in the base 12 and the fences 14.

Figure 39:
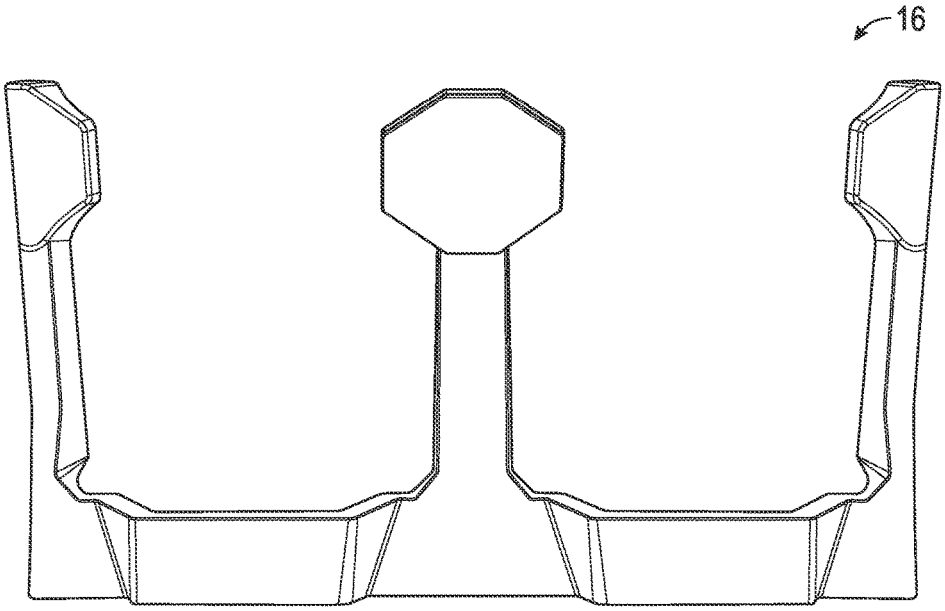
Figure 40:
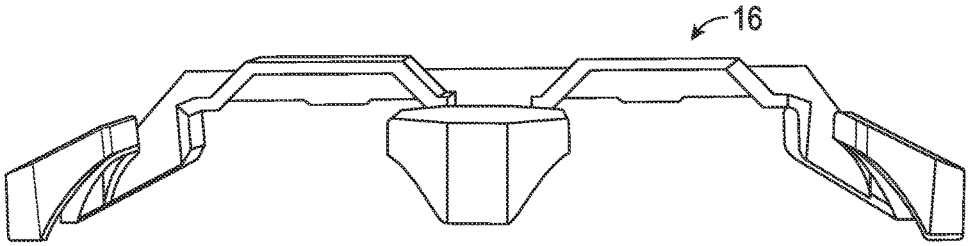
Figure 41:
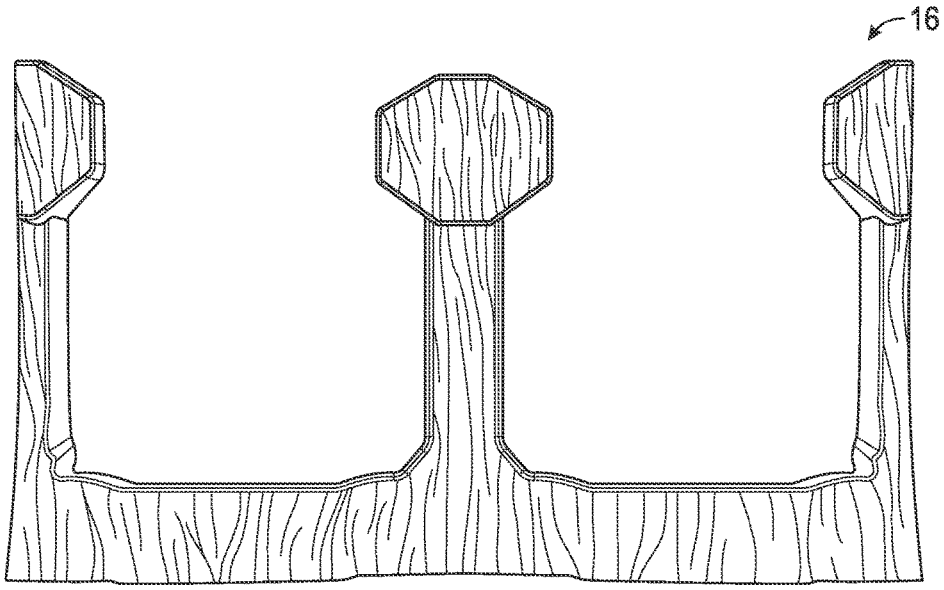
Figure 42:
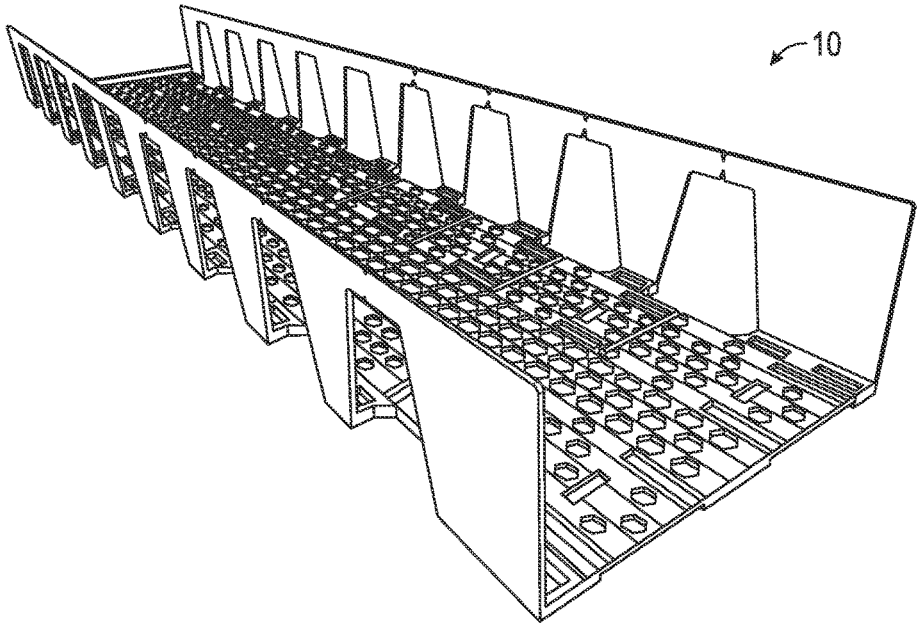
Figure 43:
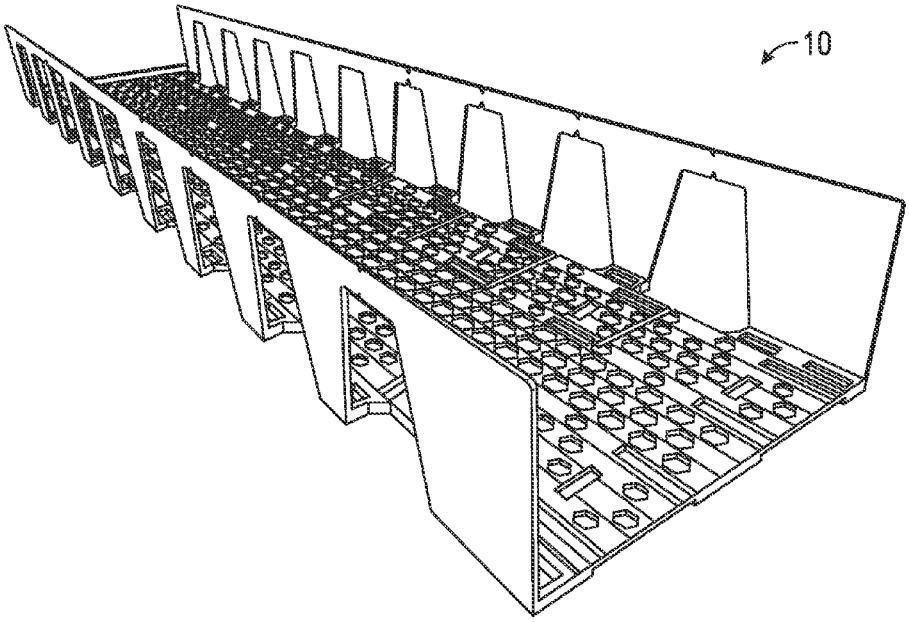
Figure 44:
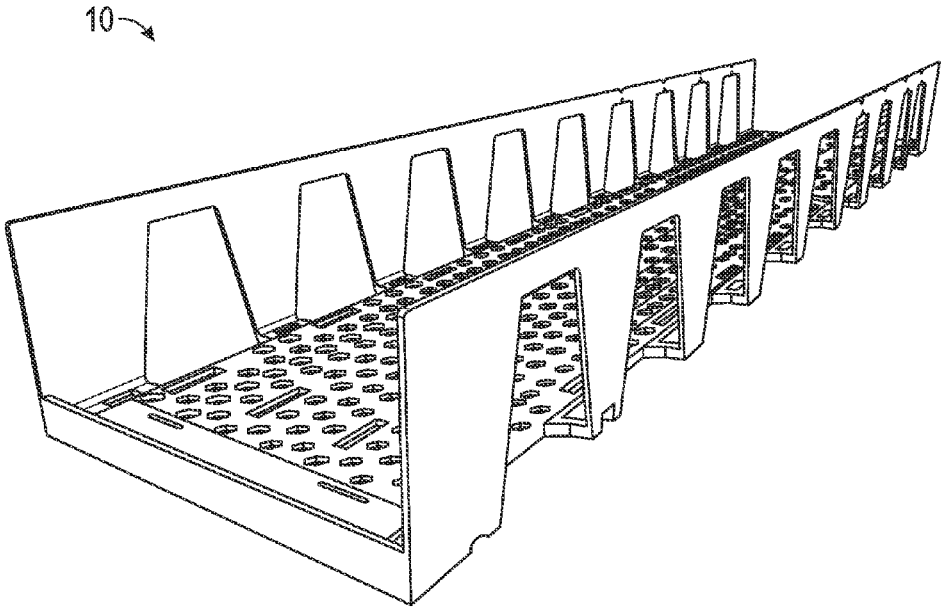
Figure 45:
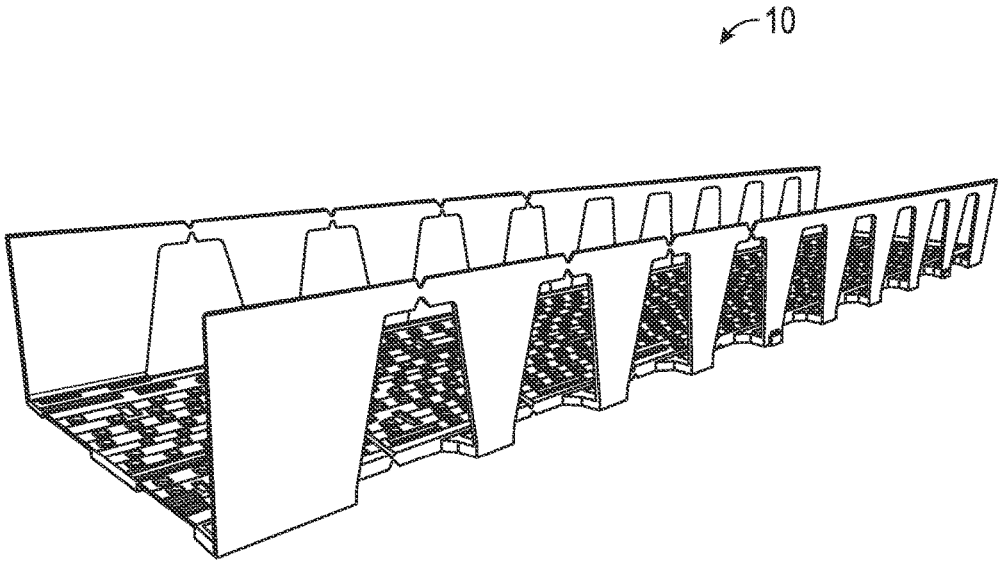
Figure 46:
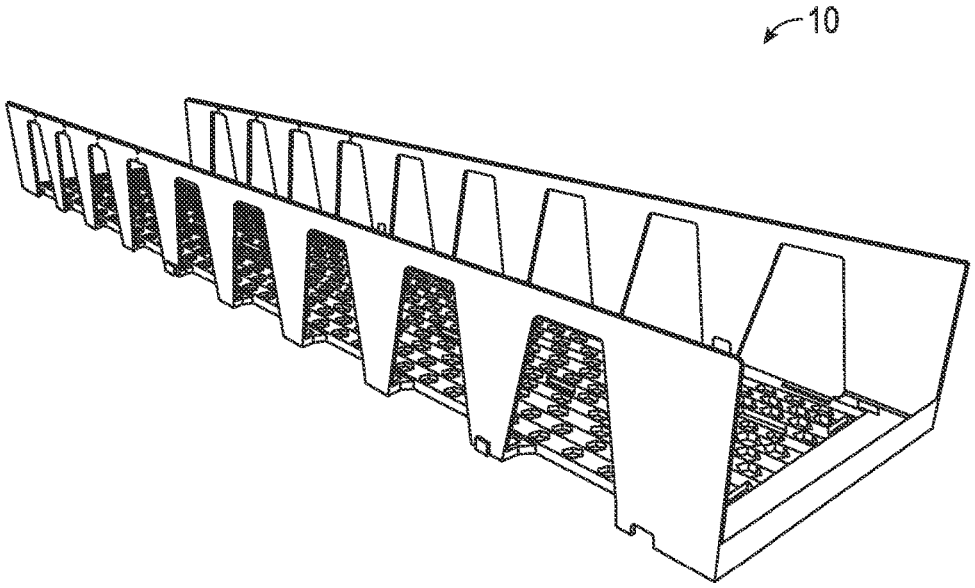
Figures 47A, 47B, 47C, 47D:
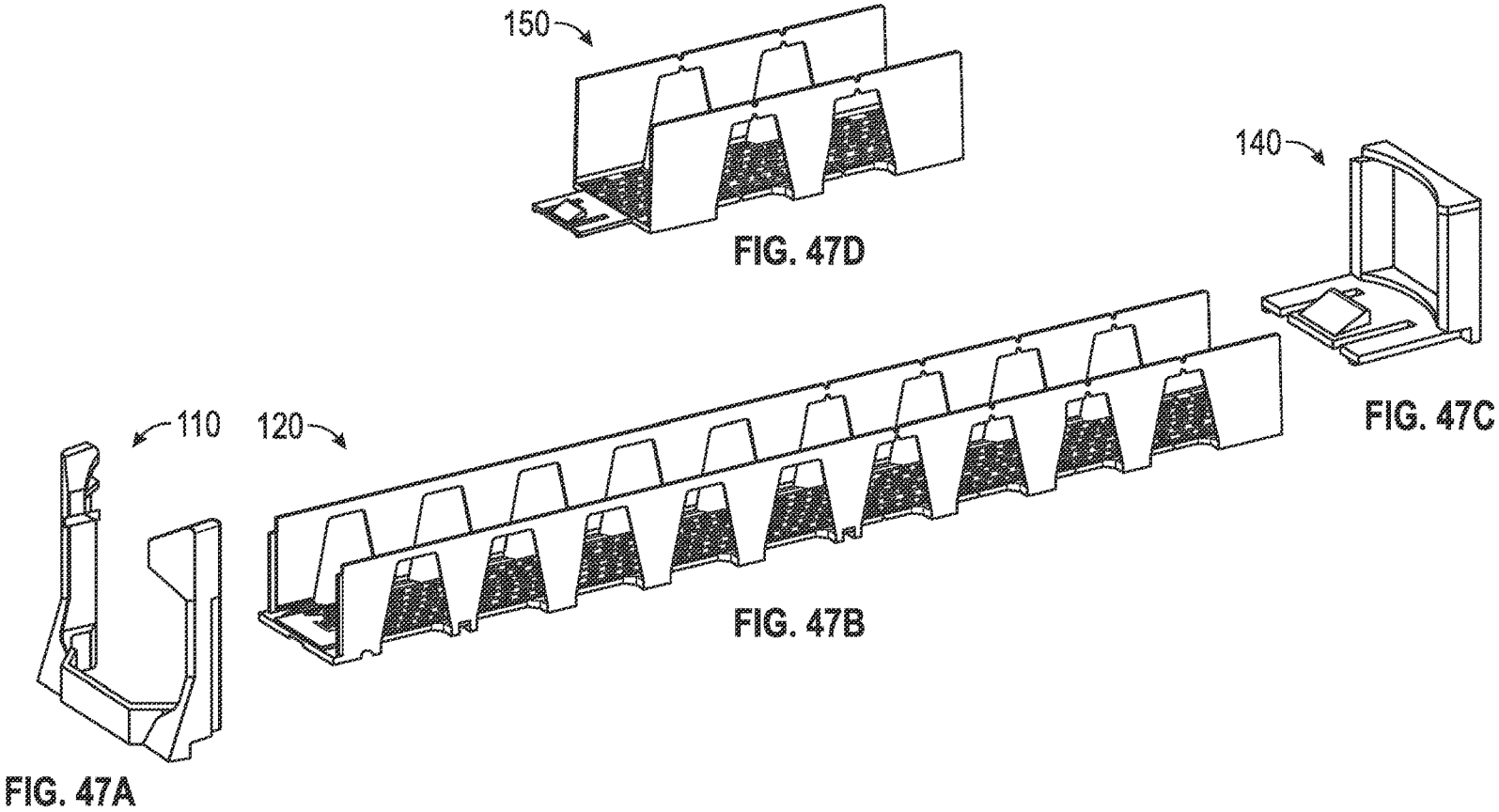
FIGS. 47A-47D illustrate an exploded perspective view of an embodiment of an article display device.

FIGS. 39-41 depict prototype non-limiting examples of the front stop unit 16. As shown in FIGS. 39 and 40, the front stop unit 16 can be generally matte, such as being a matte black. As shown in FIG. 41, the front stop unit 16 can have a woodgrain appearance.

FIGS. 42-46 depict another non-limiting example of the channel glide 10, such as an example configured to display and/or dispense multi-pack arrangements of cans. As shown, the example does not include an intermediate fence. The example can be configured to display and dispense a single column of larger goods and/or multiple columns of smaller goods. The smaller goods can be allowed to move between the columns, which can facilitate having goods at the front of the channel glide.

Certain Additional Embodiments

FIGS. 47A-47D illustrate another embodiment of a channel glide (also called a "merchandising track device") for displaying articles to a consumer. The channel glide can be similar to the channel glides discussed above and can include any of the features of the channel glides discussed above As shown, a front bracket 110 can be engageable with a track member 120. The form and appearance of the front bracket 110 and track member 120 are exemplary and are not limited to the design depicted. The track member 120 can include a base and one or more fences. The track member 120 can be generally elongate in a longitudinal direction. The track unit 120 can be engageable with corresponding portions of the front bracket 110 and with a back stop (also called a "rear stop unit") 140. As shown, some embodiment include a further track member (also called an "extension member" or an "extension") 150. The extension member can be elongate in a longitudinal direction.

The front bracket 110, track member 120, back stop 140, and extension member 150 can be made of plastic material such as Polypropylene, HIPS (High Impact Polystyrene), ABS (Acrylonitrile butadiene styrene), PC (Polycarbonate), PC+ABS—(Polycarbonate+Acrylonitrile butadiene styrene blend), PE—(Polyethylene) Nylon or similar such materials known to persons skilled in the art.

Referring now to FIGS. 48A-48D, there is depicted a side view of the arrangement of FIGS. 47A-47D. As shown, the side portion of the front bracket 110 can include a recess 112 for engagement with a corresponding protrusion 122 on a front portion 124 of the track member 120. The track member 120 can include one or more sidewalls (also called "fences") 114. The sidewalls 114 can include locking tabs 126 for inter-engagement with a corresponding elongate track member to form a merchandising track system.

As shown, frangible portions 128*a*, 128*b* can be formed in the top of the sidewalls 114 of the track member 120, a bottom of the sidewalls 114 of the track member 120, and/or in a base of the track member 120. The frangible portions or regions of the track can be configured to be broken, such as by repeated "wiggling" of the left track portion with respect to the right track portion at the predetermined frangible region. The frangible portions 128*a*, 128*b* thereby allow the overall length of the track member 120 to be adjusted. For example, if the channel glide is to be used in a narrow (e.g., shallow) display cabinet or refrigerator, the portions towards the right hand side of the track 120 depicted in FIG. 48B may not be needed (e.g., may not fit within the space in the display cabinet or refrigerator). The user can simply wiggle or flex the frangible portions so as to break the track member 120 at a frangible portion. No tools are required for this operation, and this is easily performed by untrained staff members.

Figure 48D:
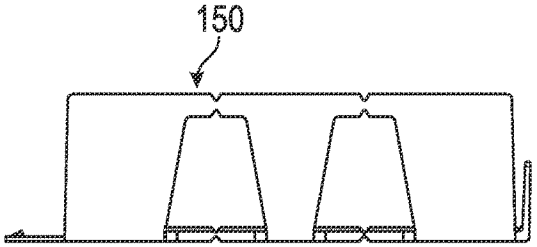
FIGS. 48A-48D illustrate a side view of the embodiment of FIGS. 47A-47D.
Figure 48C:
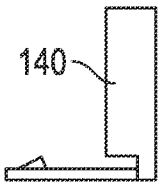
Figure 48B:
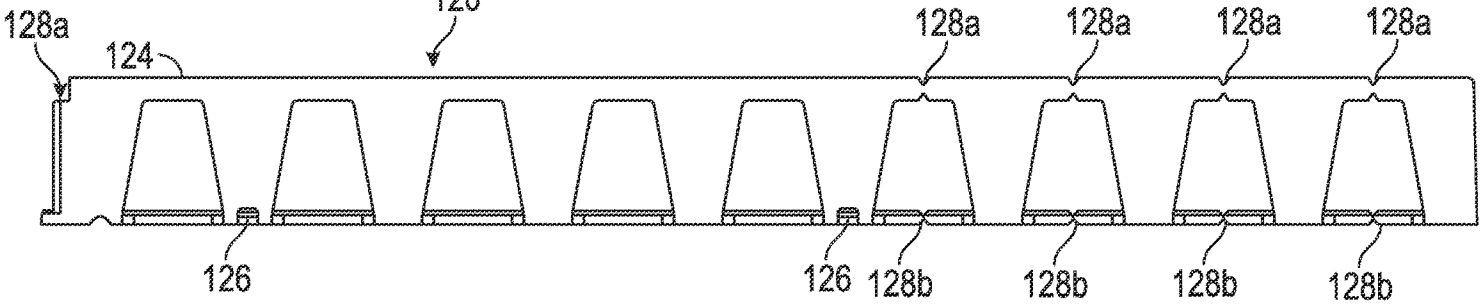
Figure 48A:
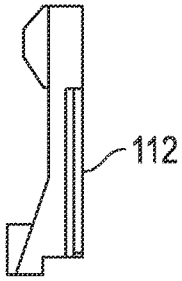
Figure 49:
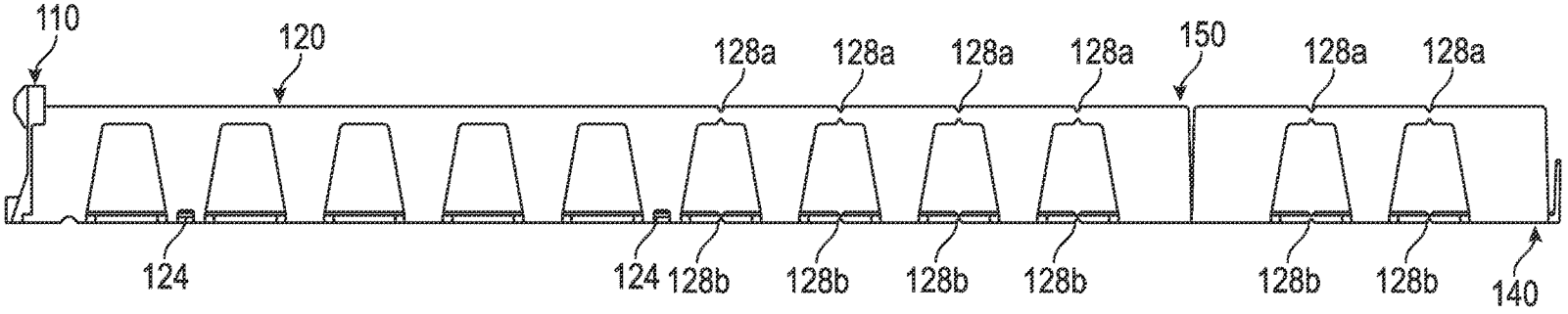
FIG. 49 illustrates a side view of the embodiment of FIGS. 47A-47D in an assembled configuration.

As shown in FIG. 48D, in some embodiments, the frangible portions may be included in the extension member 150. As shown in the engaged arrangement shown in FIG. 49, the frangible portions may be unbroken, and the extension member 150 may be engaged with the track member 120 as shown in FIG. 49. It is envisaged that such a larger track section could be used to contain articles in a deep display cabinet or refrigerator or the like. In some embodiments, if the extension member is engaged at the end of the longitudinally elongate track member 120, a stopper member 140 may be engaged at the end of the extension member.

Figure 50A:
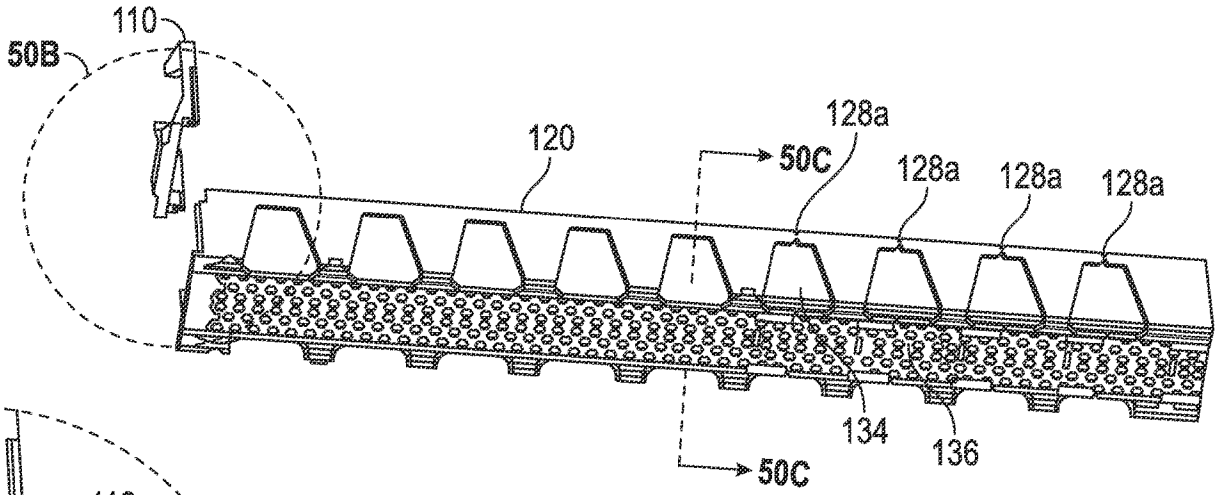
FIGS. 50A-50B illustrate perspective views of certain components of the embodiment of FIGS. 47A-47D, in which a sidewall has been removed for clarity.
Figure 50C:
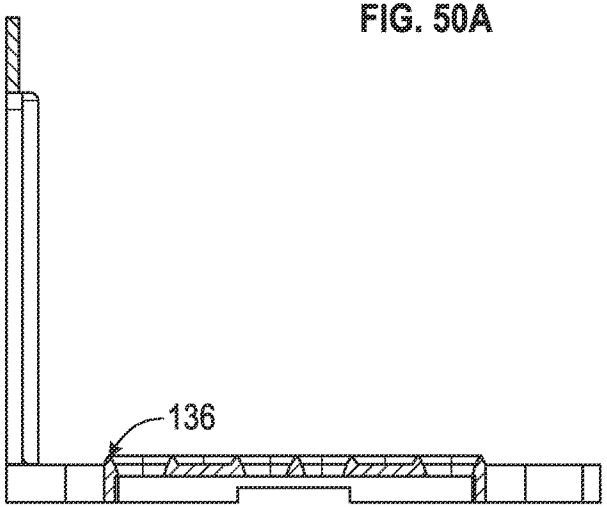
FIG. 50C illustrates a sectional view through a channel member of the embodiment of FIG. 50A.
Figure 50B:
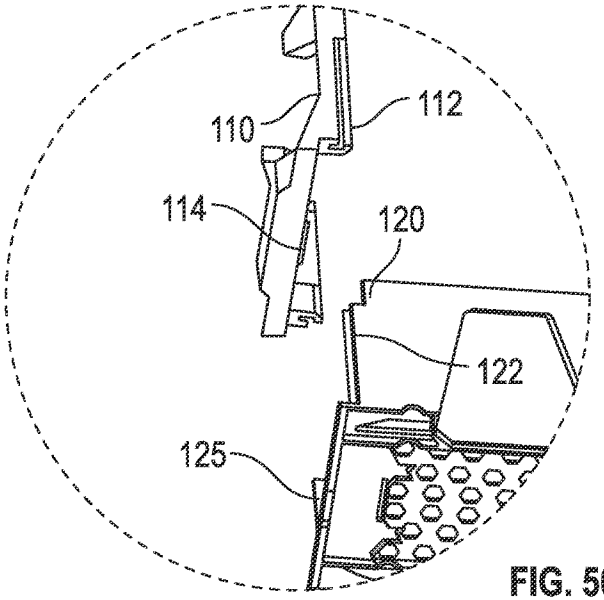

Referring now to FIGS. 50A-50C, there is depicted a perspective sectional and side view of an embodiment of the channel glide of FIGS. 47A-47D. For purposes of presentation, the front bracket 110 is shown spaced apart from the track member 120. As shown, the front bracket 110 and the track member 120 can have features to couple these components together. For example, the track member 120 can have a tab 122 for engagement with a slot 112 of the front member 110. Some embodiments have a locking tab 125 on the web portion of the track member 120. The locking tab 125 can facilitate a push or snap fit of the front member 110 with the track member 120. This engagement of the locking member 125 with the front member 110 can be configured so as to be releasable, such that the front member 110 is removable and detachable from the track member 120.

The frangible portions 128*a* can be seen formed in the top of the sidewall 114 of the track member 120. In some embodiments, the track member 120 includes holes or apertures 134 in the sidewalls and/or the base 136. The holes 134, 136 can be of any size or configuration. The holes 134, 136 can facilitate cooling of the article placed thereon, as well as reducing the amount of material used in the construction of the track device. The size and dimensions of the holes 134, 136 can be selected to integrate with the overall impression and/or trade dress of the product to be displayed.

Figure 51A:
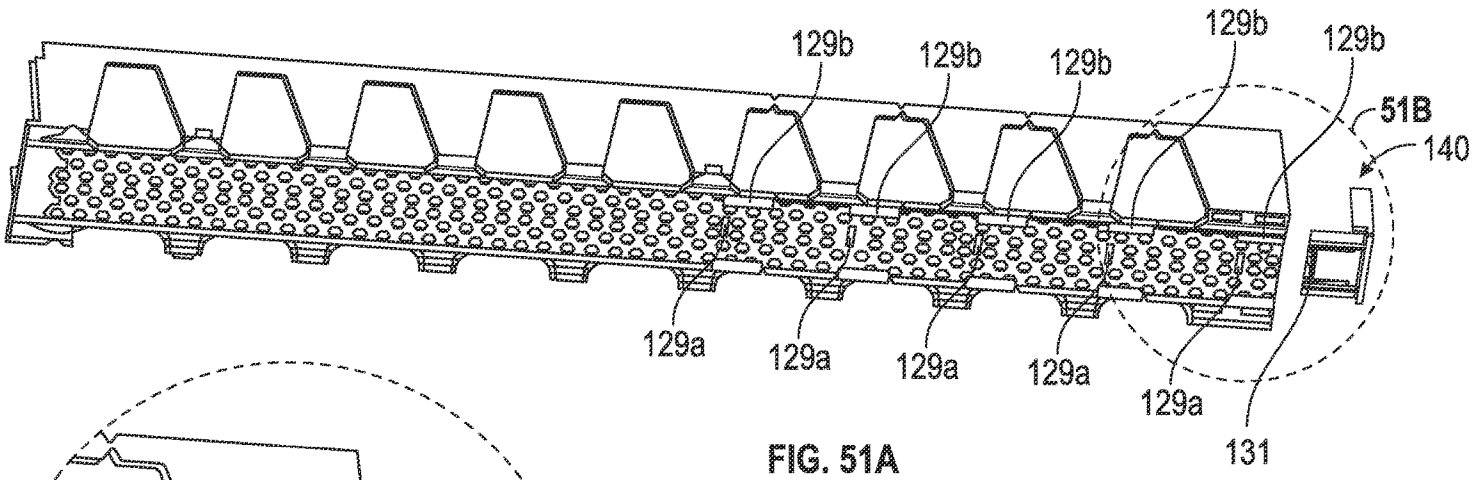
FIGS. 51A and 51B illustrate perspective views of components of the embodiment of FIGS. 47A-47D.
Figure 51B:
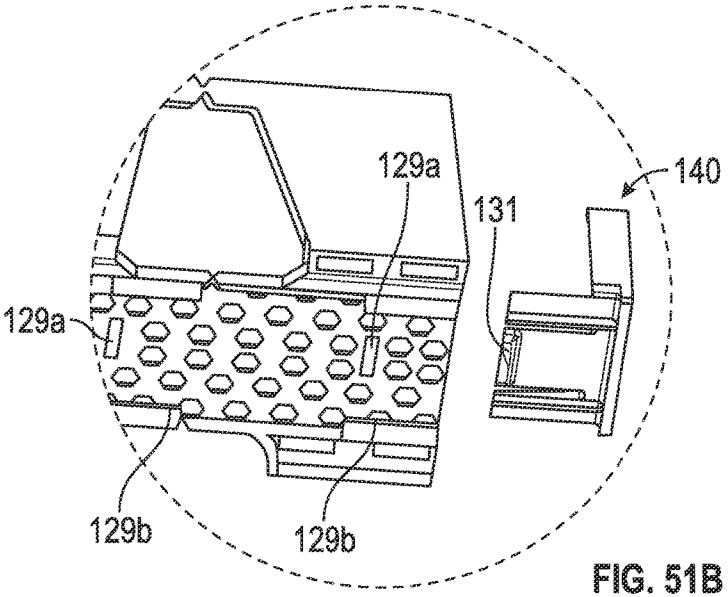

As shown in FIGS. 51A and 51B, the back stop 140 can engage with the track member 120 or the extension member 150. In some embodiments, such engagement may be facilitated with the cooperation of a locking tab 131 of the back stop 140 with a central recesses 129*a* and/or side locking guides or rails 129*b* of the track member 120 or extension member 150. In some embodiments, engagement of the back stop 140 with the track member 120 is facilitated with the cooperation of a tab (not shown) of the track member 120 or extension member 150. The central locking tab 131 on the back stop 140 can engage the central recess 129*a*. The locking guides or rails 129*b* of the track member 120 can be received in corresponding recesses in the back stop 140, so as to engage these members with the track member 120.

In various embodiments, the extension member 150 is configured to couple with the track member 120, such as with the same or similar mechanisms as described above in connection with the back stop 140. For example, a central locking tab on the extension member 150 can engage the central recess 129*a* of the track member 120 and/or locking guides or rails of the track member 120 can be received in corresponding recesses in the extension member 150, so as to engage these members with the track member 120. The engagement of the back stop 140 and/or the extension member 150 with the track member 120 can allow the size of the channel glide to be adjusted, such as to accommodate additional articles, display case size, etc. The size of the track may be reduced, for example, if the stock of articles is running low, if the display case is smaller (e.g., shallower) than typical, etc.

Figure 52:
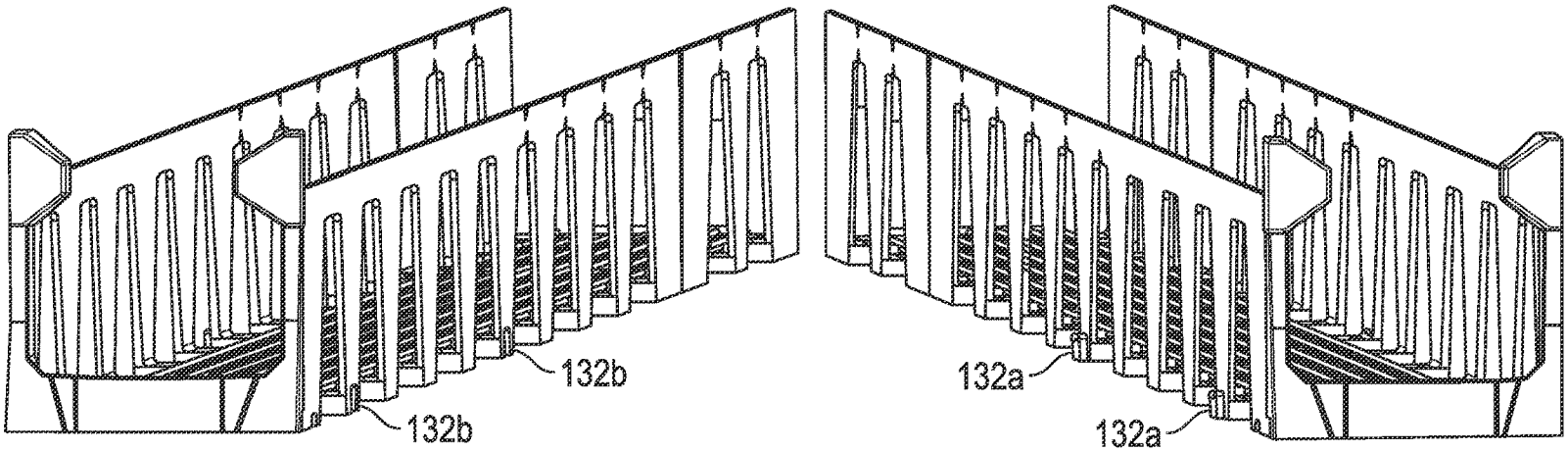
FIG. 52 illustrates a perspective view of certain components of the embodiment of FIGS. 47A-47D.

Turning to FIG. 52, there is depicted a perspective view of two elongate channel showing the locking tabs 132*a* and corresponding locking recesses 132*b* formed in the sidewalls. The tabs 132*a* and recesses 132*b* can be configured to cooperate, to join along the longitudinal sidewalls adjacent longitudinal elongate tracks, to form a merchandising track system. Although two such tracks are shown, additional tracks could be added with similar principles.

Figure 53A:
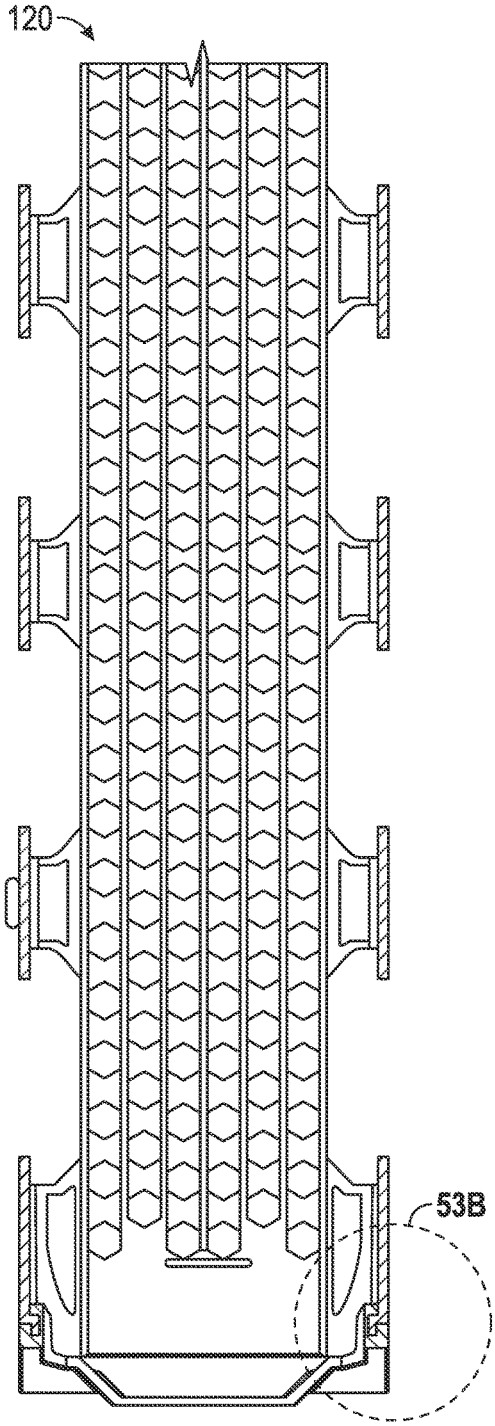
FIG. 53A illustrates a plan view of the channel member of the embodiment of FIGS. 47A-47D.
Figure 53B:
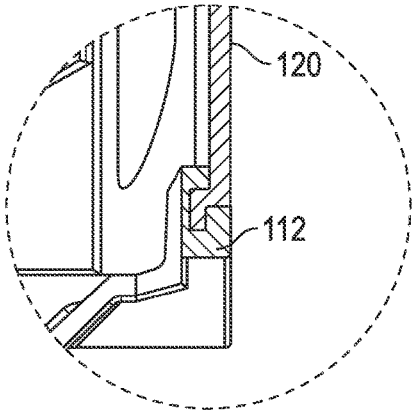
FIG. 53B illustrates an exploded sectional view of the circled region of FIG. 53A.
Figure 53C:
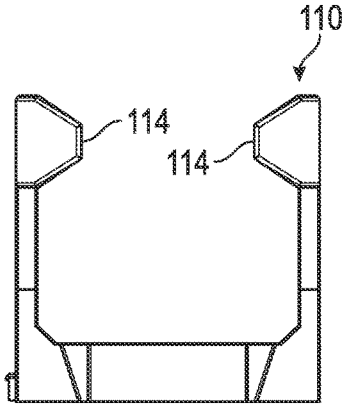
FIG. 53C illustrates a front view of a front bracket of the embodiment of FIG. 47A.

Referring now to FIGS. 53A-53C, there is shown a top view, sectional front view, and front view of the front (with sidewalls removed for ease of reference). The track member 120 is shown engaged with the front bracket 110. It can be seen that the recess 112 in the front bracket 110 mates with a portion of the track member 120. For example, as shown, the recess can have a generally "C" shaped arrangement and engage with a generally "L"-shaped tab of the end portion of the track member 120. A number of arrangements of such engagement would be possible.

As shown, the front bracket 110 can include protrusions 114. As shown, the protrusions 114 only partially extend across the channel when the front bracket is engaged with the track member 120. This can maintain a display of substantially all of the front base of the first article in the channel and/or can provide clear visual display of the front surface of the article, which assists in the purchasing decision of a consumer.

Certain Terminology

Although the channel glide assemblies have been disclosed in the context of certain embodiments and examples, it will be understood by those skilled in the art that the assemblies extend beyond the specifically disclosed embodiments to other alternative embodiments and/or uses of the embodiments and certain modifications and equivalents thereof. For example, although channel glides with two channels are depicted in some of the figures, the disclosed inventive concepts can be used in connection with a wide variety of channel glide configurations. For example, some embodiments have one channel, three channels, four channels, or more. Moreover, as mentioned above, the description describes, and several figures show, the channel glide in the context of holding beverage cans. However, this is illustrative only and is not intended to be limiting. The channel glide can be configured to hold and dispense a variety of other goods, such as bottles, jugs, tins, cups, boxes, packages, or otherwise. Use with any product is expressly within the scope of this invention. Various features and aspects of the disclosed embodiments can be combined with or substituted for one another in order to form varying modes of channel glides or channel strips. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Some embodiments have been described in connection with the accompanying drawings. The figures are to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

SUMMARY

In summary, various embodiments and examples of glide channel assemblies have been disclosed. Although the assemblies have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

The following is claimed:

1. A channel glide system comprising:

a main body portion comprising:

a base comprising a first channel configured to receive a first column of generally cylindrical beverage containers and a second channel configured to receive a second column of generally cylindrical beverage containers;

a first fence on a lateral outside side of the first channel;

a second fence on a lateral outside side of the second channel;

an intermediate fence positioned between the first and second channels; and a rear connection feature on a rear of the main body portion;

a front stop unit removably connected with the main body portion, the front stop unit being opaque and a different material than the base, the front stop unit comprising:

a bottom portion;

a lower wall extending upwardly from the bottom portion;

a first side pillar with an upper end comprising a first catch; and a second side pillar with an upper end comprising a second catch;

wherein a front-most portion of the lower wall extends forward of a front-most portion of the first and second catches;

the first and second catches and the lower wall being configured to engage the front-most beverage container in the first column such that a portion of the beverage container projects forward of the front-most portion of the first and second catches and is recessed behind and in contact with the lower wall;

the first and second side pillars each having a top, a bottom, and an intermediate portion between the top and the bottom, the top and the bottom being laterally wider than the intermediate portion;

a rear stop unit comprising a first front connection feature that is configured to connect and disconnect with the rear connection feature of the main body; and an extension portion comprising:

an extension base portion;

an extension first fence portion;

an extension second fence portion;

a second front connection feature on a front of the extension portion, the second front connection feature being configured to connect and disconnect with the rear connection feature of the main body portion such that the extension portion can be decoupled from and recoupled to the main body portion; and a plurality of break features, the plurality of break features configured to be frangibly activated to separate a rear of the extension portion from the front of the extension portion.

2. The channel glide system of claim 1, wherein the rear portion of the channel glide comprises a plurality of break points such that a selectable part of the rear portion can be separated from a front portion of the channel glide.

3. The channel glide system of claim 1, wherein the hardness of the front stop unit is greater than the hardness of the base.

4. The channel glide system of claim 1, wherein the front stop unit has a woodgrain appearance.

5. The channel glide system of claim 1, wherein the front stop unit is slidably engaged with the first fence, second fence, and intermediate fence.

6. The channel glide system of claim 1, wherein the first and second catches are angled toward a longitudinal centerline of one of the channels and toward the front of the channel glide.

7. The channel glide system of claim 1, wherein:

the first fence further comprises a first connection member and the second fence further comprises a second connection member;

the first connection member is configured to engage a second connection member of another channel glide that is laterally adjacent to the first fence; and the second connection member configured to engage a first connection member of another channel glide that is laterally adjacent to the second fence.

8. A product display and dispensing system comprising:

the channel glide system of claim 1; and a channel strip comprising:

a body having a front face configured to receive indicia;

a plurality of clamping members configured to engage a shelf on which the channel glide rests; and a plurality of scores on the channel strip, the scores being about equally spaced and configured to facilitate breaking of the channel strip at a predetermined length.

9. The system of claim 8, wherein the predetermined length is approximately the lateral width of the channel glide.

10. The system of claim 8, wherein a lower edge of the channel strip is closer to the ground than the lower edge of the channel glide.

11. The system of claim 8, further comprising a relief element received on the front face, a forward-most part of the relief element extending forward of a forward-most part of the body.

12. The system of claim 11, wherein the relief element comprises a logo.

13. The channel glide system of claim 1, wherein:

the extension portion further comprises a rear connection feature on a rear of the extension portion; and the front connection feature of the rear stop unit is configured to couple and decouple with the rear connection feature of the main body and, separately, to couple and decouple with the rear connection feature of the extension portion.

14. The channel glide system of claim 1, wherein:

the front stop further comprises a first slidable connection feature;

a front of the first fence and a front of the second fence each comprise a second slidable connection feature; and one of the first and second connection features comprises a rail, and the other of the first and second connection features comprises a track configured to slidably receive the rail such that the front stop unit is slidably engagable with the front of the first and second fences, the engagement between the first and second connection features inhibiting removal of the front stop from the first and second fences in a frontward direction generally parallel with a longitudinal axis of the main body.

15. The channel glide system of claim 1, wherein the base is configured to support a plurality of containers on a plane, and wherein the front stop is configured to slidably engage with the first fence and the second fence in a direction that is generally perpendicular with the plane.

16. The channel glide system of claim 1, wherein the extension portion is configured to be disconnected from the main body portion without breaking any of the break portions.

17. The channel glide system of claim 1, wherein the rear stop unit is configured to directly connect to the main body portion and the extension portion is configured to directly connect with the main body portion.

18. The channel glide system of claim 1, wherein the first and second catches are configured to engage the front-most beverage container in the first column such that a bottom portion of the beverage container projects forward of the front-most portion of the first and second catches.

19. The channel glide system of claim 1, wherein the top of the pillar is laterally at least twice as wide as the intermediate portion.

20. The channel glide system of claim 1, wherein the base further comprises a plurality of hexagonal apertures.

* * * * *